US008986114B2

(12) United States Patent
Emori et al.

(10) Patent No.: US 8,986,114 B2
(45) Date of Patent: Mar. 24, 2015

(54) CASINO TABLE CAPABLE OF TRACKING GAMING CARDS

(75) Inventors: Kazuki Emori, Koto-ku (JP); Hiroyuki Watanabe, Koto-ku (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 181 days.

(21) Appl. No.: 12/956,677

(22) Filed: Nov. 30, 2010

(65) Prior Publication Data

US 2011/0127722 A1 Jun. 2, 2011

(30) Foreign Application Priority Data

Dec. 1, 2009 (JP) ..... 2009-273595

(51) Int. Cl.
*A63F 9/24* (2006.01)
*G07F 17/32* (2006.01)

(52) U.S. Cl.
CPC ..... *G07F 17/32* (2013.01); *G07F 17/322* (2013.01); *G07F 17/3241* (2013.01)
USPC ..... 463/29

(58) Field of Classification Search
CPC ..... G07F 17/322; G07F 17/3241; A63F 2003/00164
USPC ..... 463/1, 47, 48, 29; 273/292, 293, 296, 273/149 R
See application file for complete search history.

(56) References Cited

U.S. PATENT DOCUMENTS

| | | | | |
|---|---|---|---|---|
| 5,941,769 | A | 8/1999 | Order | |
| 2005/0272501 | A1 * | 12/2005 | Tran et al. | 463/29 |
| 2006/0252521 | A1 * | 11/2006 | Gururajan et al. | 463/29 |

FOREIGN PATENT DOCUMENTS

| | | |
|---|---|---|
| JP | 05-127724 | 5/1993 |
| JP | 09-285594 | 11/1997 |
| JP | 10-508236 | 8/1998 |
| JP | 2002-239180 | 8/2002 |
| JP | 2007-061394 | 3/2007 |
| JP | 2008-123372 | 5/2008 |
| JP | 2009-219588 | 10/2009 |
| WO | WO 96/14115 | 5/1996 |

* cited by examiner

*Primary Examiner* — David L Lewis
*Assistant Examiner* — Robert Mosser
(74) *Attorney, Agent, or Firm* — Lexyoume IP Meister, PLLC

(57) ABSTRACT

The present invention is to provide a casino table capable of adequately determining whether a dishonest act is committed on a card arranged on a casino table while reducing a maintenance cost, a personnel cost, etc., by using a normal card not containing the tag, etc. A game surface is imaged by an imaging device, the presence of the card placed on the game surface is detected from image data produced by an imaging signal issued from the imaging device, and trajectory data of the card placed on the game surface is produced.

11 Claims, 68 Drawing Sheets

FIG. 8

| No. | DATE AND TIME | CARD | | | | |
|---|---|---|---|---|---|---|
| | | 1 | 2 | ・・・ | 79 | 80 |
| 1 | 2009/12/01-13:01 | FOUR OF HEART | TWO OF DIAMONDS | ・・・ | FIVE OF DIAMONDS | TWO OF SPADE |
| | 2009/12/01-13:01 | x1-1,y1-1 | x2-1,y2-1 | ・・・ | x79-1,y79-1 | x80-1,y80-1 |
| | ・・・ | ・・・ | ・・・ | ・・・ | ・・・ | ・・・ |
| | ・・・ | ・・・ | ・・・ | ・・・ | ・・・ | ・・・ |
| | 2009/12/01-13:07 | x1-7,y1-7 | x2-7,y2-7 | ・・・ | x79-7,y79-7 | x80-7,y80-7 |
| | 2009/12/01-13:09 | HIGH CARD | | | | |
| ・・・ | ・・・ | ・・・ | ・・・ | ・・・ | ・・・ | ・・・ |
| 108 | 2009/12/01-21:47 | 11 OF CLUB | NINE OF SPADE | ・・・ | TWO OF SPADE | NINE OF DIAMONDS |
| | 2009/12/01-21:52 | x1-1,y1-1 | x2-1,y2-1 | ・・・ | x79-1,y79-1 | x80-1,y80-1 |
| | ・・・ | ・・・ | ・・・ | ・・・ | ・・・ | ・・・ |
| | ・・・ | ・・・ | ・・・ | ・・・ | ・・・ | ・・・ |
| | 2009/12/01-21:56 | x1-5,y1-5 | x2-5,y2-5 | ・・・ | x79-5,y79-5 | x80-5,y80-5 |
| | 2009/12/01-21:59 | ROYAL STRAIGHT FLUSH | | | | |
| ・・・ | ・・・ | ・・・ | ・・・ | ・・・ | ・・・ | ・・・ |

COMMENT

Based on the outline-converted data, the outline extraction processing is again performed, a correlation calculation between the extracted outline data is used, and based on the correlation calculation result, each line is joined. A second screen is before the joint, and display-use original data of a fourth screen is after the joint.

[detlin.cpp]

COMMENT

Segment calculation of outline data is performed with a maximum 24 units.

Based on the obtained segment data, a threshold value determination of the correlation coefficient of the origin is performed, and when the correlation coefficient of the origin is smaller than the threshold value, then a correlation coefficient larger than the threshold value is searched (detection point) from a subsequent segment of the origin.

An average by segment parameter (X,Y coordinates, width, and height) from the origin to the detection point is calculated, and based on the calculated average value, width and height data for the straight line registration are calculated and the straight line registration is performed.

Based on the outline information of the origin and the detection point and the straight line registration-use parameter, the start and terminal end-use intervening variables are evaluated and the straight line registration is performed.

*Fig. 24C*

COMMENT

Check line segment data, which is an origin, and another line segment data with the line segment-registered data, and when it is determined that it is in a distance near the origin line segment data and an angle (inclination angle?) of the line segment is near, the line segment of the origin and approximate line data are joined to create straight line data.

The line segment data determined to be the approximate line is deleted from the database after registering the joined line segment data. The registered line segment data are checked in all combinations and joined.

*Fig. 26D*

COMMENT

The distance between two line segment data and the angle formed between the lines within a joint function of an approximate straight line are determined.

If line segments are crossed (no point contact is recognized), then the distance is not determined.

If the line segments are not crossed, a distance between a start point of each line segment and its end point is calculated, and the shortest distance is used.

OK is determined when the calculated distance and angle are less in angle than a determining distance of an argument.

*Fig. 27B*

If the line segment data of list data of a line segment at the origin and list data of a line segment after the origin are almost equilibrium, then these data items are registered, as the card detecting data, on the database.

*Fig. 28C*

COMMENT

Based on the data in which the equilibrium is detected, the card is determined, and the card data is registered. When the 4-side line segments can be detected and the 3-side line segments are detected by using the equilibrium data, the card registration data is performed. In the card registration, the 4-side detection is prioritized.

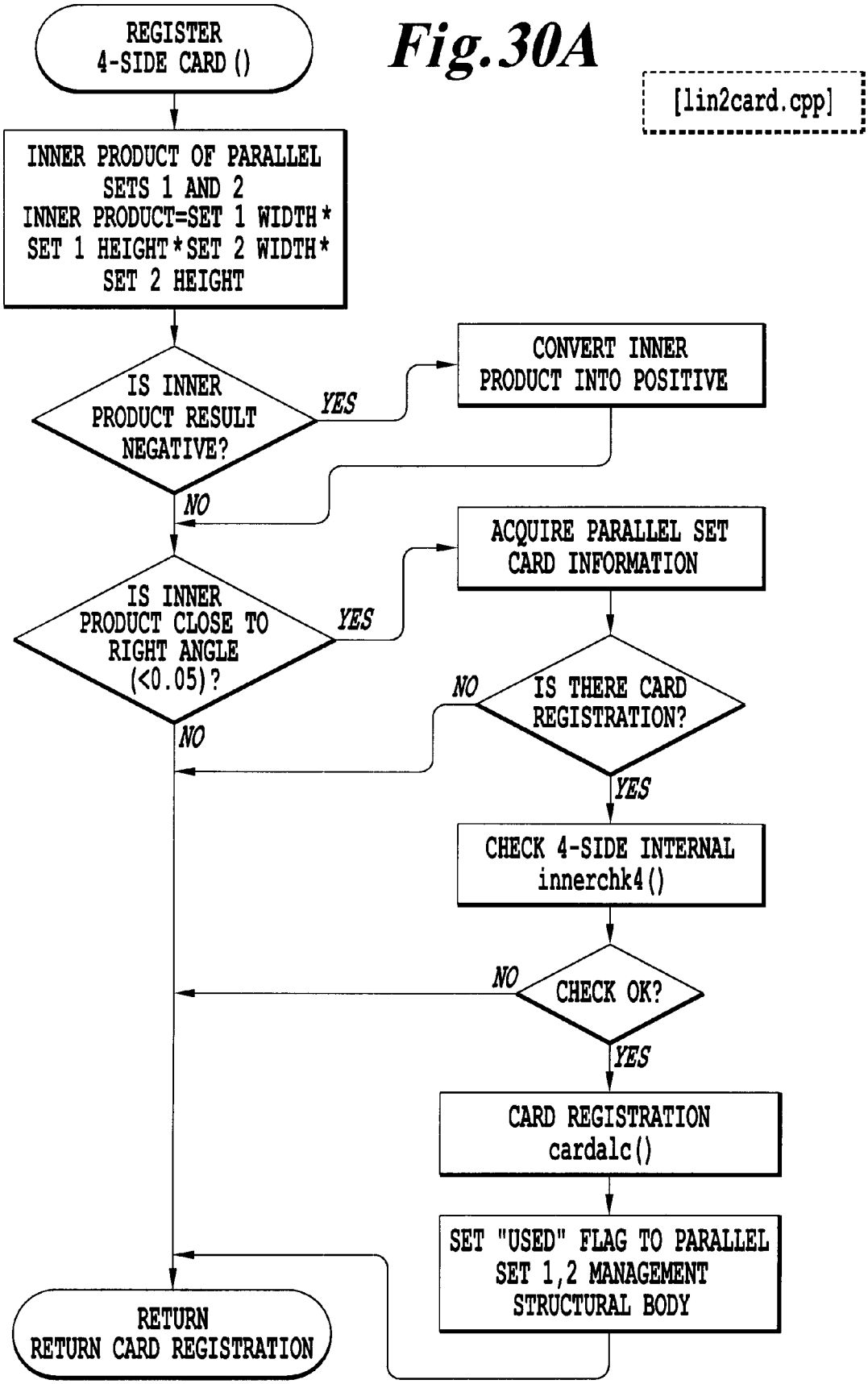
Fig.30A
[lin2card.cpp]
REGISTER 4-SIDE CARD ()
INNER PRODUCT OF PARALLEL SETS 1 AND 2
INNER PRODUCT=SET 1 WIDTH* SET 1 HEIGHT*SET 2 WIDTH* SET 2 HEIGHT
IS INNER PRODUCT RESULT NEGATIVE?
YES
CONVERT INNER PRODUCT INTO POSITIVE
NO
IS INNER PRODUCT CLOSE TO RIGHT ANGLE (<0.05)?
YES
ACQUIRE PARALLEL SET CARD INFORMATION
IS THERE CARD REGISTRATION?
NO
YES
NO
CHECK 4-SIDE INTERNAL innerchk4()
CHECK OK?
NO
YES
CARD REGISTRATION cardalc()
SET "USED" FLAG TO PARALLEL SET 1,2 MANAGEMENT STRUCTURAL BODY
RETURN
RETURN CARD REGISTRATION

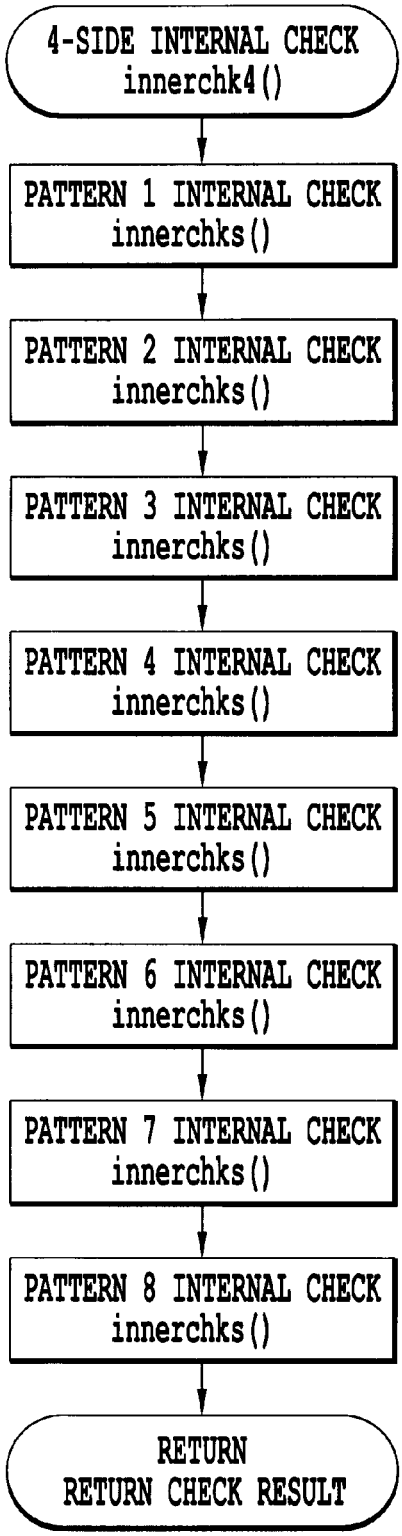
*Fig. 30B*
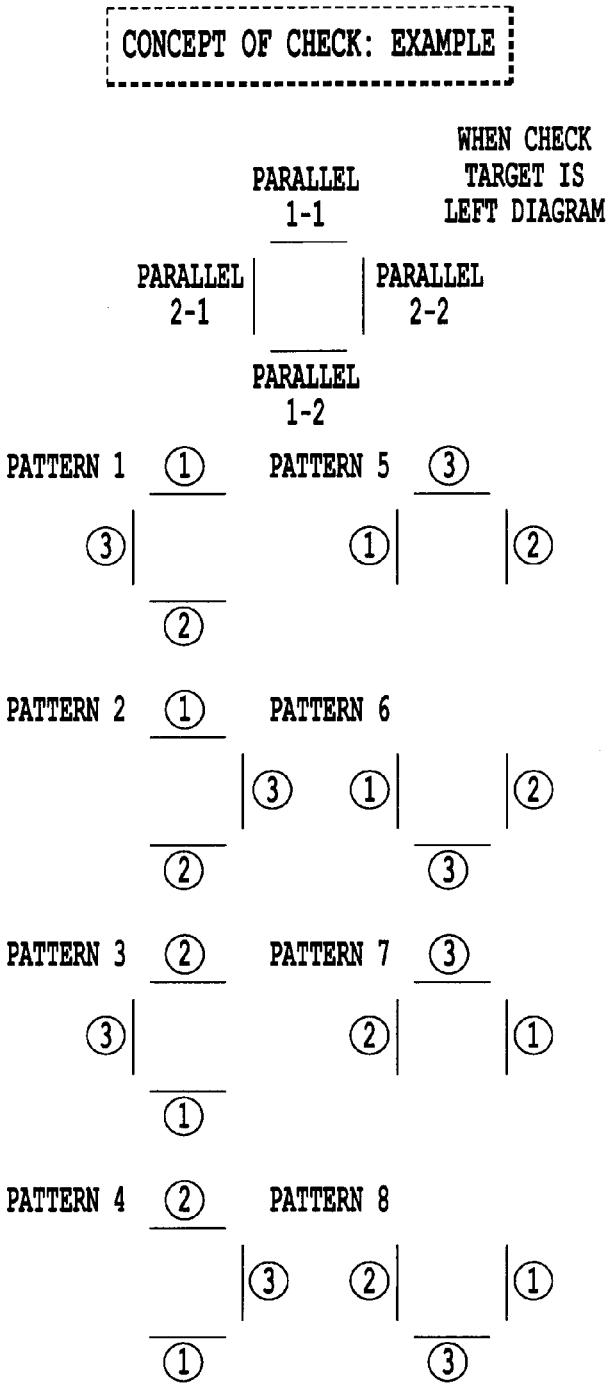
Three sides of the parallel set are checked for cross products of (1),(2) and (3) based on the above-described combined image.
When matching is established in all the eight patterns, this is registered as the 4-side card.

COMMENT

When the 3-side check is performed, the above-described pattern check is performed in the near distance calculation, the distance between the parallel set and the line segment is calculated, and if the result is less than a defined value, the combination is regarded as OK.

In the distance calculation, a distance of an area surrounded by a dotted line is calculated.

When OK is determined in the 3-side card check, the card registration is performed by creating virtual straight line data equivalent to the above-described dotted area.

*Fig.31C*

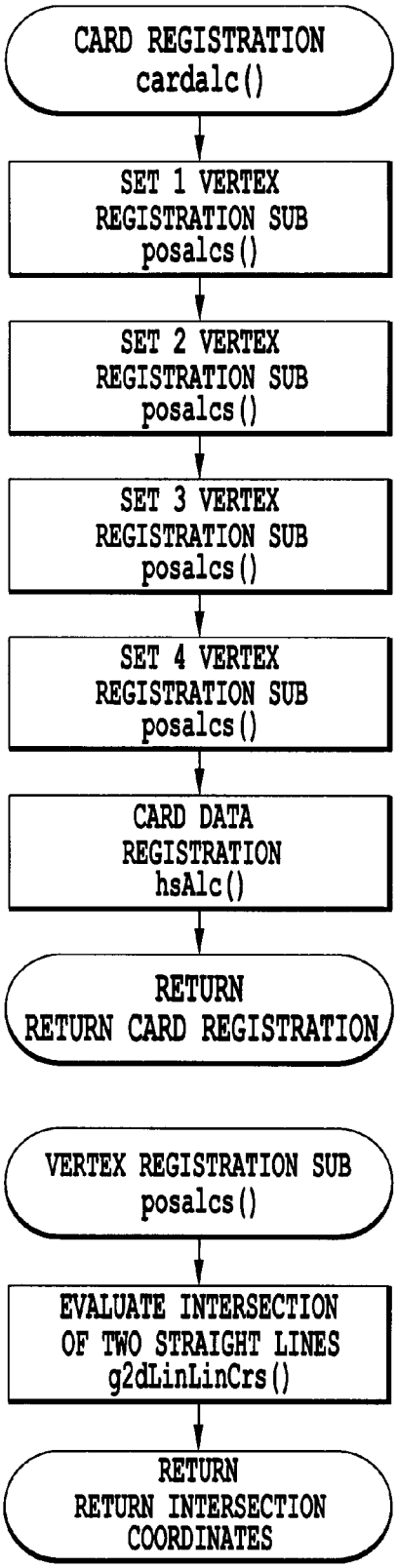

COMMENT

In the card registration, in the above-described example, an intersection between (1) and (2) is calculated in the set 1, that between (2) and (3) in the set 2, that between (3) and (4) in the set 3, and that between (4) and (1) in the set 4, and the resultant intersections are registered as the card information.

COMMENT

For 4, 3-side check-use sub functions, if a check condition of the cross product (angle?) of the start or the terminal end is established, the check OK is determined.

CARD REGISTRATION EXAMPLE

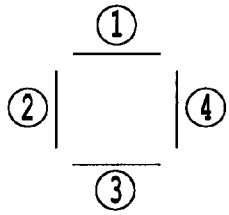

*Fig. 32A*

[PC SCREEN DEFINITION]

| | |
|---|---|
| FIRST SCREEN | THIRD SCREEN |
| SECOND SCREEN | FOURTH SCREEN |

*Fig. 40C*

[EXPLANATION]

This function [wm_PAINT()] is a test module; however, this function is a main function of drawing processing as an actual function.

From read data called upon producing a window and depressing a move key, a card trajectory according to the depressing of the key is displayed.

Processing such as an outline is also called from here, and thus, although this is a main portion of the invention of the subject application, the drawing is treated as a test module since the drawing depends on OS and hardware.

*Fig. 40D*

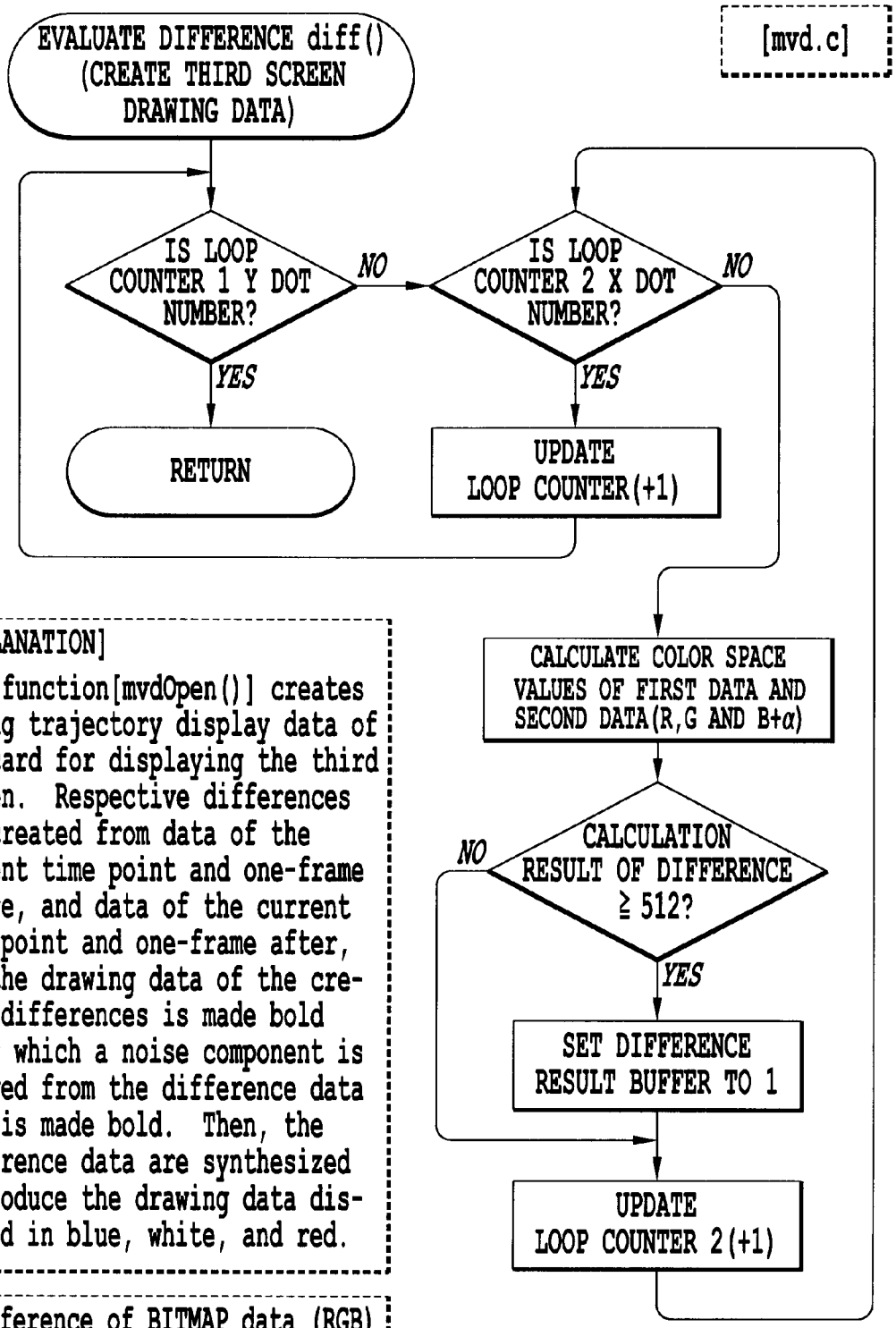

[EXPLANATION]

This function[mvdOpen()] creates moving trajectory display data of the card for displaying the third screen. Respective differences are created from data of the current time point and one-frame before, and data of the current time point and one-frame after, and the drawing data of the created differences is made bold after which a noise component is removed from the difference data that is made bold. Then, the difference data are synthesized to produce the drawing data displayed in blue, white, and red.

A difference of BITMAP data (RGB) is calculated in dot units.

The data are saved at a position of a buffer corresponding to X, Y coordinates.

*Fig. 41B*

| | | |
|---|---|---|
| 0 | 1 | 2 |
| 3 | B | 4 |
| 5 | 6 | 7 |

When data are present in the dots of 0 to 7 positions, set data to B for making bold.

Effective points are detected based on the image in the figure, the outline is traced, and X,Y coordinate data of the trace data are saved.

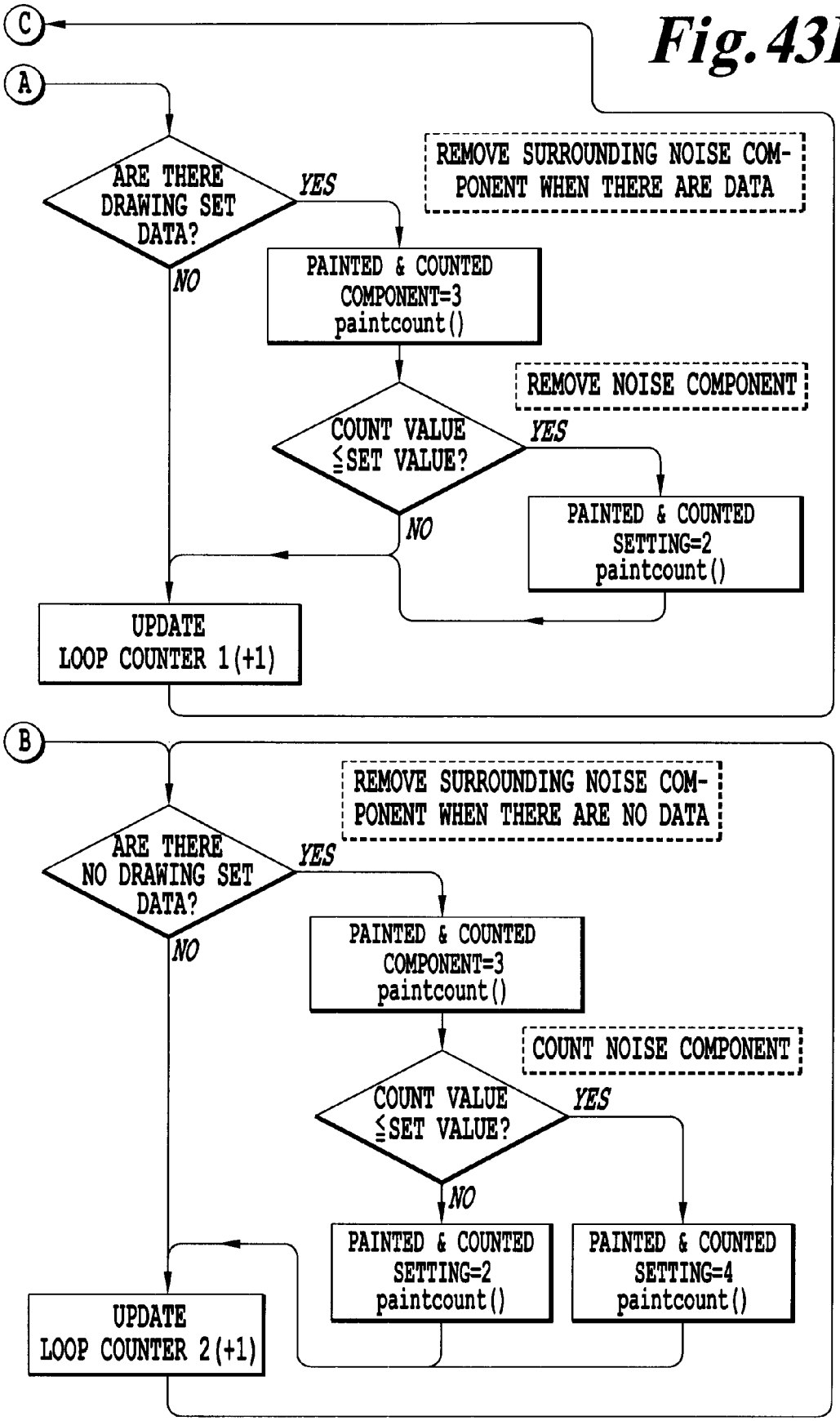
Fig. 43B
C
A
ARE THERE DRAWING SET DATA?
YES
NO
REMOVE SURROUNDING NOISE COMPONENT WHEN THERE ARE DATA
PAINTED & COUNTED COMPONENT=3 paintcount()
REMOVE NOISE COMPONENT
COUNT VALUE ≦SET VALUE?
YES
NO
PAINTED & COUNTED SETTING=2 paintcount()
UPDATE LOOP COUNTER 1(+1)
B
ARE THERE NO DRAWING SET DATA?
YES
NO
REMOVE SURROUNDING NOISE COMPONENT WHEN THERE ARE NO DATA
PAINTED & COUNTED COMPONENT=3 paintcount()
COUNT NOISE COMPONENT
COUNT VALUE ≦SET VALUE?
YES
NO
PAINTED & COUNTED SETTING=2 paintcount()
PAINTED & COUNTED SETTING=4 paintcount()
UPDATE LOOP COUNTER 2(+1)

Effective points are detected based on the image in the figure, the outline is traced, and X,Y coordinate data of the trace data are saved.

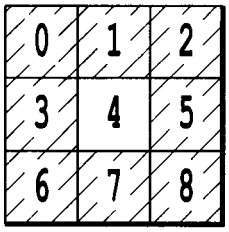

Whether there are effective data in the striped portion is searched.

*Fig. 45B*

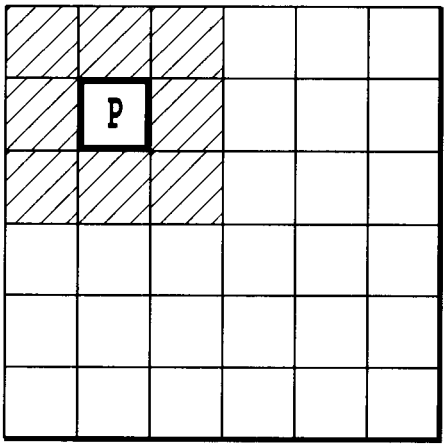

COMMENT (IMAGE OF PROCESSING FOR TRACING OUTLINE)

When P is an origin of data, an area in a striped (including black) portion is copied to the working area, and the data in the striped portion are traced and searched. In tracing and searching, if there are effective data in the striped portion, then the effective portion is used as next P.

*Fig. 45C*

CASINO TABLE CAPABLE OF TRACKING GAMING CARDS

CROSS-REFERENCE TO RELATED APPLICATIONS

This application is based on and claims a priority from the prior Japanese patent Application No. 2009-273595 filed on Dec. 1, 2009, the entire contents of which are incorporated herein by reference.

BACKGROUND OF THE INVENTION

1. Field of the Invention

The present invention relates to a casino table capable of tracing the trajectory of a card, such as a playing card, used in a casino, etc.

2. Description of the Related Art

In a casino, various types of games are played by using a card such as a playing card. A game result is determined based on a combination of cards, and a player therefore has a strong interest in contents of cards distributed from a dealer. Normally, a plurality of cards are used, and this makes it difficult to discover that one portion of the cards is changed. Thus, in order to obtain advantageous results as much as possible, there is no end to dishonest act in which cards are secretly changed while avoiding the control of the dealer.

To prevent this, in a casino, there is a disclosed a device in which the surface of a card used in a game is scanned before being distributed to a player and a symbol, a numerical value, etc., of the card distributed to the player are stored so that it becomes possible to confirm that the cards are not changed during the game (see Japanese Unexamined Patent Application Publication (Translation of PCT Application) No. H10-508236).

Further, there is disclosed a device which images a card of a dealer by a camera and automatically determines the win/loss or a payout of the game based on an image recognition of the image of the imaged card (for example, see Japanese Unexamined Patent Application Publication No. 2009-219588).

Moreover, there is disclosed a device in which a tag is contained in a card and a radio issued from the tag is received to determine whether a dishonest act is committed based on a position of the card, identification information of the card, etc.

Still further, there is disclosed a casino in which a monitoring camera is installed on a casino table and an image taken by the camera is projected on a monitor in a separate room allowing a monitoring personnel to visually confirm the image.

However, as described above, even in the case where the device scanning the card when the dealer distributes the card is used, whether or not the dishonest act is committed can be known only when the dealer checks the collected card after the game is ended. Thus, there occurs a possibility that it is difficult to specify the player who has committed the dishonest act.

The above device which images the card of the dealer by a camera and determines the win/loss or the payout of the game based on the card image recognition is capable of determining the win/loss or the payout not only based on the dealer's determination but also automatically. This prevents the device from paying back a chip having an erroneous payout amount to the player, which in turns alleviates a burden of a casino employee. However, this device images only the card of the dealer, i.e., images a narrow area of the casino table.

This makes it impossible to adequately discover the dishonest act even when the dishonest act is committed in an unimaged area.

Moreover, in the case where the device using the card containing the tag, it is certain that the card can be monitored in real time; however, if the card containing the tag gets dirty or broken, then the card needs to be changed. The card containing the tag is more costly than a normal card, and thus, a maintenance cost of the casino inevitably becomes high.

Still further, in the case where the monitoring personnel monitors via the camera installed on the casino table, the monitoring personnel needs to always observe the monitor while the game is played. This imposes a burden on the monitoring personnel, and at the same time, there is a possibility that a moment when the dishonest act is committed is lost. Needless to say, it is possible to record the image taken by the camera; however, it is very difficult to check the huge recorded data, and this case also imposes a heavy burden on a person who checks the image.

The present invention has been made in view of the above-described circumstance. It is an object thereof to provide a casino table capable of reducing a maintenance cost, a personnel cost, etc., and adequately determining whether a dishonest act is not committed on a card arranged on a casino table by using a normal card not containing a tag, etc.

SUMMARY OF THE INVENTION

A casino table according to an embodiment of the present invention, comprises:

a game surface on which a game is played;

an imaging device imaging the game surface and issuing an imaging signal; and a monitoring control unit monitoring the game based on the imaging signal issued from the imaging device, wherein the monitoring control unit comprises:

a controller executing the following processing (1-1) to (1-3) of:

(1-1) imaging the game surface by the imaging device;

(1-2) detecting the presence of a card placed on the game surface from image data produced by the imaging signal issued from the imaging device; and (1-3) producing trajectory data of the card placed on the game surface; and a storing means into which data used for these processing is stored.

According to this configuration, the game surface is imaged, the presence of the card arranged on the game surface is detected, and the trajectory data of the card is produced. Thus, it is possible to trace the card moving along with the progress of the game and also possible to detect that the card is lost or changed during the game. Therefore, it is possible to easily and adequately determine whether the dishonest act is committed in the game. Moreover, the normal card not containing the tag, etc., is used to trace the position of the card. Thus, it is possible to reduce the maintenance cost, the personnel cost, etc. Further, it is possible to monitor the game while not relying on the monitoring personnel's attention, and thus, it is possible to adequately determine the rightfulness of the game.

The casino table according to an embodiment of the present invention, comprises a reference-card-data storing means into which reference card data obtained by converting a design of the top surface of the card into image data is stored, wherein the processing of (1-2) further includes processing of:

(2-1) determining whether a card is present on the game surface by comparing the image data and the reference card data; and (2-2) calculating, when the card is present on the game surface, a position of the card and storing position data of the card into the storing means, and the processing of (1-3) includes (2-3) producing trajectory data indicating a trajectory of the card from the position data by executing the processing of (2-1) and the processing of (2-2) at least once.

According to this configuration, the image data is compared with the reference card data, and thus, it is possible to adequately determine whether the card is present and more accurately produce the trajectory of the card. As a result, it is possible to more surely trace the card moving along with the progress of the game and adequately determine whether the dishonest act is committed.

Further, a casino table according to an embodiment of the present invention, wherein the processing of (1-2) further includes processing of:

(3-1) producing outline data by extracting an outline of an object imaged by the imaging device by the imaging signal issued from the imaging device;

(3-2) extracting a line segment from the outline data; and (3-3) storing, as card information, a position of a vertex of a rectangle into the storing means when it is possible to form the rectangle from the extracted line segment, and the processing of (1-3) includes (3-4) processing of producing trajectory data indicating a trajectory of the card by executing the processing of (3-1) to the processing of (3-3) at least once.

According to this configuration, the line segment data is formed from the outline data and the card information is formed from the line segment data, and thus, the amount of data to be processed can be reduced while maintaining the accuracy for detecting the presence of the card and a burden of the processing of the monitoring control unit can be alleviated without decreasing the accuracy for determining the dishonest act.

Still further, a casino table according to an embodiment of the present invention, comprising a display on which a display image by a display signal issued from the monitoring control unit is displayed, wherein the monitoring control unit executes (4-1) processing for displaying the trajectory data on the display.

According to this configuration, the trajectory data is displayed on the display, and thus, the dealer is able to visually confirm the displayed trajectory of the card. As a result, the dealer becomes able to determine the dishonest act such as the cards are secretly changed or lost during the game in real time.

A casino table according to an embodiment of the present invention, wherein the processing of (1-2) further includes (5-1) processing of deleting remaining card information except for one card information, out of card information indicating the same rectangle, when there are a plurality of card information indicating the same rectangle, out of the card information stored by the processing of (3-3).

According to this configuration, the card information of the card determined to be duplicated is deleted, and thus, the data amount can be reduced, and at the same time, various types of processing such as card searching processing and rendering processing can be rapidly executed.

It is possible to adequately determine whether a dishonest act is committed on a card arranged on a casino table while reducing a maintenance cost, a personnel cost, etc., by using a normal card not containing the tag, etc.

BRIEF DESCRIPTION OF THE DRAWINGS

FIG. 8 is a table depicting an example of position information of a stored card, together with time information, processing sequence, and a game result;

FIG. 30 is a flowchart depicting subroutines of processing for a 4-side card registration and processing for a 4-side internal check;

DESCRIPTION OF THE PREFERRED EMBODIMENTS

Figure 1:
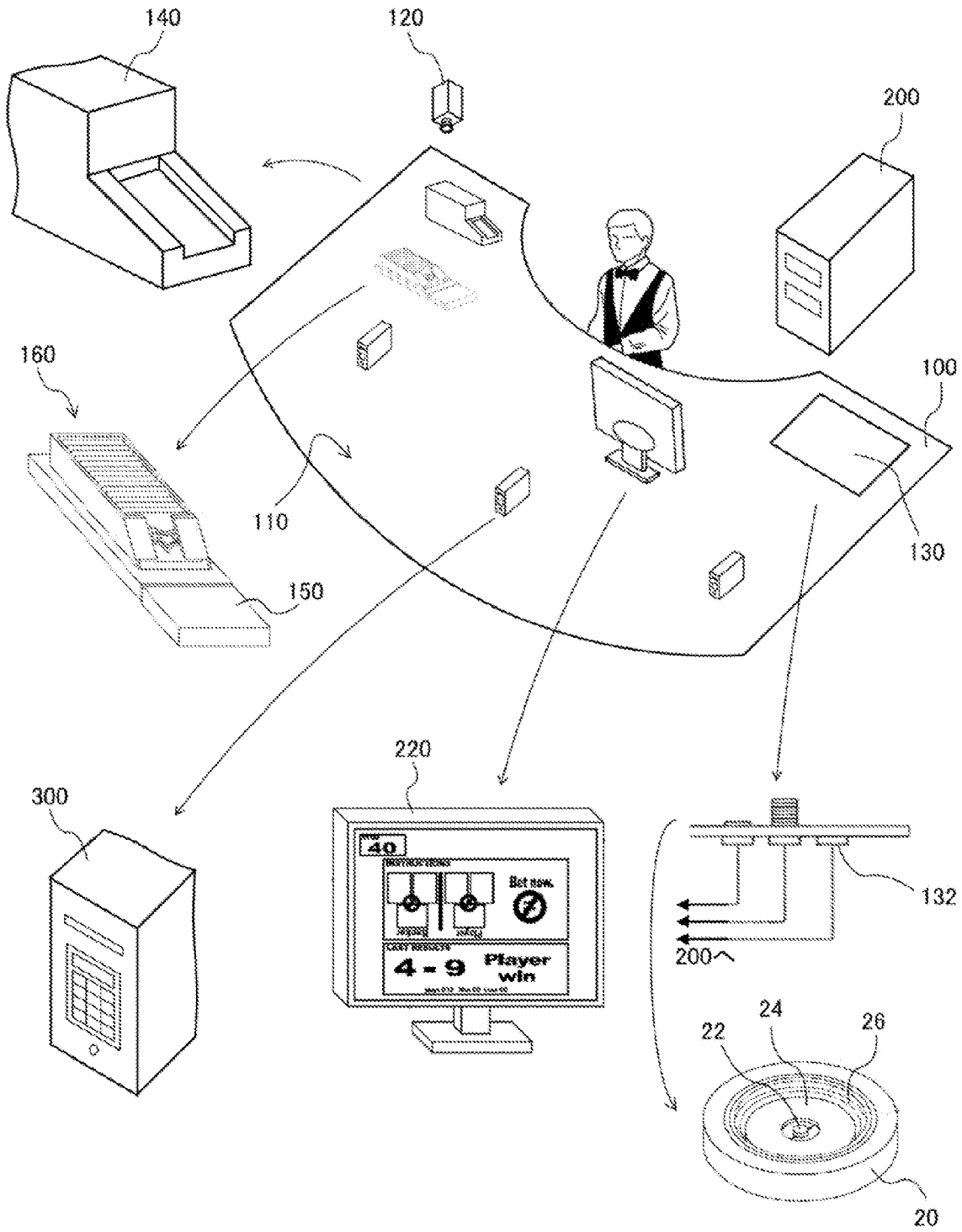
FIG. 1 is a schematic view depicting the overview of a casino table according to the embodiment.

Hereinafter, embodiments of the present invention will be described based on drawings. The embodiments include first to fifth embodiments. Hereinafter, in descriptions common to the first to fifth embodiments, these embodiments are merely called the embodiment.

Characteristics of First to Fifth Embodiments

Hereinafter, each of the characteristics of the first to fifth embodiments described later will be described.

Characteristic of the First Embodiment

A casino table according to the first embodiment of the present invention, described later, comprises:

a game surface (game surface 110) on which a game is played;

an imaging device (camera 120) imaging the game surface and issuing an imaging signal; and a monitoring control unit (game management device 200) monitoring the game based on the imaging signal issued from the imaging device, wherein the monitoring control unit comprises:

a controller (CPU 202) executing the following processing (1-1-1) to (1-1-3) of:

(1-1-1) imaging the game surface by the imaging device (step S513 or step S615);

(1-1-2) detecting the presence of a card placed on the game surface from image data produced by the imaging signal issued from the imaging device (step S519 or step S619); and (1-1-3) producing trajectory data of the card placed on the game surface (step S523 or step S627); and a storing means (RAM 206 or HDD 208) into which data used for these processing is stored.

According to this configuration, the game surface is imaged, the presence of the card arranged on the game surface is detected, and the trajectory data of the card is produced. Thus, it is possible to trace the card moving along with the progress of the game and also possible to detect that the card is lost or changed during the game. As a result, it is possible to easily and adequately determine whether the dishonest act is committed in the game. Moreover, the normal card not containing the tag, etc., is used to trace the position of the card. Thus, it is possible to reduce the maintenance cost, the personnel cost, etc. Further, it is possible to monitor the game while not relying on the monitoring personnel's attention, and thus, it is possible to adequately determine the rightfulness of the game.

Further, the casino table according to the first embodiment of the present invention, comprises a reference-card-data storing means (RAM 206 or HDD 208) into which reference card data obtained by converting a design of the top surface of the card into image data is stored, wherein the processing of (1-1-2) further includes processing of:

(1-2-1) determining whether a card is present on the game surface by comparing the image data and the reference card data (step S617); and (1-2-2) calculating, when the card is present on the game surface, a position of the card and storing position data of the card on the storing means (step S623), and the processing of (1-1-3) includes (1-2-3) producing trajectory data indicating a trajectory of the card from the position data by executing the processing of (1-2-1) and the processing of (1-2-2) at least once (step S627).

According to this configuration, the image data is compared with the reference card data, and thus, it is possible to adequately determine whether the card is present and more accurately produce the trajectory of the card. As a result, it is possible to more surely trace the card moving along with the progress of the game and adequately determine whether the dishonest act is committed.

Still further, the casino table according to the first embodiment of the present invention, comprises a display (display 220) on which a display image by a display signal issued from a monitoring control unit is displayed, wherein the monitoring control unit executes (1-3-1) processing for displaying the trajectory data on the display (step S711).

According to this configuration, the trajectory data is displayed on the display, and thus, the dealer is able to visually confirm the displayed trajectory of the card. As a result, the dealer becomes able to determine the dishonest act such as the cards are secretly changed or lost during the game in real time.

Characteristic of the Second Embodiment

In a casino, a cash is not directly bet when a game is played, but the game is played, regarding a casino chip changeable to the cash as a subject to be bet. In this way, the casino chip can be changed to the cash, and thus, the casino chip is considered as having a monetary value equal to the cash in the casino. Therefore, a player plays a game to acquire casino chips as many as possible. However, due to the reason that the casino chip is endowed with the monetary value equal to the cash, a dishonest act occurs along with the game in order to obtain casino chips as many as possible.

As a result, in a conventional casino, there is introduced a device or a system in which a casino chip containing a tag is used and a predetermined radio issued from the tag is received to determine based on the number or position of the casino chip whether a dishonest act is committed (for example, see Japanese Unexamined Patent Application Publication No. 2006-167329 or No. 2006-172354).

However, there may be a case where a casino chip obtained through a dishonest method such as stealing the casino chip from the casino when the casino is closed late at night or on holidays is used to play a game in that casino. Thus, a crime prevention system needs to be enhanced when the casino is closed, for example, many security monitoring personnels need to be employed even when the casino is closed, various crime-prevention devices are introduced. These increase a management cost or a maintenance cost of the casino. A casino chip obtained through an unknown route needs to be managed, and it is very difficult to manage all of these casino chips.

From such an aspect, it is desired in the casino to have a system capable of inexpensively and surely managing the casino chip. In the second embodiment of the present invention described later, a casino table capable of achieving such an object is provided.

The casino table according to the second embodiment of the present invention comprises:

- a gaming-medium read/write device (casino-chip read/write device 130) writing use information into a gaming medium (casino chip 20) subject to be bet in order to advance a game and reading the use information from the gaming medium; and
- a monitoring control unit (game management device 200) transmitting and receiving the use information, wherein
- the monitoring control unit includes a controller (CPU 202) executing the following processing (2-1-1) to (2-1-2) of:
- (2-1-1) writing, as the use information, usable information on a gaming medium distributed to a player (step S917); and
- (2-1-2) writing, as the use information, unusable information on a gaming medium collected from the player (step S1019).

The "gaming medium distributed to a player" is a gaming medium that is possibly used for a game from now. The usable information is information determined by the monitoring control unit that the gaming medium in which the usable information is stored is used for a game. The "gaming medium collected from the player" is a gaming medium that has been used for a game after the end of the game. The unusable information is information determined by the monitoring control unit that the gaming medium in which the unusable information is stored cannot be used for a game.

According to this configuration, the usable information is stored on the gaming medium distributed to the player, and thus, the player can advance the game by using that gaming medium. On the other hand, the unusable information is stored on the gaming medium collected from the player, and thus, the player cannot advance the game even when this gaming medium is obtained through a certain method. In doing so, the casino chip can be managed inexpensively and surely, and even when the casino chip obtained through an unknown route is used for the game, such a casino chip can be adequately discovered and is not used for the game.

It is noted that the gaming-medium read/write device preferably reads and writes in a non-contact manner with the gaming medium present within a predetermined range from the gaming-medium read/write device. Non-contact reading and writing are possible, and thus, the gaming medium can be treated simply.

Further, the casino table according to the second embodiment of the present invention comprises a display (display 220) on which information issued from the monitoring control unit is displayed, wherein the controller further comprises the following processing of:

- (2-2-1) reading the use information from the gaming medium collected from the player (step S1011); and
- (2-2-2) displaying on the display information indicating that the collected game medium is the gaming medium into which the unusable information is written when the use information read by the processing of (2-2-1) is the unusable information (step S1017).

According to this configuration, originally, on the gaming medium collected from the player, the usable information must have been written by the aforementioned (2-1-1) processing. However, in the case where the unusable information is written on the gaming medium collected from the player, this gaming medium, which has been passed over to the player without undergoing the (2-1-1) processing, is highly probably obtained dishonestly. When such a gaming medium is discovered, the discovery is displayed on the display. In this way, the gaming medium can be adequately managed by notifying the dealer.

In the casino table according to the second embodiment described above, the case where the usable information or the unusable information is stored on the gaming medium has been described; however, corresponding to the identification information for identifying the gaming medium, the usable information or the unusable information may also be stored on a storing device (for example, the RAM 206 or the HDD 208, etc.) of the monitoring control unit (game management device 200). Further, the identification information and the usable information or the unusable information may be transmitted via a network to the management server 400, besides the storing device of the monitoring control unit, connected to the monitoring control unit, and the usable information or the unusable information may be stored on the management server in a manner to correspond to the identification information. In either way, any management is acceptable as long as the usable information or the unusable information is stored on a storing medium different from the gaming medium. The identification information is information for identifying the gaming medium, and is previously stored on the gaming medium. In this case, instead of using the gaming-medium read/write device, a gaming medium read device may be used to read the identification information from the gaming medium. In doing so, the usable information or the unusable information is stored on a device managed by the casino such as the monitoring control unit or the management server, and thus, it becomes possible to more strictly manage the gaming medium, and at the same time, it becomes possible to simplify the processing or configuration on the casino table.

Characteristic of the Third Embodiment

Further, in the casino, conventionally, if there is a need for a player to change a cash to a casino chip to play a game on a casino table, then the player gives the cash to the dealer on the casino table so as to change the cash to the casino chip. In the casino, to play a plurality of different games, a plurality of casino tables respectively corresponding to the games are installed. Thus, the player needs to move to another casino table to play a game different from the game that is now played.

Generally, the cash used in the casino is in the form of a bill, and thus, when the player walks with the bill, the bill is not bulky. However, the casino chip has a predetermined size, and thus, it has a bulky form. Therefore, the player often moves in the casino in the form of the cash rather than moving in the casino changing the cash to the casino chip. Thus, when the number of casino chips at hand decreases to a certain extent, it is inevitable to change the cash to the casino chip, and on the casino table, the frequency at which the cash is changed to the casino chip is high. Further, even in the form of the bill, the bills are bulky to a certain extent, and an effort or a device for counting the number of bills is needed.

Moreover, the casino sometimes gives a point redeemable to the player as a token of a service. The point is recorded on a member card, and thus, the player needs to carry the member card when the player visits the casino, and the player needs to pass over the member card to the dealer or write it by using a write device installed at a predetermined location in the casino.

From such an aspect, in the casino, it is desired that the cash can be changed to the casino chip without a burden on the player, and at the same time, the change to the casino chip can be easily and adequately performed in a short period of time. It is also desired a system capable of simply imparting the player with the point. In the third embodiment of the present invention described later, a casino table capable of achieving such an object is provided.

A casino table according to the third embodiment of the present invention comprises:

- a storing-medium read/write device (IC-card read/write device 300) writing money amount information into a detachable storing medium (IC card 30) that can be possessed by a player and reading the money amount information from the storing medium;
- a managing control unit (game management device 200) receiving the money amount information read from the storing medium; and
- a display (display 220) on which the money amount information read from the storing medium is displayed, wherein the managing control unit includes:

- a controller (CPU 202) executing the following processing (3-1-1) to (3-1-3) of:
  - (3-1-1) reading the money amount information from the storing medium by the storing-medium read/write device (step S1111);
  - (3-1-2) displaying on the display the number of gaming media corresponding to the money amount indicated by the money amount information read from the storing medium (step S1215); and
  - (3-1-3) storing on the storing medium, by the storing-medium read/write device, a money amount obtained by subtracting the money amount corresponding to the number of gaming media changed by the player from the money amount indicated by the money amount information read from the storing medium (step S1317), and
- a storing means (RAM 206 or HDD 208) into which data used for these processing is stored.

The aforementioned "storing medium" includes an IC card, for example. Further, the "gaming medium" may suffice if it can be a subject to be bet to play the game, and includes a casino chip, for example.

According to this configuration, the money amount information stored on the storing medium can be read and changed to the gaming medium, and thus, there is no need of carrying a bulky cash, the change to the gaming medium is possible without a burden on the player, and it is not needed to count the bills. As a result, it is possible to easily and adequately change to the gaming medium in a short period of time. Further, the number of gaming media corresponding to the money amount indicated by the money amount information read from the storing medium is displayed on the display, and thus, the dealer becomes able to know the maximum number that can be converted into the gaming media. In this way, a task of converting into the gaming medium can be facilitated.

Moreover, the casino table according to the third embodiment of the present invention preferably comprises an input device (keyboard 340) capable of inputting the number of gaming media according to a manipulation of a player, wherein the controller further includes (3-2-1) processing of displaying information indicating the number of gaming media input in the input device on the display (step S1215).

According to this configuration, the information indicating the number of input gaming media is displayed on the display, and thus, the dealer becomes able to know the number of gaming media that the player desires to change. At the same time, the maximum number corresponding to the money amount indicated by the money amount information read from the storing medium is also displayed, and thus, the determination whether the money amount changeable to the storing medium is possessed by the player can be facilitated. Further, the "information indicating the number of gaming media input to the input device" may be displayed on the display that can be visually confirmed by the player (step S1115). In doing so, the player becomes able to confirm the number of gaming media that the player desires.

In the casino table according to the third embodiment of the present invention, the controller preferably further comprises processing of:

- (3-3-1) reading the money amount information from the storing medium by the storing-medium read/write device;
- (3-3-2) generating a point when a predetermined condition is satisfied based on progress of the game (step S1411);

(3-3-3) converting a value of the generated point into a money amount (step S1513); and (3-3-4) storing a money amount obtained by adding the money amount converted from the value of the point to the money amount indicated by the money amount information read from the storing medium (step S1515), by the storing-medium read/write device into the storing medium (step S1517).

A condition under which to generate the point includes the number of games that the player plays or the amount money to be bet (or number of gaming media), for example. For example, the point can be generated at each play by the player, or the point corresponding to the number of gaming media to be bet can be generated. The conditions under which to generate the point are not limited thereto, and any condition that can be managed by the managing control unit may be included. Further, the point can be a subject to arithmetic calculation, and information or data that can be stored may suffice.

According to this configuration, the money amount according to a value of the point generated based on the progress of the game can be imparted to the player, and thus, the point can be redeemed to the player as a service provided by the casino to the player. In doing so, the player is imparted with a motivation to continuously play the game.

Moreover, in the casino table according to the third embodiment of the present invention, the controller preferably further comprises processing of:

(3-4-1) reading the money amount information from the storing medium by the storing-medium read/write device;

(3-4-2) converting the number of gaming media possessed by the player into a money amount (step S1613); and (3-4-3) storing a money amount obtained by adding the money amount converted from the number of gaming media to the money amount indicated by the money amount information read from the storing medium (step S1615), by the storing-medium read/write device into the storing medium (step S1617).

According to this configuration, when the player ends the game or when the player moves to another casino table, the player converts the number of gaming media owned by the player into the money amount and the money amount information is stored in the IC card. Thereby, all of the remaining moneys that the player owns can be stored in the IC card as the remaining money information. In doing so, the player becomes able to end the game or move to the other casino table only by holding the IC card without a need of carrying the cash, the casino chip, etc.

Characteristic of the Fourth Embodiment

Further, when the dealer, etc., receive the cash from the player in the casino, a camera installed above the casino table is disposed so that the cash can be imaged, and thereafter, a dedicated pusher is used to collect the cash in a collection box. A monitor connected to the camera is arranged in a room separate from a room where the casino table is laid, the cash imaged by the camera is projected on the monitor, and a monitoring personnel in the separate room confirms the money amount of the cash projected on the monitor.

In this way, the conventional casino has adopted a system in which the monitoring personnel monitors the cash received from the player. The timing at which the dealer, etc., receive the cash from the player is unknown, and thus, the monitoring personnel needs to always monitor in the separate room, resulting in a heavy burden imposed on the monitoring personnel and an increase in personnel cost as well. Moreover, the monitor is watched by a person, and thus, there is a possibility that the timing at which the cash is received is lost.

From such an aspect, in the casino, it is desired to reduce the personnel cost without imposing a burden on the monitoring personnel, and at the same time, to manage the cash received from the player irrespective of the timing at which the cash is received. In the fourth embodiment of the present invention described later, a casino table capable of achieving such an object is provided.

A first characteristic of a casino table according to the fourth embodiment of the present invention is that it comprises:

a bill identification device (bill identification device 140) issuing money amount information indicating a money amount of an injected bill;

an input means (keyboard 230) issuing injection purpose information indicating a purpose of injecting the bill, to the bill identification device; and a managing control unit (game management device 200) receiving the money amount information and the injection purpose information, wherein the control unit comprises:

a controller (CPU 202) executing the following processing (4-1-1) to (4-1-3) of:

(4-1-1) receiving the injection purpose information issued from the input means (step S1711);

(4-1-2) receiving the money amount information issued from the bill identification device when the injection purpose information is received (step S1715); and (4-1-3) storing the money amount information and the injection purpose information into the storing means (step S1717); and a storing means (RAM 206 or HDD 208) into which data used for these processing is stored.

According to this configuration, the money amount information, together with the injection purpose information, is stored in the storing means, and thus, the money amount can be managed while facilitating sorting of the money amount of the bill.

Moreover, in the casino table according to the fourth embodiment of the present invention, the bill identification device preferably issues the money amount information when the bill is injected.

According to this configuration, by providing that the money amount information is issued when the bill is injected, the money amount information and the injection purpose information can be stored in the storing means upon injection of the bill, and thus, the money amount of the bill injected into the bill identification device can be managed in real time.

Further, in the casino table according to the fourth embodiment of the present invention, the controller preferably further comprises (4-3-1) processing of storing the money amount information and the injection purpose information in a management server connected to the managing control unit.

According to this configuration, the money amount information and the injection purpose information are stored in a management server, and thus, it is possible to collectively manage the purposes of injecting the bills injected in all the bill identification devices installed in the casino and its money amounts.

Characteristic of the Fifth Embodiment

A casino table according to the fifth embodiment of the present invention, described later, comprises:

a game surface (game surface 110) on which a game is played;

an imaging device (camera 120) imaging the game surface and issuing an imaging signal; and a monitoring control unit (game management device 200) monitoring the game based on the imaging signal issued from the imaging device, wherein the monitoring control unit comprises:

a controller (CPU 202) executing the following processing (5-1-1) to (5-1-4) of:

(5-1-1) producing outline data by extracting an outline of an object imaged by the imaging device by the imaging signal issued from the imaging device (step S1813);

(5-1-2) extracting a line segment from the outline data (step S1817);

(5-1-3) storing, as card information, a position of a vertex of a rectangle into the storing means when it is possible to form the rectangle from the extracted line segment (step S1827), and (5-1-4) producing trajectory data indicating a trajectory of the card by repeating the processing of (5-1-1) to (5-1-3) (step S523); and a storing means (RAM 206 or HDD 208) into which data used for these processing is stored.

According to this configuration, the line segment data is formed from the outline data and the card information is formed from the line segment data, and thus, the amount of data to be processed can be reduced while maintaining the accuracy for detecting the presence of the card and a burden of the monitoring control unit can be alleviated without decreasing the accuracy for determining the dishonest act.

Moreover, in the casino table according to the fifth embodiment of the present invention, the controller further comprises (5-2-1) processing of deleting remaining card information except for one card information, out of card information indicating the same rectangle, when there are a plurality of card information indicating the same rectangle, out of the card information stored by the processing of (5-1-3) (step S1837).

According to this configuration, the card information of the card determined to be duplicated is deleted, and thus, the data amount can be reduced, and at the same time, various types of processing such as card searching processing and rendering processing can be rapidly executed.

<<<Overview of the Casino Table>>>

Figure 2:
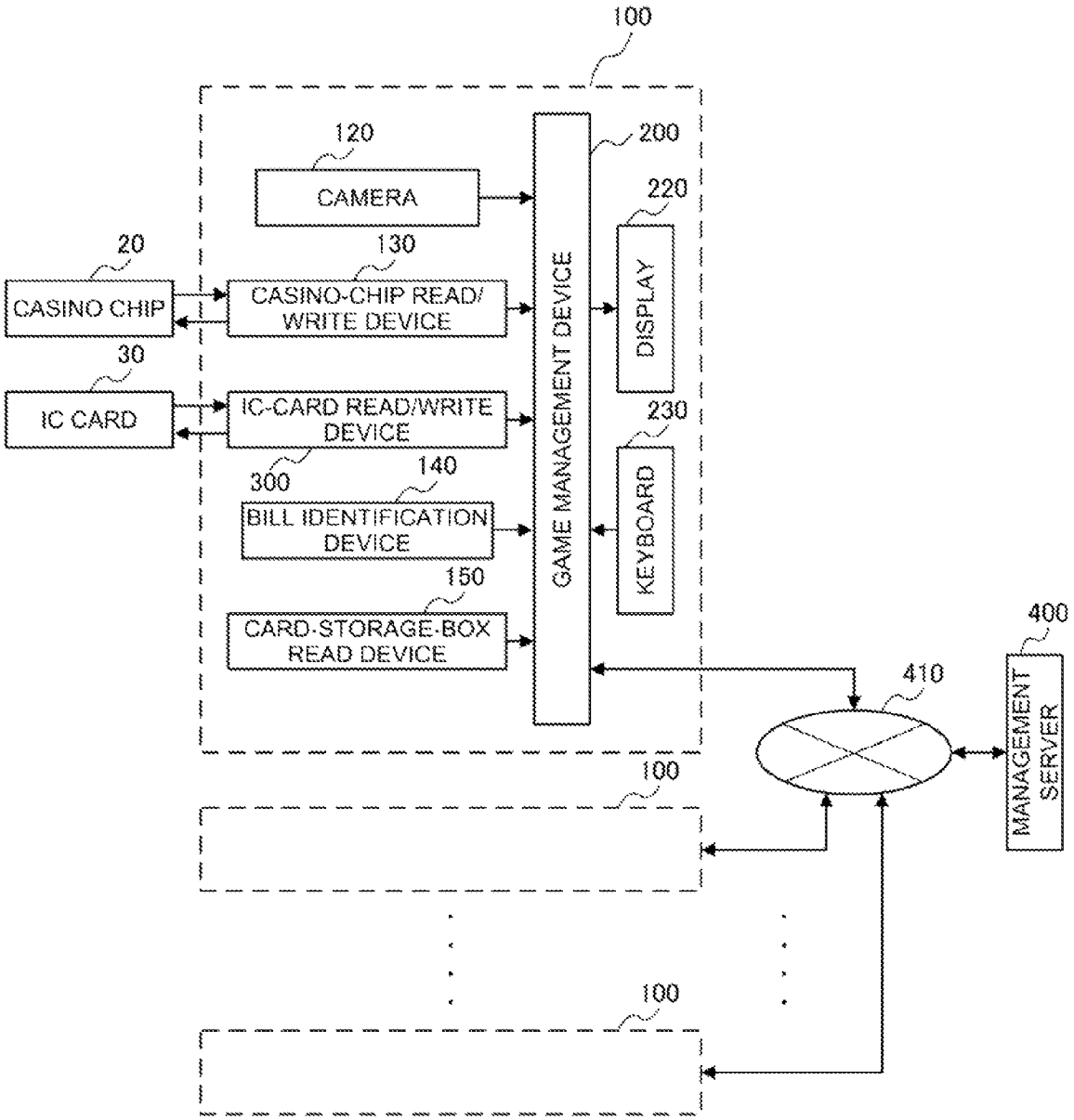
FIG. 2 is a block diagram depicting the whole configuration of the casino table according to the embodiment.
Figure 3:
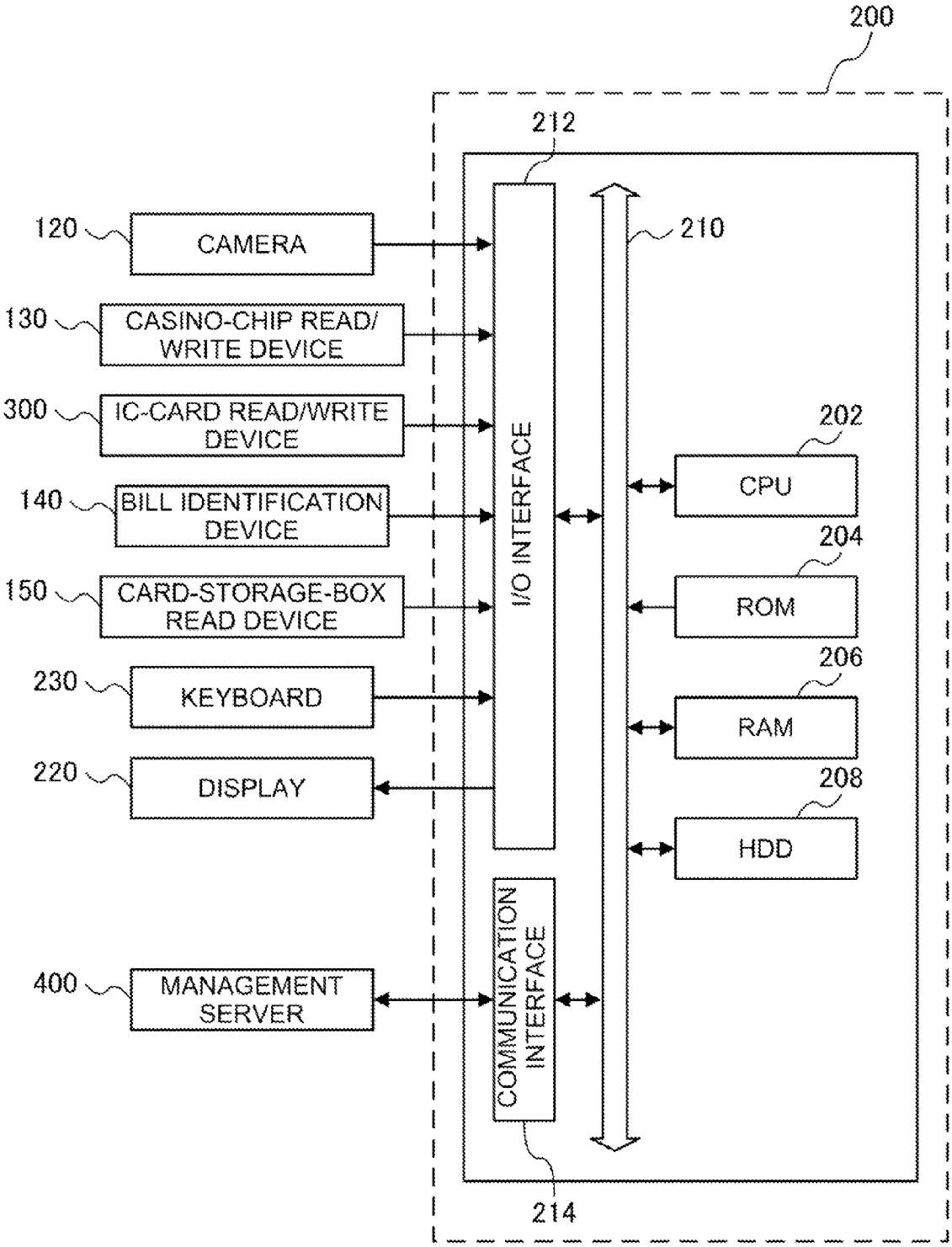
FIG. 3 is a functional block diagram depicting the configuration of a play management device of the casino table according to the embodiment.
Figure 4:
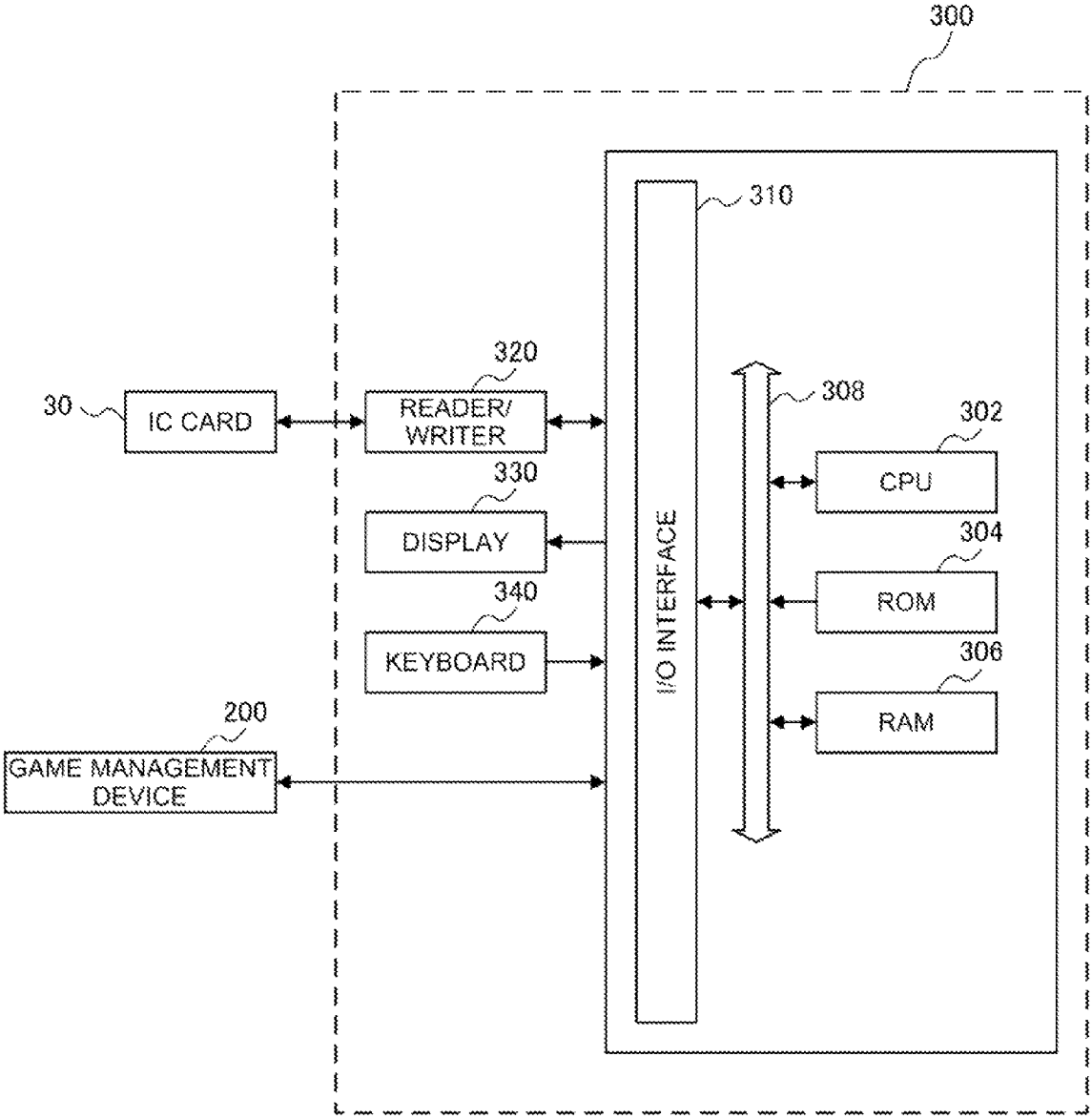
FIG. 4 is a functional block diagram depicting the configuration of an IC-card read/write device of the casino table according to the embodiment.

Hereinafter, the overview of the casino table according to the embodiment will be explained by using FIG. 1 to FIG. 4. FIG. 1 shows the overview of the configuration of the casino table according to the embodiment. FIG. 2 is a block diagram depicting the whole configuration of the casino table according to the embodiment. FIG. 3 is a functional block diagram depicting the configuration of a play management device of the casino table according to the embodiment. FIG. 4 is a functional block diagram depicting the configuration of an IC-card read/write device of the casino table according to the embodiment.

<Casino Table 100>

A casino table 100 is a table used for playing a casino game. As depicted in FIG. 1, on the top of the casino table 100, a game surface 110 is arranged. On the game surface 110, cards such as a playing card and a casino chip are placed by a dealer or a player. In the embodiment, the top surface of the card means a surface on which a design, etc., for indentifying the card are displayed, and the bottom surface of the card means a surface on which an identical design is displayed so that the cards cannot be distinguished. For example, in the case of the playing card, the surface on which indexes such as a spade and a diamond and characters such as a numeral and an alphabet are displayed is the top surface.

<Game Management Device 200>

Behind or below the casino table 100, a game management device 200 is arranged. The game management device 200 is a device for an employee of the casino, such as a dealer, to use. As depicted in FIG. 2 and FIG. 3, a display 220 and a keyboard 230 are connected to the game management device 200. The display 220 is a unit for the employee of the casino such as a dealer to visually confirm the displayed image. The keyboard 230 is a unit for the employee, of the casino such as a dealer to manipulate, and transmits predetermined information to the game management device 200. It is noted that a touch panel function may be optionally provided on the display 220 rather than on the keyboard 230 so that the employee of the casino such as a dealer can manipulate a touch panel section of the display 220. In either way, it suffices as long as a unit that the employee of the casino manipulates to input desired information to the game management device 200 is connected.

As depicted in FIG. 3, the game management device 200 includes: a CPU 202; a ROM 204; a RAM 206; an HDD 208; an input/output bus 210; an I/O interface 212; and a communication interface 214. The CPU 202, the ROM 204, the RAM 206, the HDD 208, the I/O interface 212, and the communication interface 214 are connected to each other via the input/output bus 210 so that data can be input and output.

The CPU (Central Processing Unit) 202 executes subroutines depicted in FIG. 5 to FIG. 7, FIG. 9, FIG. 10, FIG. 12, FIG. 14, FIG. 17 to FIG. 20, and FIG. 22 to FIG. 45 described later. The ROM (Read Only Memory) 204 stores a program for processing these subroutines. The RAM (Random Access Memory) 206 is for temporarily storing values of various data items when the CPU 202 executes processing of the subroutines depicted in FIG. 5 to FIG. 7, FIG. 9, FIG. 10, FIG. 12, FIG. 14, FIG. 17 to FIG. 20, and FIG. 22 to FIG. 45. Moreover, the HDD 208 is for eternally storing and accumulating the values of the various data items when the CPU 202 executes the processing of these subroutines.

As depicted in FIG. 2 and FIG. 3, a camera 120, the casino-chip read/write device 130, and the IC-card read/write device 300, the bill identification device 140, and a card-storage-box read device 150 are connected via the I/O interface 212 to the game management device 200. The I/O interface 212, which is connected to the various peripheral devices, is for exchanging data among these devices and the game management device 200.

Moreover, as depicted in FIG. 3, the game management device 200 is connected to the management server 400 via the communication interface 214. The game management device 200 transmits various types of information acquired in the game management device 200, e.g., various types of information such as a game result, the number of changed casino chips, and remaining money information stored in the IC card described later, to the management server 400 via the communication interface 214. Further, the management server 400 stores, performs computational processing on, and statistical processing on the various types of information transmitted from the game management device 200, and stores the results thereof. Moreover, where appropriate, the management server 400 transmits various types of information such as a result processed in the management server 400 to the game management device 200 via the communication interface 214. The game management device 200 stores the various types of information transmitted from the management server 400 on the RAM 206 and the HDD 208, displays the same on the display 220, and transmits the same to the IC-card read/write device 300 described later.

<Camera 120>

The camera 120 is connected to the game management device 200. When imaged data imaged by the camera 120 is processed, the position of the card placed on the casino table 100 is detected or trajectory data of the card is produced.

The camera 120 is arranged above the casino table 100. The camera 120 is disposed toward the game surface 110 of the casino table 100, and is capable of imaging the game surface 110. The camera 120 is connected to the game management device 200, images the game surface 110 at a predetermined timing according to a command signal from the game management device 200, and issues an imaging signal to the game management device 200. The game management device 200 receives the imaging signal issued from the camera 120, produces image data by the imaging signal, and stores the image data on the RAM 206 and the HDD 208 described later. The game management device 200 uses the stored image data to detect the position of the card placed on the casino table 100 or to produce the trajectory data of the card.

<Casino-Chip Read/Write Device 130>

The casino-chip read/write device 130 is connected to the game management device 200. The casino-chip read/write device 130 is arranged at a predetermined position of the casino table 100. The position at which the casino-chip read/write device 130 is arranged preferably is a position included in a range where the dealer can manipulate by extending his/her hand.

The casino-chip read/write device 130 includes a reader/writer 132. The reader/writer 132 is arranged on the bottom surface of the casino table 100, and is capable of reading and writing the casino chip 20 mounted on the game surface 110 of the casino table 100 and information in a non-contact manner. As described later, the casino chip 20 includes an IC device 22 having a storing function and is capable of strong usable information or unusable information into the IC device 22 by using the reader/writer 132. A plurality of reader/writers 132 are arranged over a predetermined range of the casino table 100, and are capable of reading from and writing into the respective IC devices 22 of the casino chips 20 mounted within the range in a non-contact manner. In doing so, the reader/writers 132 can read from and write into the respective IC devices 22 of the plurality of casino chips 20.

The usable information is information permitting the use of the casino chip 20, and the casino chip 20 in which the usable information is stored can be used for a game. The unusable information is information not permitting the use of the casino chip 20, and the casino chip 20 in which the unusable information is stored cannot be used for the game. When the unusable information is stored in the casino chip 20 collected after the end of the use for the game, the casino chip 20 cannot be directly used for the game even when the casino chip 20 encounters the dishonest act such as stealing. Thus, it is possible to maintain balanced benefits among the players.

As depicted in FIG. 1, the casino chip 20 includes the IC device 22, an antenna coil 24, and a booster coil 26.

The IC device 22 includes a computational processing function, a storing function, and an input/output control function. In response to a request from the reader/writer 132, the IC device 22 issues the information (the usable information or the unusable information) stored in the IC device 22, to the reader/writer 132, and stores the information (the usable information or the unusable information) issued from the reader/writer 132, into the IC device 22.

The antenna coil 24 transmits and receives a signal between the reader/writer 132 and the IC device 22, converts a carrier wave from the reader/writer 132 into power, and supplies the power to the IC device 22.

The booster coil 26 is configured to be electromagnetically coupled to a modulated electromagnetic wave from the reader/writer 132 and is capable of passing over the information of the IC device 22 to the reader/writer 132 by being electromagnetically coupled to the antenna coil 24 connected to the IC device 22 farther away from the reader/writer 132. The presence of the booster coil 26 enables extension of an electromagnetically coupled state, and thus, even if the casino chips 20 are stacked on the casino table 100, even the casino chip 20 stacked at a higher portion, out of the stacked casino chips 20, can communicate with the reader/writer 132 and the information of the IC device 22 can be passed over to the reader/writer 132. In doing so, the reader/writers 132 can read from and write into the respective IC devices 22 of the plurality of stacked casino chips 20.

As described above, the usable information or the unusable information can be stored in the casino chip 20. When the bill, etc., are changed to the casino chip 20 or when the casino chip 20 is distributed from the dealer as a payout, the casino chip 20 in which the usable information is written is applied to the player by the casino-chip read/write device 130. In doing so, the player becomes able to play the game by using the applied casino chip 20. Moreover, when the casino chip 20 is changed to the bill or when the dealer collects the casino chip 20 from the player, the unusable information is written by the casino-chip read/write device 130. In doing so, even when such a casino chip 20 is passed over to the player through a dishonest act such as stealing, the game cannot be played immediately because of the casino chip 20 in which the unusable information is written. Further, when such a casino chip 20 in which the unusable information is written is discovered, it is easy to investigate the obtaining route.

Further, the casino-chip read/write device 130 is connected to the game management device 200. When the casino-chip read/write device 130 stores the usable information or the unusable information into the casino chip 20, information about its number and time is stored. In this way, it becomes possible to manage conversion to cash, the payout, or collection record in real time, and at the same time, it is possible to manage its history, resulting in prevention of the dishonest act in the casino and facilitation of the discovery.

<Bill Identification Device 140>

The bill identification device 140 is connected to the game management device 200. The bill identification device 140 is arranged at a predetermined position of the casino table 100. The position at which the bill identification device 140 is arranged preferably is a position included in a range where the dealer can manipulate by extending his/her hand.

As described above, the bill identification device 140 is connected to the game management device 200. The bill identification device 140 reads the bill injected in the bill identification device 140, and transmits the money amount information indicating the money amount of the read bill to the game management device 200. The game management device 200 receives the money amount information and stores the information on the RAM 206 or the HDD 208. It is noted that a person who injects the bill into the bill identification device 140 may be either the player or the employee of the casino such as a dealer.

The keyboard 230 is connected to the game management device 200. The keyboard 230 is a device that can be manipulated by the employee of the casino such as a dealer. When the bill is injected into the bill identification device 140, its purpose is input from the keyboard 230. For example, the purpose of injecting the bill into the bill identification device 140 in order to change the bill to the casino chip or the purpose of injecting the bill as a tip to the dealer is input as a result of the dealer, etc., manipulating the keyboard 230.

When it is detected that the bill is injected into the bill identification device 140, the game management device 200 displays a selection screen for the bill injection purpose on the display 220. A first item is "for changing to the casino chip", and a second item is "for the tip to the dealer". When the dealer, etc., depress "1" on a numerical keypad, purpose information of "for changing to the casino chip" is selected, and when the dealer, etc., depress "2" on the numerical keypad, purpose information of "for the tip to the dealer" is selected. Thereafter, with the money amount information transmitted from the bill identification device 140, the purpose information is stored on the HDD 208. In doing so, by using the game management device 200, the money amount can be managed in a manner to correspond to the purpose of injecting the bill.

<Card Storage Box 160>

A card storage box 160 is arranged in a range where the dealer of the casino table 100 can manipulate by extending his/her hand.

The card storage box 160 is a box, in which the card such as a playing card is contained, for distributing the card to the player who plays the game using the casino table 100. At the end of the card storage box 160, an opening through which the contained card can be discharged is formed. When the dealer distributes the card to the player, the dealer withdraws the card from the card storage box 160 so that the card passes through the opening.

At the front of the opening, the card-storage-box read device 150 (for example, an optical scanner) is arranged so that the top surface of the card is scanned. The game management device 200 is connected to the card-storage-box read device 150. When the card passes above the card-storage-box read device 150, the design printed on the card is read to convert the design into identification information for identifying the card. In doing so, when the dealer withdraws the card from the card storage box 160, the design printed on the card is always read by the card-storage-box read device 150, and the identification information can be transmitted to the game management device 200 and stored on the RAM 206 of the game management device 200. In this way, the dealer becomes able to constantly manage the type of the card distributed from the card storage box 160 to the player, and thus, it is possible to prevent or easily discover the dishonest act.

Moreover, when the game is started, the timing at which the card passes above the card-storage-box read device 150 can be used as a start time to trace the trajectory of the card. This saves the dealer's labor of inputting the timing at which to start tracing the trajectory of the card by way of the keyboard 230 of the game management device 200.

<IC-Card Read/Write Device 300>

The IC-card read/write device 300 is connected to the game management device 200. The IC-card read/write device 300 is arranged at a predetermined position of the casino table 100. The position at which the IC-card read/write device 300 is arranged preferably is included in a range where the player can manipulate by extending his/her hand.

The IC-card read/write device 300 is for writing or reading the cash information into or from the IC card inserted from an insertion slot of the IC-card read/write device 300. The IC card includes an IC chip (not shown) for storing the cash information (remaining money information). The IC card, which is possessed by the player who plays the game in the casino, is for storing the information about the cash (remaining money information) owned by the player. The player previously injects the cash into a change machine installed at a predetermined location in the casino, and adds the money amount information indicating the amount of the injected money to the remaining money information of the IC card. In doing so, the player becomes able to play the game in the casino as long as the player possesses the IC card only without a need of carrying the cash in the casino. When the player changes the cash to the casino chip using the IC card, the amount of money corresponding to the number of changed casino chips is subtracted from the IC chip of the IC card, and thus, the money amount information of the IC card means the remaining money information.

As depicted in FIG. 4, the IC-card read/write device 300 includes: a CPU 302; a ROM 304; a RAM 306; an input/output bus 308; and an I/O interface 310. The CPU 302, the ROM 304, the RAM 306, and the I/O interface 310 are connected to each other via the input/output bus 308 so that data can be input and output.

The CPU (Central Processing Unit) 302 executes subroutines depicted in FIG. 11, FIG. 13, FIG. 15, and FIG. 16 described later. The ROM (Read Only Memory) 304 stores a program for processing these subroutines depicted in FIG. 11, FIG. 13, FIG. 15, and FIG. 16. The RAM (Random Access Memory) 306 is for temporarily storing values of various data items when the CPU 302 executes the subroutines depicted in FIG. 11, FIG. 13, FIG. 15, and FIG. 16.

Further, as depicted in FIG. 4, a reader/writer 320, a display 330, a keyboard 340, and the game management device 200 are connected to the IC-card read/write device 300 via the I/O interface 310. The I/O interface 310 is an interface, which is connected to the respective peripheral devices, for exchanging data among these devices and the IC-card read/write device 300.

As described above, the reader/writer 320, the display 330, and the keyboard 340 are connected to the IC-card read/write device 300 via the I/O interface 310. The reader/writer 320 writes predetermined information into the IC chip of the IC card, and reads the predetermined information from the IC chip. When the IC card is inserted into the IC-card read/write device 300, the money amount information read from the IC card is displayed on the display 330. Further, a maximum casino chip number (convertible maximum casino chip number) that can be converted according to the read money amount information also is preferably displayed. The keyboard 340 is for inputting the number of casino chips desired by the player.

If the money amount corresponding to the number of casino chips desired by the player is equal to or less than the money amount of the money amount information read from the IC card, then the cash can be converted. Thus, information indicating the conversion is possible is displayed on the display 330. On the other hand, if the money amount corresponding to the number of casino chips desired by the player is larger than the money amount of the money amount information read from the IC card, then the cash cannot be converted. Thus, information indicating that the conversion is not possible is displayed on the display 330.

As described above, the IC-card read/write device 300 is connected to the game management device 200. When the player inserts the IC card into the IC-card read/write device 300, the money amount information read from the IC card and the convertible maximum casino chip number are transmitted to the game management device 200 from the IC-card read/write device 300. In doing so, the money amount information and the convertible maximum casino chip number can be displayed also on the display 220 connected to the game management device 200. In doing so, also the employee of the casino such as a dealer becomes able to visually confirm the money amount information or the convertible maximum casino chip number.

Moreover, also when the player inputs the desired number of casino chips, the number is transmitted to the game management device 200 from the IC-card read/write device 300. In doing so, also the number of casino chips desired by the player can be displayed on the display 220 connected to the game management device 200. This allows the dealer, etc., to visually confirm the number of casino chips. Moreover, likewise, the both information indicating the conversion is possible and not possible can also be displayed on the display 220 of the game management device 200.

In the case where the money amount corresponding to the number of casino chips desired by the player is equal to or less than the money amount of the money amount information read from the IC card, the employee of the casino such as a dealer passes over the casino chips as much as that number to the player.

It is noted that a payout device (not shown) for paying out the casino chip may be connected to the IC-card read/write device 300. In the case where the money amount corresponding to the number of casino chips desired by the player is equal to or less than the money amount of the money amount information read from the IC card when such an arrangement is set, the casino chips as much as the number may be paid out from the payout device. In doing so, a burden of the employee of the casino such as a dealer can be alleviated.

<Management Server 400>

As depicted in FIG. 2, a management server 400 is connected to the game management device 200 via a network 410. In the casino, the plurality of casino tables 100 are installed and various types of games are played. For example, Blackjack is played at a certain casino table 100, a poker is played at another casino table 100, a roulette is played at another casino table 100. The game management devices 200 are respectively installed at the plurality of casino tables 100. When the respective game management devices 200 are connected to the management servers 400, results of respective games played at the plurality of casino tables 100, the cash injected to be changed to the casino chip, the number of changed casino chips, various types of information such as the cash information stored in the aforementioned IC card can be collectively managed.

Each management server 400 is arranged at a predetermined location in the casino. The management server 400 can be used only by the employee of the casino such as a dealer.

The management server 400 includes: a CPU; a ROM; a RAM; an HDD; an input/output bus; and communication interface (not shown). The CPU, the ROM, the RAM, and the communication interface are connected to each other via the input/output bus so that data can be input and output.

The CPU (Central Processing Unit) receives various types of information transmitted from the game management device 200, stores the information on the RAM or the HDD, performs various processing such as computational processing and statistical processing by using the various types of the received information, and stores the results on the RAM and the HDD. On the ROM (Read Only Memory), a program for executing such processing is stored. On the RAM (Random Access Memory), values of various data items generated when the CPU executes various processing are temporarily stored. Moreover, the HDD is for eternally storing and accumulating the values of the various data items when the CPU executes the various types of processing.

First Embodiment

Hereinafter, the first embodiment will be explained. In the first embodiment, data of the trajectory of the card placed on the game surface 110 of the casino table 100 is produced.

<<Card-Trajectory-Data Producing Processing 1>>

Figure 5:
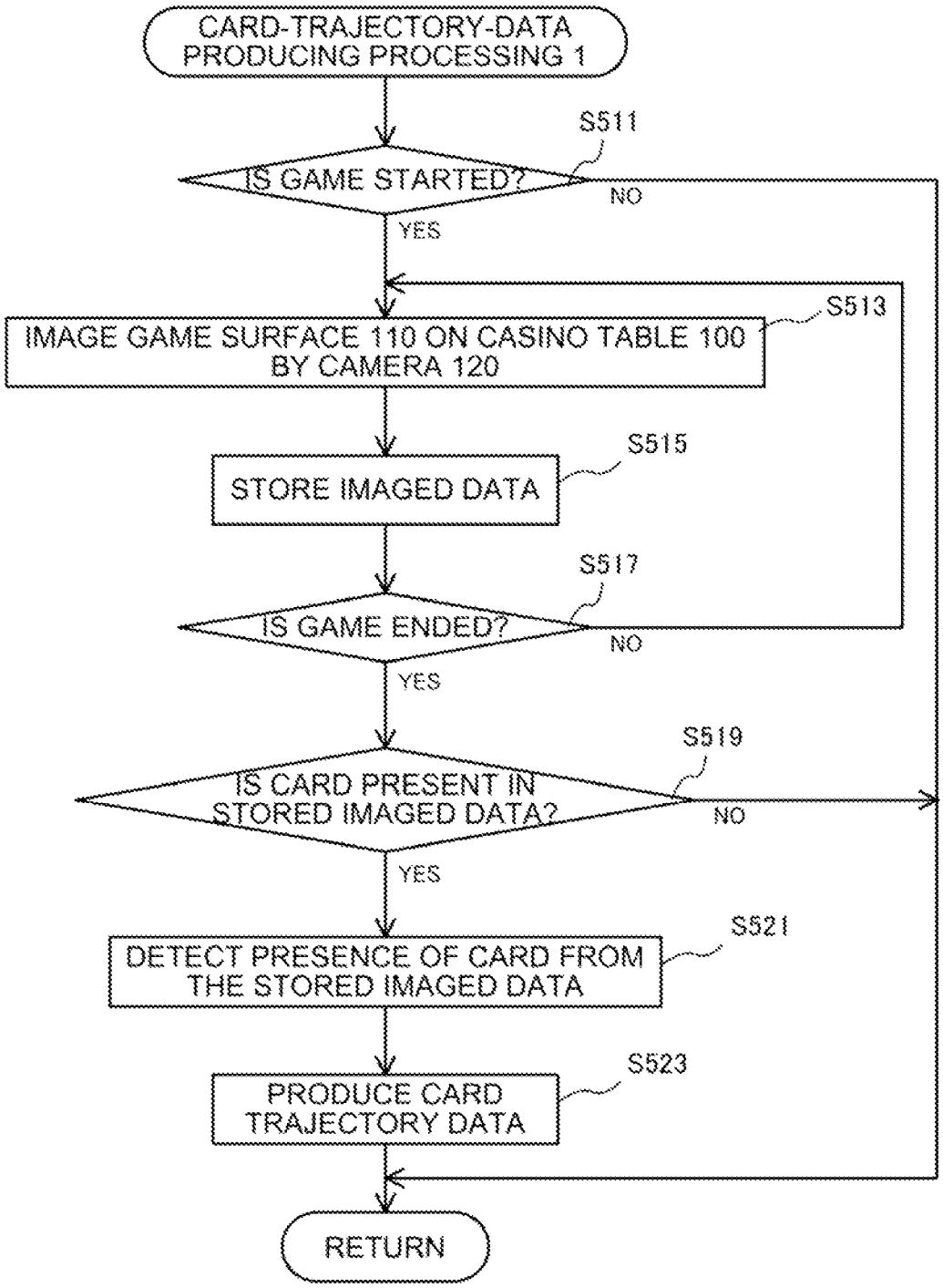
FIG. 5 is a flowchart depicting first processing for producing trajectory data of a card placed on the casino table.

FIG. 5 is a flowchart depicting first processing for producing the trajectory data of the card placed on the casino table 100.

Firstly, it is determined whether the game is started (step S511). Whether the game is started can be determined based on whether the dealer performs a predetermined manipulation on the keyboard 230. This manipulation preferably is performed before the dealer distributes the card to the player. In doing so, it becomes possible to trace the trajectory of the card from a time when the dealer distributes the card to the player. Further, it may be also possible to determine whether the game is started based on whether the card has passed above the card-storage-box read device 150 of the card storage box 160. In doing so, it becomes possible to save the dealer's labor of inputting by way of the keyboard 230 of the game management device 200. Upon determining that the game is not yet started (NO), the subroutine is immediately ended.

On the other hand, upon determining that the game is already started (YES), the game surface 110 of the casino table 100 is imaged by the camera 120 (step S513), and the resultant imaged data is stored on the HDD 208 (step S515). The use of the HDD 208 enables storing the imaged data, i.e., a large amount of image data.

Subsequently, it is determined whether the game is ended (step S517). Whether the game is ended can be determined based on whether the dealer performs a predetermined manipulation on the keyboard 230. This manipulation preferably is performed after the dealer collects all the cards from the player. In doing so, it becomes possible to trace the trajectory of the card until the dealer collects all the cards.

Upon determining that the game is not yet ended (NO), the process returns to step S513. In doing so, the game surface 110 of the casino table 100 is imaged by the camera 120 while the game is played, and the trajectory data of the card obtained while the game is played can be produced.

On the other hand, upon determining that the game is ended (YES), it is determined whether the card is imaged on the imaged data stored on the HDD 208 (step S519). Upon determining that the card is not imaged on the imaged data stored on the HDD 208 (NO), the subroutine is immediately ended.

On the other hand, upon determining that the card is imaged on the imaged data stored on the HDD 208 (YES), the presence of the card is detected from the imaged data (step S521) and the trajectory data of the card is produced (step S523). Then, the subroutine is ended.

In the processing in the aforementioned steps S519 and S521, it is determined whether it is possible to extract a predetermined-sized rectangular image that appears to be a card. If the extraction is possible, the position of a vetex or the position at the center of the rectangular image is used as the card position information and this information is stored on the RAM 206 or the HDD 208. At this time, the card position information, together with time information, processing sequence, etc., is stored. In doing so, with the processing in step S523, it becomes possible to produce the card trajectory data. Further, the card position information, together with the time information, the processing sequence, a game result, preferably is stored, for each game played, on the RAM 206 or the HDD 208 (see FIG. 8). In doing so, these information can be retained as a game history even after the game is ended, and thus, it becomes easier to retroactively determine the presence or absence of the dishonest act.

As a result of the subroutine depicted in the aforementioned FIG. 5 being executed, the card trajectory data is produced at each predetermined timing by imaging the game surface 110 of the casino table 100 by using the camera 120 during a time from the dealer distributes the card to the player to the dealer collects the card after the end of the game. Thus, the dishonest act such as the cards are secretly changed or lost during the game can be determined in real time.

Further, in the game, a plurality of cards are placed on the game surface 110 of the casino table 100. In the subroutine depicted in FIG. 5, the trajectory data items of all the cards included in the imaged data imaged by the camera 120 are respectively produced, and thereby, even when there is committed a dishonest act in which even a single card is secretly changed or lost, out of the plurality of cards placed on the game surface 110, this act can be determined in real time.

<<Card-Trajectory-Data Producing Processing 2>>

Figure 6:
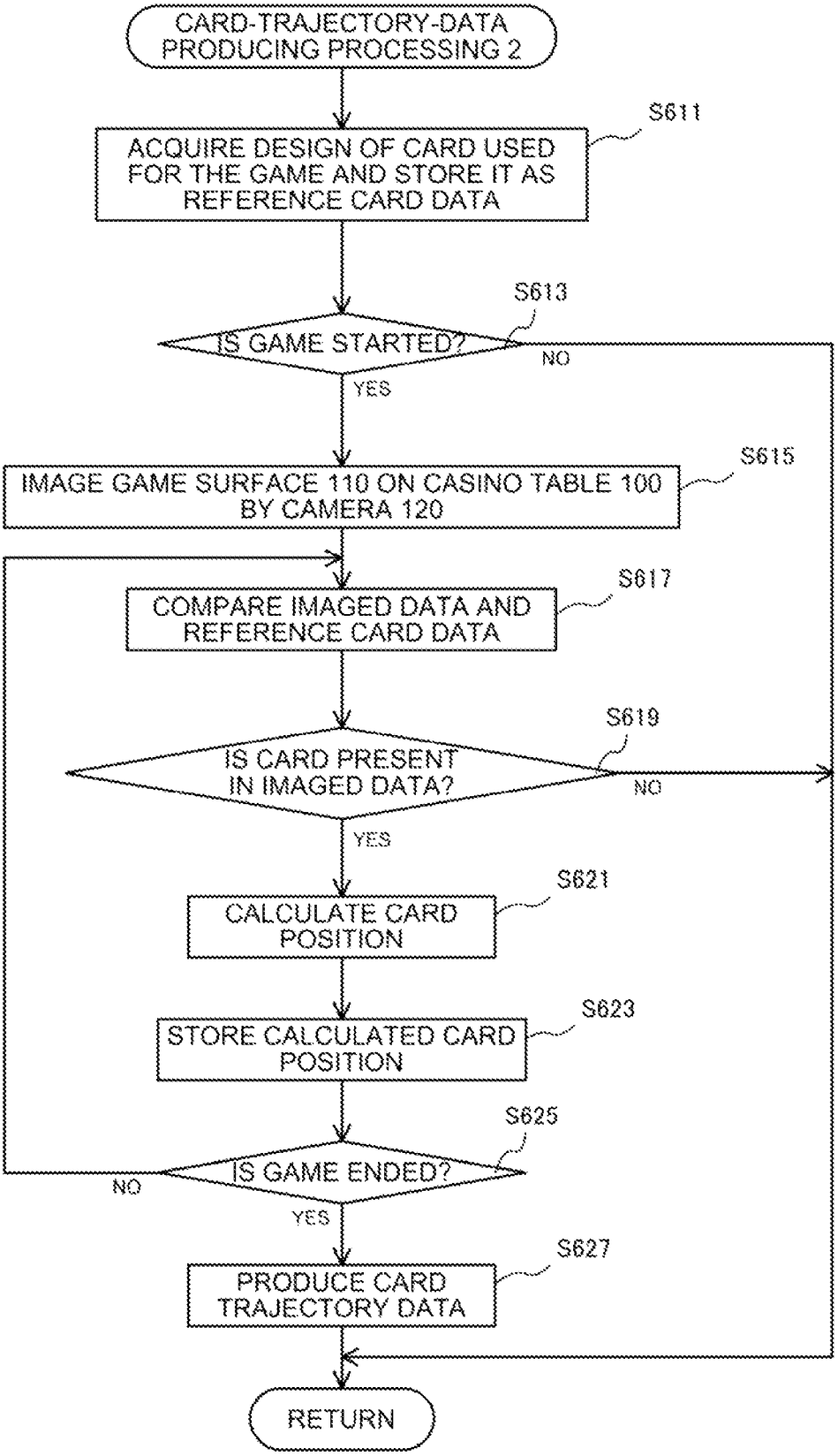
FIG. 6 is a flowchart depicting second processing for producing the trajectory data of the card placed on the casino table.

FIG. 6 is a flowchart depicting second processing for producing the trajectory data of the card placed on the casino table 100. Similar to the flowchart depicted in FIG. 5, in the flowchart depicted in FIG. 6, the trajectory data of the card placed on the game surface 110 of the casino table 100 is produced.

Firstly, the design of the card used for the game is acquired, and the resultant design is stored as reference card data (step S611). Examples of the design of the card include a design on the bottom surface of the card, i.e., the identical design commonly drawn on a plurality of cards so that the cards cannot be distinguished. In the processing in step S611, the data in which the design on the bottom surface of a playing card is acquired can be used as the reference card data.

It is noted that the image data of the design of the card acquired in the processing in step S611 may be either obtained by imaging the design of the card by the camera 120 or obtained by optically scanning the design by using another scanner such as the card-storage-box read device 150. In either way, as the reference card data of the design of the card, the data that can be used to compare with another image data may suffice.

Subsequently, it is determined whether the game is started (step S613). The determination can be made, similar to step S511 in FIG. 5. Whether the game is started can be determined based on whether the dealer performs a predetermined manipulation on the keyboard 230. This manipulation preferably is performed before the dealer distributes the card to the player. In doing so, it becomes possible to trace the trajectory of the card from a time when the dealer distributes the card to the player. Upon determining that the game is not yet started (NO) in the determination processing in step S613, the subroutine is immediately ended.

On the other hand, upon determining that the game is already started (YES), the game surface 110 of the casino table 100 is imaged by the camera 120 (step S615). This processing is similar to that in step S513 in FIG. 5.

Subsequently, the imaged data imaged in the processing in step S615 is compared to the reference card data acquired in the processing in step S611 (step S617). As described above, the reference card data is data in which the design of the card used for the game is acquired each time. Thus, even when a card having a different design is used, the comparison can adequately be performed by lessening an erroneous recognition in the comparison processing in step S617.

Subsequently, as a result of the comparison processing in step S617, it is determined whether the reference card data is present in the imaged data (step S619). Normally, a plurality of cards are placed on the casino table and the game is progressed, and thus, in the determination in step S619, it is preferably determined whether there is no reference card data present in the imaged data, i.e., no card is placed on the casino table.

Upon determining that the reference card data is not present in the imaged data in the determination processing in step S619 (NO), this subroutine is immediately ended. Examples of this case include a case where the card placed on the casino table ceases to exist due to a certain reason, and therefore, the game is ended or interrupted.

On the other hand, upon determining that the reference card data is present in the imaged data in the determination processing in step S619 (YES), the position of the card is calculated from a location where the reference card data is present in the imaged data (step S621). In this case also, when the position of the card is calculated, the position of a vertex or the position at the center preferably is calculated as the card position information from the location where the reference card data is present.

Subsequently, the calculated card position information is stored on the RAM 206 or the HDD 208 (step S623). In this processing also, the card position information, together with time information, processing sequence, etc., is stored. In doing so, with the processing in step S627 described later, it becomes possible to produce the card trajectory data. Further, the card position information, together with the time information, the processing sequence, a game result, preferably is stored, for each game played, on the RAM 206 or the HDD 208 (see FIG. 8). In doing so, these information can be retained as a game history even after the game is ended, and thus, it becomes easier to retroactively determine the presence or absence of the dishonest act.

Subsequently, it is determined whether the game is ended (step S625). Whether the game is ended can be determined based on whether the dealer performs a predetermined manipulation on the keyboard 230. This manipulation preferably is performed after the dealer collects all the cards from the player. In doing so, it becomes possible to trace the trajectory of the card until the dealer collects all the cards. Upon determining that the game is not yet ended (NO) in the determination processing in step S625, the process returns to step S617.

On the other hand, upon determining that the game is ended (YES), the card trajectory data is produced (step S627), and then, this subroutine is ended.

It is noted that the reference card data acquired in the processing in the aforementioned step S611 or the imaged data imaged in the processing in step S615 preferably is subjected to various types of image processing such as extraction of an outline and a modification of a contrast. In doing so, the erroneous recognition can be further decreased in the comparison processing in step S617, and the presence of the card can be adequately determined.

As a result of the subroutine depicted in the aforementioned FIG. 6 being executed, the card trajectory data is produced at each predetermined timing by imaging the game surface 110 of the casino table 100 by using the camera 120 during a time from the dealer distributes the card to the player to the dealer collects the card after the end of the game. Thus, the dishonest act such as the cards are secretly changed or lost during the game can be determined in real time.

Further, in the game, a plurality of cards are placed on the game surface 110 of the casino table 100. In the subroutine depicted in FIG. 6, the trajectory data items of all the cards included in the imaged data imaged by the camera 120 are respectively produced, and thereby, even when there is committed a dishonest act in which even a single card is secretly changed or lost, out of the plurality of cards placed on the game surface 110, this act can be determined in real time.

The aforementioned step S611 provides a case where the design of the card used for the game is acquired and used as the reference card data. As described above, the design on the bottom surface of the playing card, for example, is used as the design of the card. However, when the card is distributed, the bottom surface of the card is faced up, and thus, the image data on the bottom surface of the card can be compared as the reference card data. However, since the player is interested in the content on the top surface of the card, the top surface of the card is often imaged by the camera 120 when the player exposes the top surface of the card. As a result of such a circumstance, there may be a case where the presence of the card cannot be adequately determined. Therefore, the external shape or the outline of the card is acquired from the image data on the bottom surface of the card and external-shape data or outline data may be used as the reference card data. In this case, in the determination processing in step S619, it may suffice if whether the reference card data is present in the imaged data is determined by using data such as the size or the shape of the card. In doing so, also when the top surface of the card is imaged and when the bottom surface thereof is imaged, the presence of the card can be adequately determined and the card trajectory data can be produced.

<<Card Trajectory Data Display Processing>>

Figure 7:
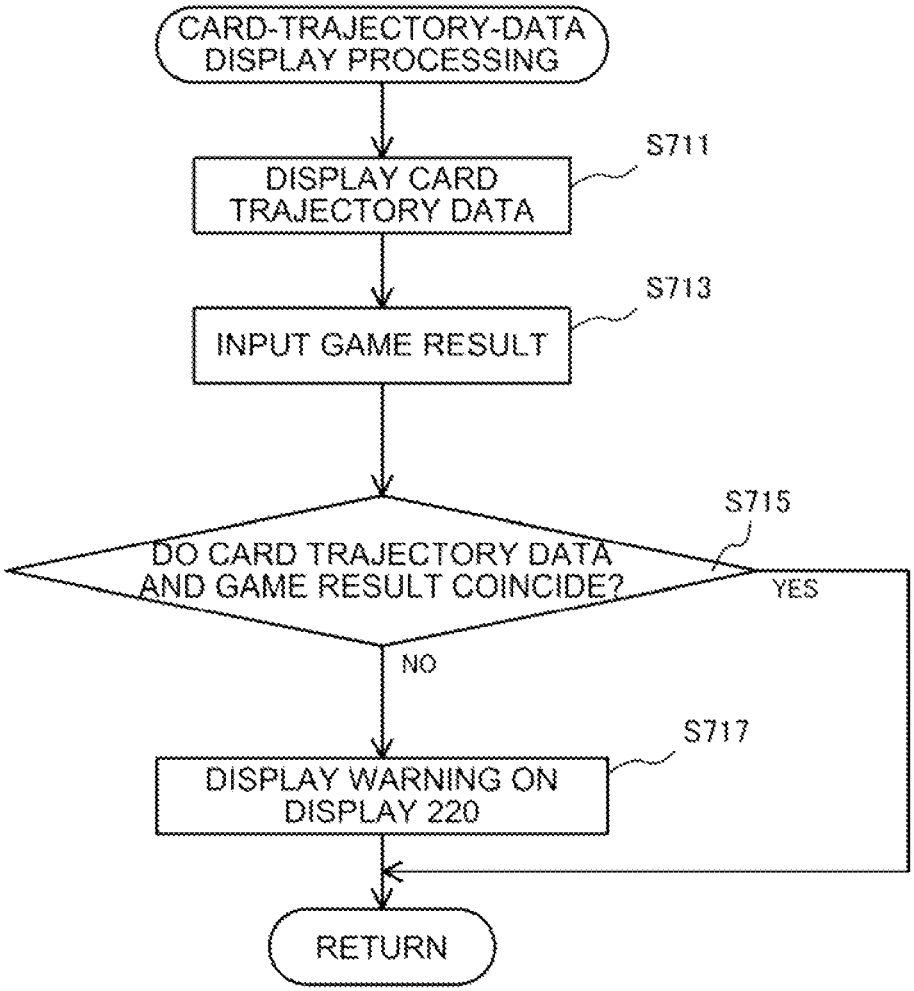
FIG. 7 is a flowchart depicting processing for displaying the trajectory data produced by card-trajectory-data producing processing 1 or card-trajectory-data producing processing 2.

FIG. 7 is a flowchart depicting processing for displaying the trajectory data produced in the card-trajectory-data producing processing 1 depicted in FIG. 5 or the card-trajectory-data producing processing 2 depicted in FIG. 6.

Firstly, the CPU 202 of the game management device 200 displays on the display 220 the trajectory data produced in the processing in step S523 in FIG. 5 or step S627 in FIG. 6 (step S711).

Subsequently, as a result of the dealer manipulating the keyboard 230, the game result is input (step S713). For example, in the case where the game is a poker in which the playing card is used, a type of combinations such as a three of a kind and a royal straight flush is input from the keyboard 230.

Subsequently, it is determined whether the card trajectory data and the game result coincide (step S715). Upon determining that the card trajectory data and the game result coincide (YES), there is no particular problem. Then, the subroutine is immediately ended.

On the other hand, upon determining that the card trajectory data and the game result do not coincide (NO), a warning message is displayed on the display 220 (step S717). Then, the subroutine is ended.

These processing are displayed on the display 220 of the game management device 200, and thus, the dealer can confirm it at each end of the game, allowing the dealer to immediately determine whether the dishonest act is committed in the game at that time.

As described above, the card-storage-box read device 150 is arranged in the card storage box 160, and when the card passes above the card-storage-box read device 150, the design printed on the card is read and the identification information for identifying that card is transmitted to the game management device 200. For example, as a result of the design printed on the top surface of the card being read, it becomes possible to know that the read card is a card having identification information of "four of heart" or a card having identification information of "five of diamonds" (see FIG. 8).

Thereafter, as a result of the subroutines in the aforementioned FIG. 5 or FIG. 6 being executed, the respective positions of the plurality of cards placed on the casino table are acquired for each predetermined time, and thereby, the respective positions of the plurality of cards, together with a date and time on which the position of the card is acquired, are stored on the RAM 206 or the HDD 208. In this way, the trajectory data can be produced (see FIG. 8). Moreover, if the position of the card cannot be acquired because it is determined that the card is not present when the subroutine in FIG. 5 or FIG. 6 is executed, then information different from the position information is stored in the trajectory data. In doing so, it becomes possible to quickly search the result that the position of the card could not be acquired.

As a result of such trajectory data being produced, the trajectory data of the card and the identification information for identifying the card can be associated (see FIG. 8), and when the game is ended, it is possible to specify an alignment or a combination of the cards from the trajectory data of the card. As a result of determination whether the alignment or combination of the cards and the game result coincide, it becomes possible to determine whether the dishonest act is committed in the game at that time.

Further, in determining the trajectory data, whether the trajectory is disappeared during the game, whether a new trajectory is generated, or whether the trajectory longer than a predetermined length is broken up can also be determined without a comparison with the game result, and then, the warning message may be displayed on the display for the dealer 220.

Second Embodiment

Hereinafter, the second embodiment will be explained. In the second embodiment, the usable information or the unusable information is stored on the IC device 22 of the casino chip 20 by the reader/writer 132.

<<Casino Chip Usable Information Writing Processing>>

Figure 9:
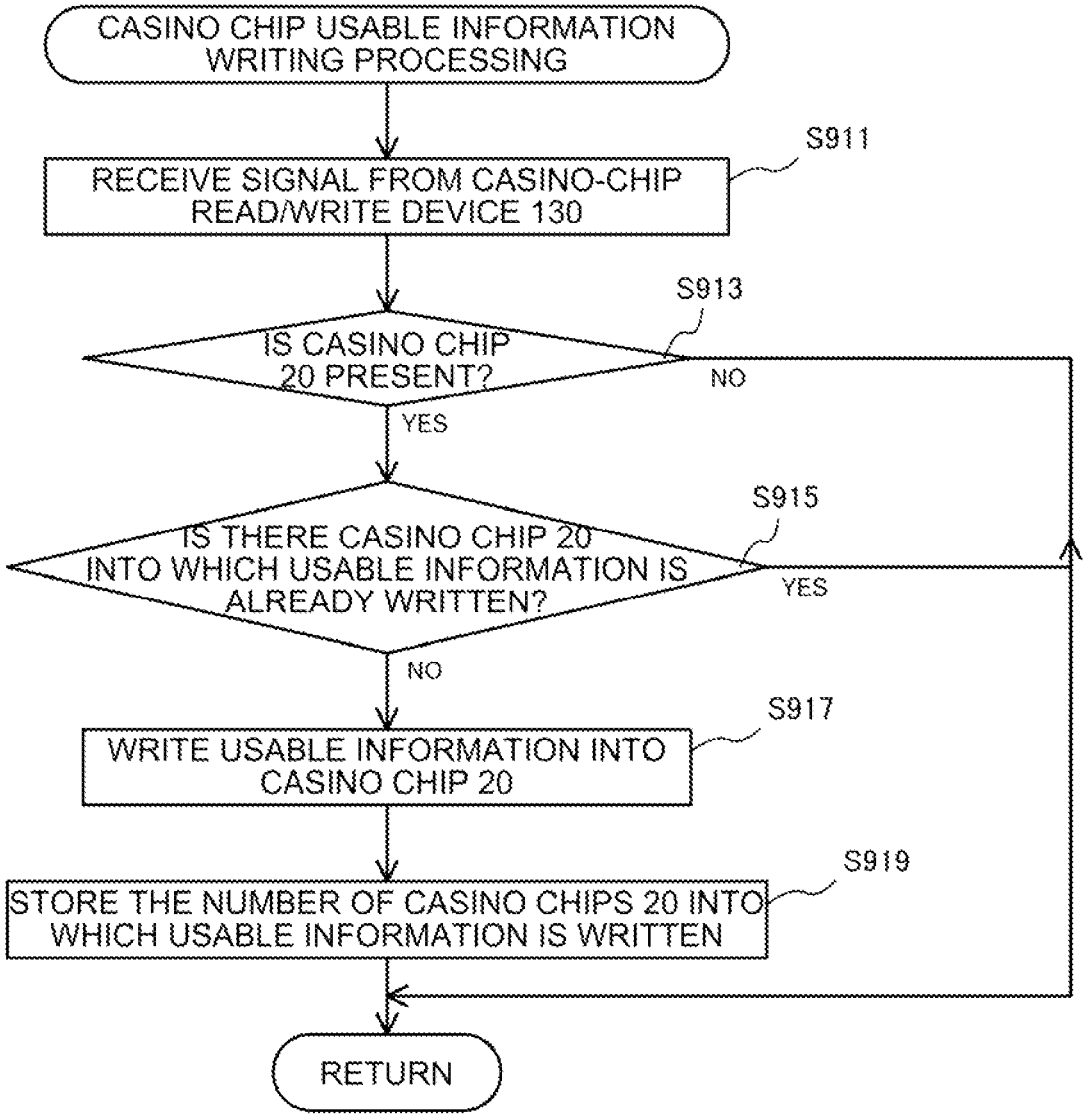
FIG. 9 is a flowchart depicting processing for writing usable information on a casino chip 20.

FIG. 9 is a flowchart depicting processing for writing the usable information on the casino chip 20.

Firstly, a signal issued from the casino-chip read/write device 130 is received (step S911). By the signal issued from the casino-chip read/write device 130, it becomes possible to determine whether the casino chip 20 is present in a range of the readable/writable casino table 100 of the casino-chip read/write device 130.

Subsequently, by the signal issued from the casino-chip read/write device 130, it is determined whether the casino chip 20 is present (step S913). Upon determining that the casino chip 20 is not present (NO), the subroutine is immediately ended.

Upon determining that the casino chip 20 is present (YES), the information stored on the IC device 22 of the casino chip 20 is read so as to determine whether the casino chip 20 in which the usable information is already written is present in the present casino chips 20 (step S915). Upon determining that the casino chip 20 in which the usable information is already written is present (YES), the subroutine is immediately ended. It is noted that the presence of the casino chip 20 in which the usable information is already written preferably is displayed on the display 220 before the end of the subroutine. In doing so, it becomes possible to notify the dealer of a possibility that the casino chip 20 in which the usable information is already written due to a certain mistake is included.

Upon determining in the determination processing in step S915 that the casino chip 20 in which the usable information is already written is not present (NO), the usable information is written into the IC device 22 of the casino chip 20 via the reader/writer 132 of the casino-chip read/write device 130

(step S917), and the number of the casino chips 20 in which the usable information is written is stored on the HDD 208 (step S919). Then, the subroutine is ended.

With this processing, when the bill, etc., are changed to the casino chip 20 or when the casino chip 20 is distributed from the dealer as a payout, the casino chip 20 in which the usable information is written is applied to the player by the casino-chip read/write device 130. In doing so, the player becomes able to play the game by using the applied casino chip 20.

<<Casino Chip Unusable Information Writing Processing>>

Figure 10:
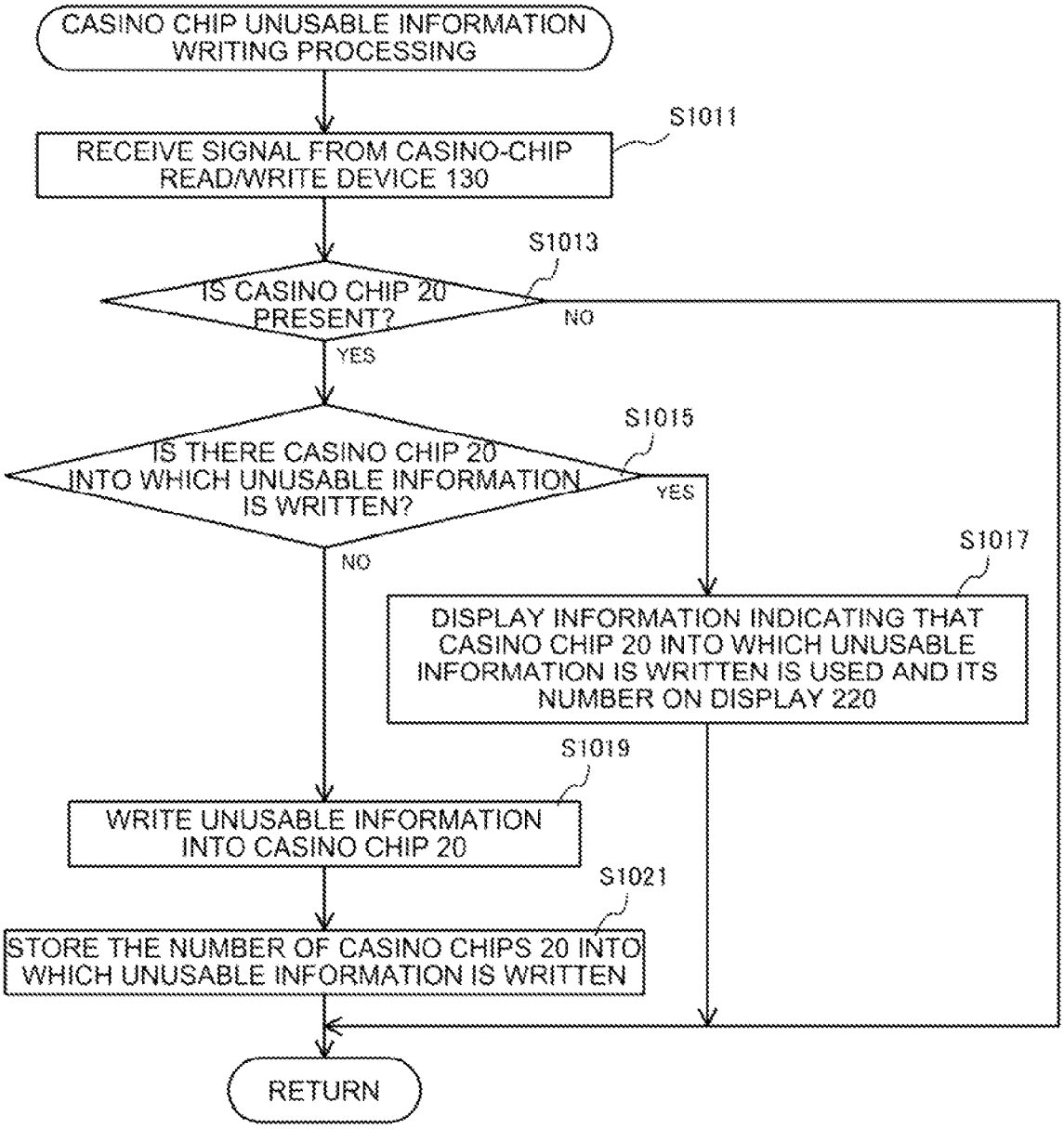
FIG. 10 is a flowchart depicting processing for writing unusable information on the casino chip 20.

FIG. 10 is a flowchart depicting processing for writing the unusable information on the casino chip 20.

Firstly, a signal issued from the casino-chip read/write device 130 is received (step S1011). This processing is similar to that in step S911 in FIG. 9. By the signal issued from the casino-chip read/write device 130, it becomes possible to determine whether the casino chip 20 is present in a range of the readable/writable casino table 100 of the casino-chip read/write device 130.

Subsequently, by the signal issued from the casino-chip read/write device 130, it is determined whether the casino chip 20 is present (step S1013). This processing is similar to that in step S913 in FIG. 9. Upon determining that the casino chip 20 is not present (NO), the subroutine is immediately ended.

Upon determining that the casino chip 20 is present (YES), the information stored on the IC device 22 of the casino chip 20 is read, and it is determined whether the casino chip 20 in which the unusable information is written is present in the present casino chips 20 (step S1015). Upon determining that the casino chip 20 in which the unusable information is written is present (YES), information indicating that the casino chip 20 in which the unusable information is written is used and the number of the casino chips 20 are displayed on the display 220 (step S1017). Then, the subroutine is ended.

As a result of the casino chip usable information writing processing in the aforementioned FIG. 9, the player is to play the game always using the casino chip 20 in which the usable information is written. Therefore, there is no chance that the player possesses the casino chip 20 in which the unusable information is written. Consequently, in the case where the player possesses the casino chip 20 in which the unusable information is written, it is highly possible that the player obtains the casino chip 20 through the dishonest act such as stealing, and thus, the determination processing in step S1015 is effective processing for preventing or discovering the dishonest act. As a result of the processing in step S1017, the dealer, etc., visually confirm the information indicating that the casino chip 20 in which the unusable information is written is used and the number of the casino chips 20. In this way, it becomes possible for the dealer, etc., to know that there is committed the dishonest act.

Upon determining in the determination processing in step S1015 that the casino chip 20 in which the unusable information is already written is not present (NO), the unusable information is written on the IC device 22 of the casino chip 20 via the reader/writer 132 of the casino-chip read/write device 130 (step S1019), and the number of the casino chips 20 in which the unusable information is written is stored on the HDD 208 (step S1021). Then, the subroutine is ended.

By processing in this way, when the casino chip 20 is changed to the bill or when the dealer collects the casino chip 20 from the player, the unusable information is written by the casino-chip read/write device 130. In doing so, even when such a casino chip 20 is fell into the hand of the player through the dishonest act such as stealing, the unusable information has been written in this casino chip 20, and as a result, the player cannot immediately play the game and the possibility that the dishonest act is committed can be easily discovered.

When the identification information of the casino chip 20, such as a serial number, is stored on the casino chip 20, it becomes possible to manage each of the plurality of casino chips 20. Further, as a result of the processing in step S917, the game management device 200 stores a date and time on which the usable information is written on the IC device 22 of the casino chip 20, together with the identification information of the casino chip 20, on the RAM 206 or the HDD 208. Likewise, as a result of the processing in step S1019, the game management device 200 stores a date and time on which the unusable information is written on the IC device 22 of the casino chip 20, together with the identification information of the casino chip 20, on the RAM 206 or the HDD 208. Moreover, the game management device 200 stores also a date and time, determined as a result of the determination processing in step S1015 that the casino chip 20 in which the unusable information is written is present, together with the identification information of the casino chip 20, on the RAM 206 or the HDD 208. In doing so, it becomes possible to more adequately manage the casino chip 20. For example, as a result of the processing in step S1019, it becomes easier to determine the possibility that the casino chip 20 is stolen from a period from the date and time on which the unusable information is written on the IC device 22 of the casino chip 20 to the date and time determined that the casino chip 20 in which the unusable information is written is present.

Further, besides the information about these dates and times and the identification information of the casino chip 20, information for identifying the casino table 100 or the game management device 200 may be stored in the management server 400. In the casino, a plurality of casino tables 100 are installed, and thus, when the information for identifying the casino table 100 or the game management device 200 is used, it becomes also possible to manage a manner in which the casino chip 20 is carried by the player to be used in the game.

Third Embodiment

Hereinafter, the third embodiment will be explained. In the third embodiment, the remaining money information stored in the IC card is read and is employed to change to the casino chip. Moreover, when the player continuously plays the game, a point is generated when a predetermined condition is satisfied, the point is redeemed to the player, and the remaining money information in the IC card is updated.

<<Casino Chip Conversion Processing>>

Figure 11:
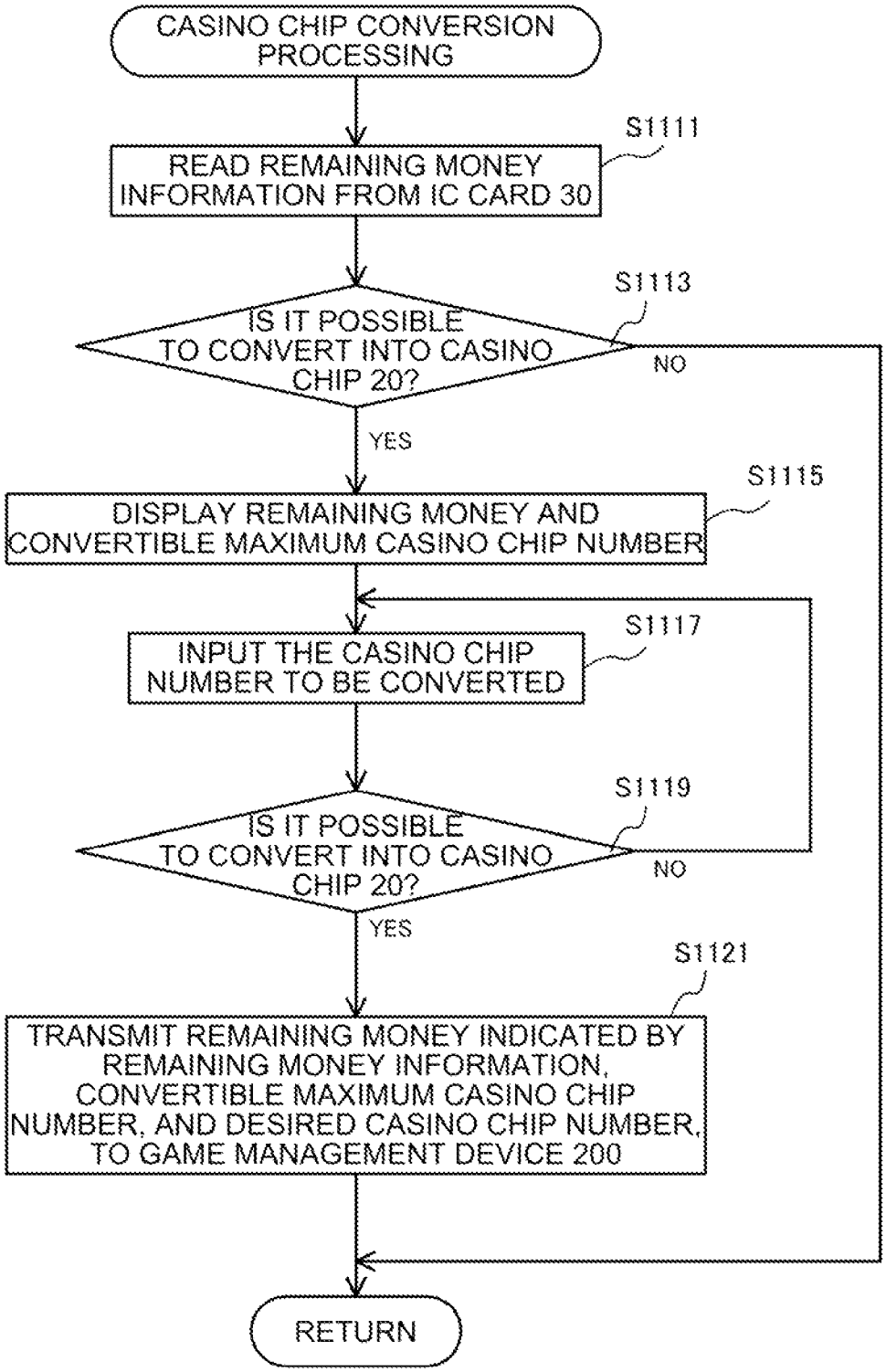
FIG. 11 is a flowchart depicting processing for converting into the casino chip 20 based on remaining money information stored in an IC card.

FIG. 11 is a flowchart depicting processing for converting into the casino chip 20 based on the remaining money information stored in the IC card. A subroutine depicted in this FIG. 11 is executed by the CPU 302 of the IC-card read/write device 300.

Firstly, the remaining money information is read from the IC chip of the IC card 30 (step S1111). As described above, the IC-card read/write device 300 is mounted in a range where the player can manipulate by extending his/her hand, and when the player inserts the IC card 30 possessed by the player into the IC-card read/write device 300, the remaining money information stored in the IC chip of the IC card 30 can be read by the IC-card read/write device 300.

It is determined whether it is possible to convert into the casino chip 20 by the remaining money indicated by the remaining money information (step S1113). This determination is processing for determining whether the remaining money indicated by the remaining money information is a minimum amount being capable of converting into the casino chip 20. Upon determining that it is not possible to convert into the casino chip 20 by the remaining money indicated by the remaining money information (NO), the subroutine is immediately ended.

Upon determining that it is possible to convert into the casino chip 20 by the remaining money indicated by the remaining money information (YES), the remaining money indicated by the remaining money information and a maximum number reached when the remaining money is used to convert into the casino chip 20 (convertible maximum casino chip number) are displayed on the display 330 (step S1115). The player visually confirms the convertable maximum casino chip number displayed on the display 330. The keyboard 340 is manipulated by the player, and the casino chip number desired by the player is input (step S1117).

Subsequently, it is determined whether it is possible to convert into the casino chip number input by the player (step S1119). That is, it is determined whether the money amount corresponding to the casino chip number input by the player is equal to or less than the remaining money indicated by the remaining money information. Upon determining that it is not possible to convert into the casino chip number input by the player in the determination processing in step S1119 (NO), the process returns to the aforementioned step S1117.

On the other hand, upon determining that it is possible to convert into the casino chip number input by the player (YES), the remaining money indicated by the remaining money information, the convertable maximum casino chip number, and the casino chip number input by the player are transmitted to the game management device 200 (step S1121). Then, the subroutine is ended.

<<Casino Chip Number Display Processing>>

Figure 12:
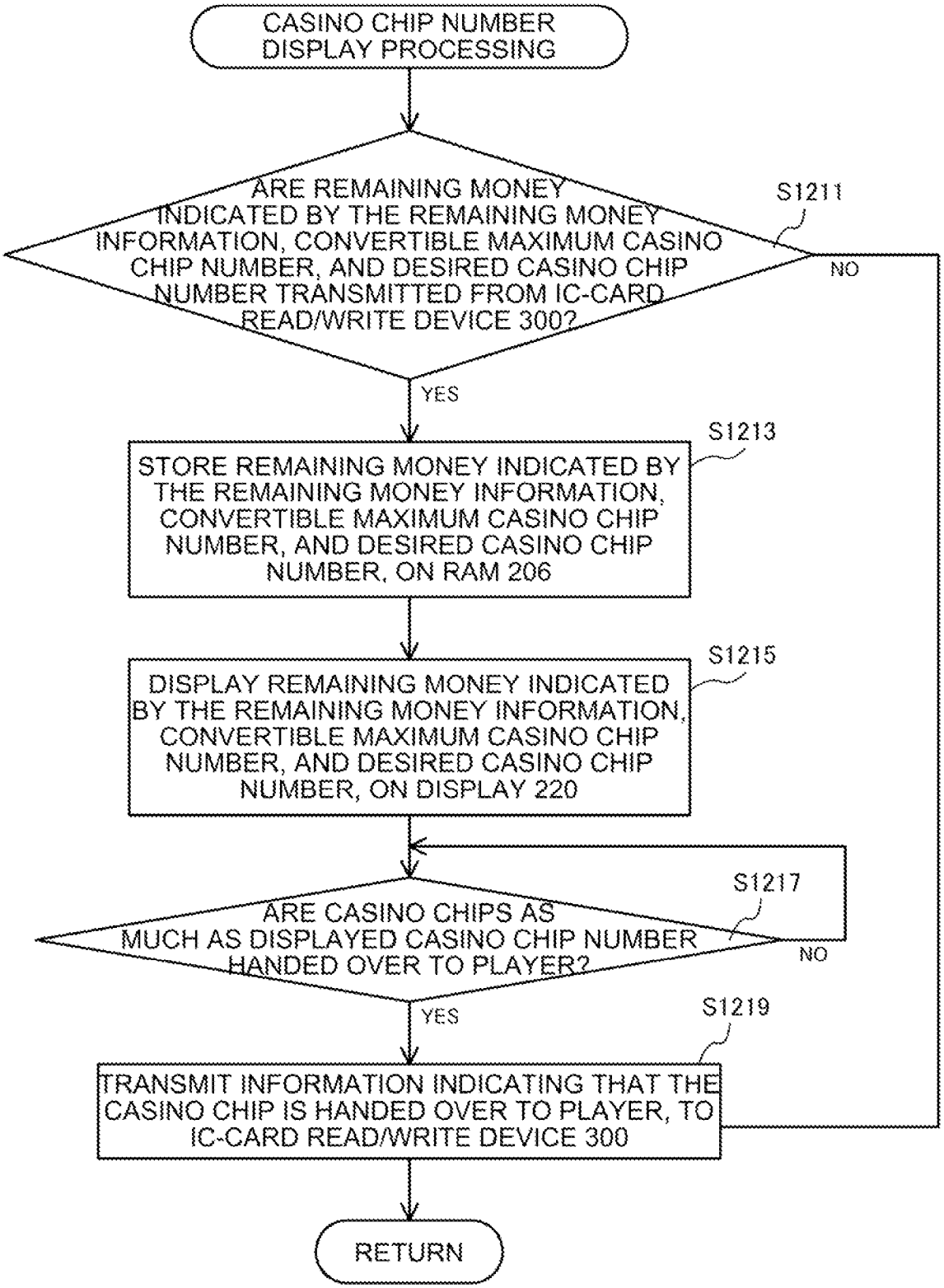
FIG. 12 is a flowchart depicting processing for displaying the casino chip number transmitted from an IC-card read/write device 300 on a display 220 connected to a game management device 200.

FIG. 12 is a flowchart depicting processing for displaying the casino chip number transmitted from the IC-card read/write device 300 on the display 220 connected to the game management device 200. A subroutine depicted in this FIG. 12 is executed by the CPU 202 of the game management device 200.

Firstly, it is determined whether information indicating the remaining money indicated by the remaining money information, the convertable maximum casino chip number, and the casino chip number input by the player is transmitted from the IC-card read/write device 300 (step S1211). Upon determining that the information indicating the remaining money indicated by the remaining money information, the convertable maximum casino chip number, and the casino chip number input by the player is not transmitted from the IC-card read/write device 300 (NO), the subroutine is immediately ended.

On the other hand, upon determining that the information indicating the remaining money indicated by the remaining money information, the convertable maximum casino chip number, and the casino chip number input by the player is transmitted from the IC-card read/write device 300 (YES), the information indicating the remaining money indicated by the remaining money information, the convertable maximum casino chip number, and the casino chip number input by the player is stored on the RAM 206 (step S1213), and these information are displayed on the display 220 connected to the game management device 200 (step S1215).

In this way, when the remaining money indicated by the remaining money information, and the convertable maximum casino chip number are displayed on the display 220, the dealer becomes able to know the remaining money and the maximum casino chip number that can be converted. Moreover, when the information indicating the casino chip number input by the player is displayed on the display 220, the dealer becomes able to visually confirm the casino chip number desired by the player. Further, the dealer is also able to visually confirm whether the casino chip number desired by the player exceeds the maximum casino chip number, and thus, the dealer is able to determine whether the change to the casino chip is appropriate.

When the casino chip number desired by the player is visually confirmed in this way, the dealer hands over the casino chips as much as the displayed casino chip number, to the player. Subsequently, when the dealer hands over the casino chips as much as the casino chip number displayed to the player, the dealer manipulates the keyboard 230 so as to input information indicating that the casino chip has been handed over to the player.

After the execution of the processing in the aforementioned step S1215, it is determined whether information indicating that the keyboard 230 is manipulated by the dealer and the casino chip is handed over to the player is input (step S1217). Upon determining that the information indicating that the casino chip is handed over to the player is not input (NO), the process returns to step S1217.

On the other hand, upon determining that the information indicating that the casino chip is handed over to the player is input (YES), the information indicating that the casino chip is handed over to the player is transmitted to the IC-card read/write device 300 (step S1219). Then, the subroutine is ended.

The aforementioned example provides the case where the dealer hands over the casino chip to the player; however, the following is also possible: a casino-chip payout device (not shown) is arranged, the remaining money indicated by the remaining money information, the convertible maximum casino chip number, and the casino chip number desired by the player are displayed on the display 220 in the processing in step S1215, and when the dealer confirms that, according to the manipulation of the dealer, the casino chips as much as the casino chip number desired by the player are paid out from the casino-chip payout device.

<<IC Card Remaining Money Information Update Processing>>

Figure 13:
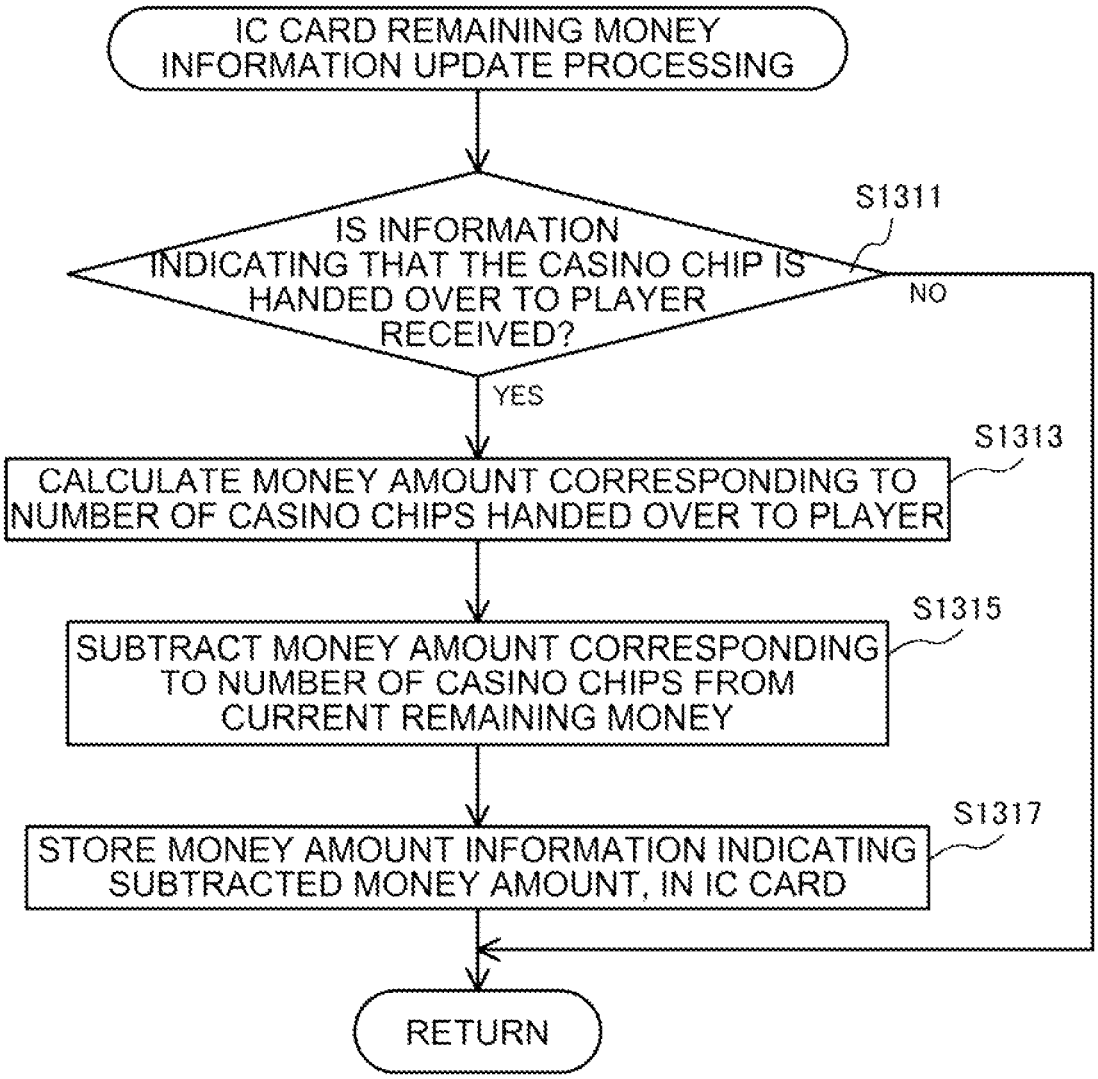
FIG. 13 is a flowchart depicting processing in which information indicating that the casino chip is handed over to a player is received from the game management device 200 and the remaining money information in the IC card is updated.

FIG. 13 is a flowchart depicting processing in which the information indicating that the casino chip is handed over to the player is received from the game management device 200 and the remaining money information in the IC card is updated. A subroutine depicted in this FIG. 13 is executed by the CPU 302 of the IC-card read/write device 300.

Firstly, it is determined whether the information indicating that the casino chip is handed over to the player is transmitted from the game management device 200 (step S1311). Upon determining that the information indicating that the casino chip is handed over to the player is not transmitted from the game management device 200 (NO), the subroutine is immediately ended.

On the other hand, upon determining that the information indicating that the casino chip is handed over to the player is transmitted from the game management device 200 (YES), a money amount corresponding to the number of casino chips (casino chip number) is calculated to the player (step S1313). The correspondence relationship between the number of casino chips and the money amount is previously defined, and thus, by referring to the correspondence relationship, the money amount corresponding to the number of casino chips can be calculated.

Subsequently, from the money amount indicated by the remaining money information currently stored in the IC chip of the IC card, the money amount calculated in step S1313 is subtracted (step S1315). The money amount information indicating the subtracted money amount is written, as the remaining money information, into the IC chip of the IC card (step S1317). Then, the subroutine is ended.

As a result of the execution of the processing in the aforementioned FIG. 11 to FIG. 13, it becomes possible to convert into the casino chips as much as the number desired by the player by using the IC card possessed by the player, and when the casino chip is converted, the remaining money information in the IC card can be updated by as much as that number. In this way, as long as the cash is previously injected into a conversion machine installed at a predetermined location in the casino and the money amount information indicating the injected money amount is stored in the IC card, the player becomes able to play the game in the casino as long as the player possesses the IC card only without a need of carrying the cash in the casino.

<<Point Number Transmission Processing>>

Figure 14:
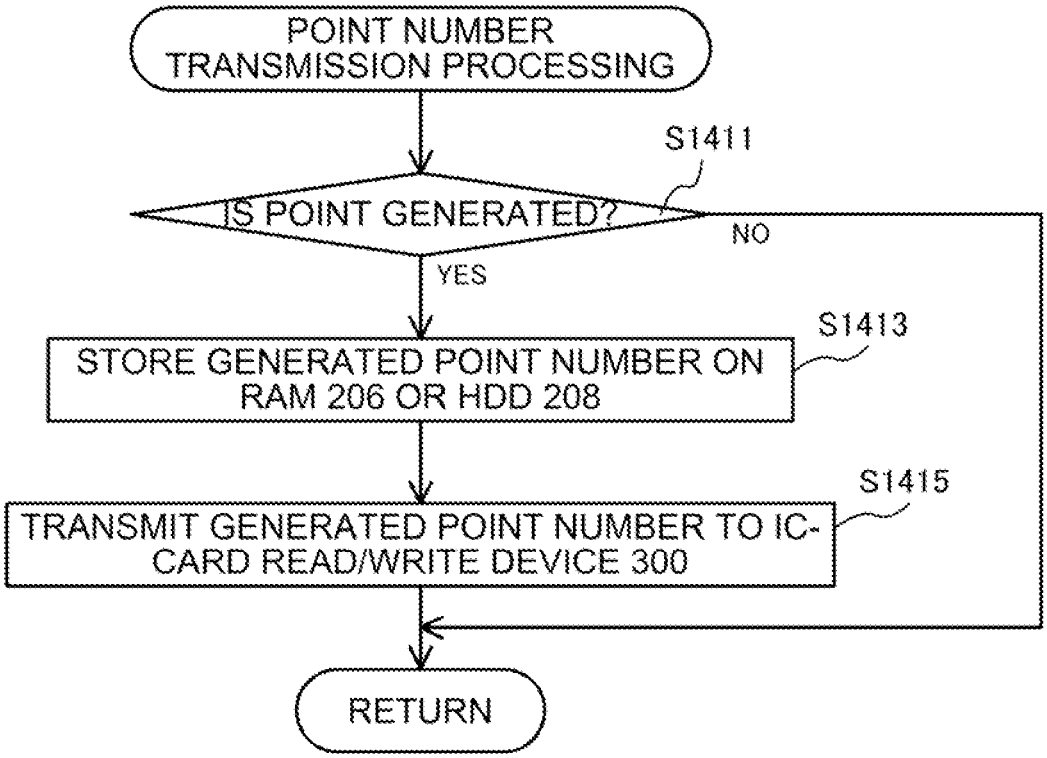
FIG. 14 is a flowchart depicting processing for updating the remaining money information in the IC card by redeeming a point, which is generated when a predetermined condition is satisfied if the player continuously plays the game, to the player.

FIG. 14 is a flowchart depicting processing for updating the remaining money information in the IC card by redeeming a point, which is generated when a predetermined condition is satisfied if the player continuously plays the game, to the player. A subroutine depicted in this FIG. 14 is executed by the CPU 202 of the game management device 200.

Firstly, it is determined whether the point is generated as a result of the predetermined condition being satisfied (step S1411). Examples of a condition for generating the point includes the number of times that the game is played and the money amount (number of casino chips) to be bet. For example, the point can be generated at each play, or the points of which the number corresponds to the number of bet casino chips. The condition for generating the point is not limited thereto, and any condition managed by the game management device 200 may suffice.

Upon determining that the point is not generated in the determination processing in step S1411 (NO), the subroutine is immediately ended. On the other hand, upon determining that the point is generated (YES), the generated point number is stored on the RAM 206 or the HDD 208 (step S1413), the generated point number is transmitted to the IC-card read/write device 300 (step S1415), and then, the subroutine is ended.

<<Processing for Updating by as Much as Point Number>>

Figure 15:
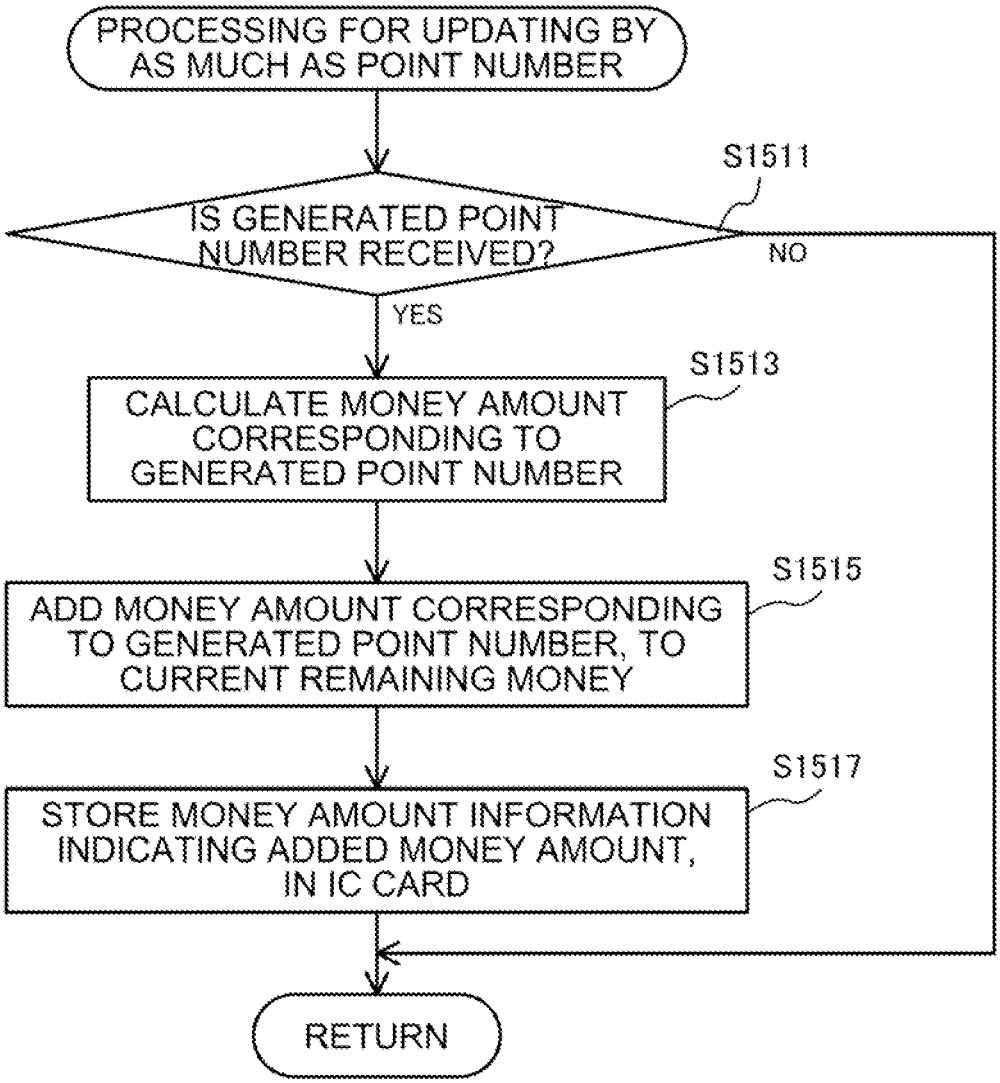
FIG. 15 is a flowchart depicting processing for storing a money amount according to the point number in the IC chip of the IC card in order to redeem a generated point number to the player when the point is generated.

FIG. 15 is a flowchart depicting processing for storing a money amount according to the point number in the IC chip of the IC card in order to redeem a generated point number to the player when the point is generated. A subroutine depicted in this FIG. 15 is executed by the CPU 302 of the IC-card read/write device 300.

Firstly, it is determined whether the generated point number is received from the game management device 200 (step S1511). Upon determining that the generated point number is not received from the game management device 200 (NO), the subroutine is immediately ended.

On the other hand, upon determining that the generated point number is received from the game management device 200 (YES), the money amount corresponding to the generated point number is calculated (step S1513). The correspondence relationship between the point number and the money amount is previously defined, and thus, by referring to the correspondence relationship, the money amount corresponding to the point number can be calculated.

Subsequently, the money amount calculated in step S1513 is added to the money amount indicated by the remaining money information currently stored in the IC chip of the IC card (step S1515). The money amount information indicating the added money amount is written, as the remaining money information, into the IC chip of the IC card (step S1517). Then, the subroutine is ended.

As a result of the processing in the aforementioned FIG. 14 and FIG. 15 being executed, the player continuously plays the game, and then, if the predetermined condition is satisfied, then the point is generated, and the remaining money information of the IC card is updated according to the point. In this way, the generated point can be redeemed to the player as a service provided by the casino to the player. In doing so, the generated point can be easily imparted to the player without a need for the player to carry a member card, etc., and a motivation to continuously play the game can be applied to the player.

<<Cash Conversion Processing>>

Figure 16:
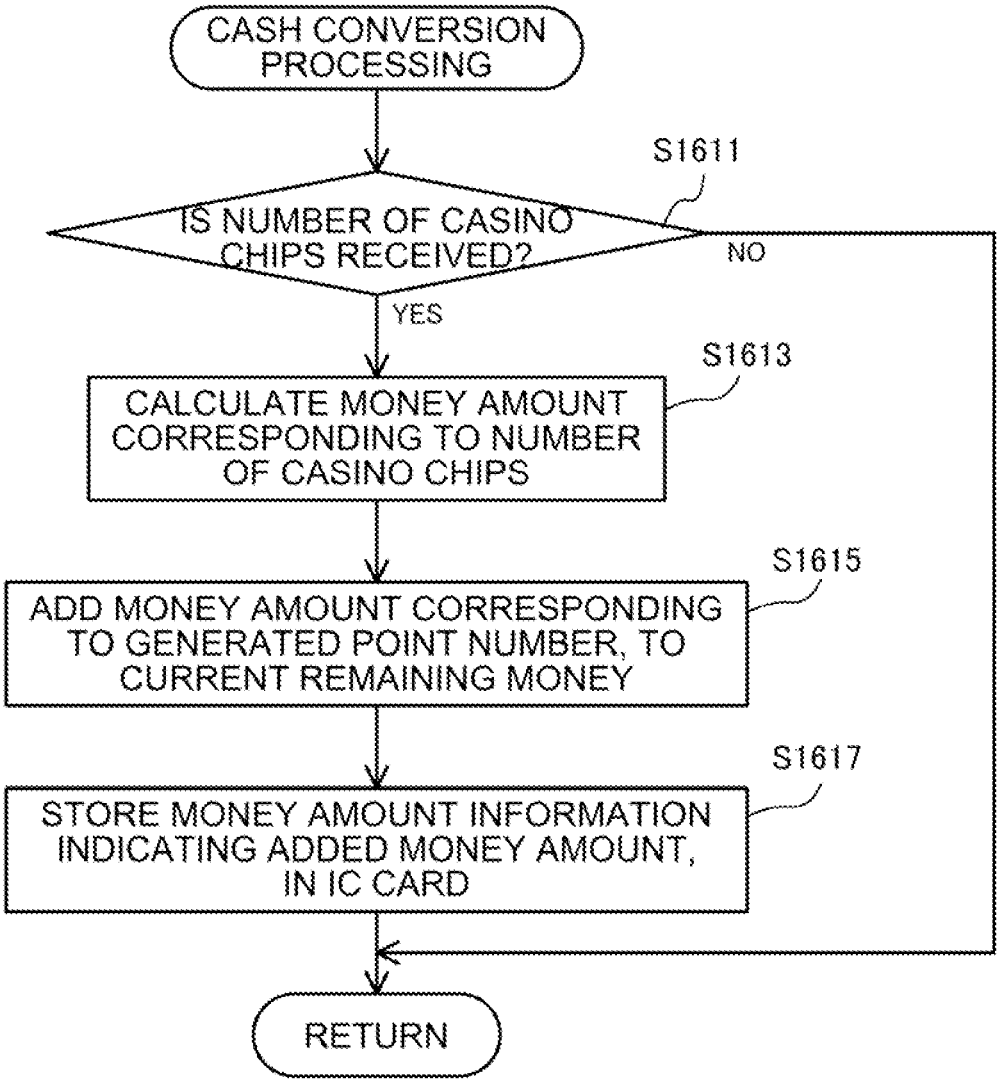
FIG. 16 is a flowchart depicting processing for converting the casino chip possessed by the player into a cash.

FIG. 16 is a flowchart depicting processing for converting the casino chip possessed by the player into the cash. For example, the processing is executed when the player ends the game or when the player moves to another casino table, etc. A subroutine depicted in this FIG. 16 is executed by the CPU 302 of the IC-card read/write device 300.

Firstly, it is determined whether the number of casino chips is received from the game management device 200 (step S1611). Upon determining that the number of casino chips is not received from the game management device 200 (NO), the subroutine is immediately ended.

The number of casino chips transmitted from the game management device 200 may be counted by a predetermined counting device (not shown) or counted by the dealer. Further, the casino-chip read/write device 130 explained in the second embodiment may also be used. The game management device 200 counts the number of casino chips by the signal issued from the casino-chip read/write device 130, and transmits the result to the IC-card read/write device 300. In either way, it suffices if the information indicating the number of counted casino chips can be received from the game management device 200.

Upon determining in the determination processing in step S1611 that the number of casino chips is received from the game management device 200 (YES), the money amount corresponding to the number of received casino chips is calculated (step S1613). The correspondence relationship between the number of casino chips and the money amount is previously defined, and thus, by referring to the correspondence relationship, the money amount corresponding to the number of casino chips can be calculated.

Subsequently, the money amount calculated in step S1613 is added to the money amount indicated by the remaining money information currently stored in the IC chip of the IC card (step S1615). The money amount information indicating the added money amount is written, as the remaining money information, into the IC chip of the IC card (step S1617). Then, the subroutine is ended.

As a result of the processing in the aforementioned FIG. 16 being executed, when the player ends the game or when the player moves to another casino table, the player converts the number of possessed casino chips into the cash information and stores the cash information in the IC card. In this way, all the remaining moneys owned by the player can be stored, as the remaining money information, in the IC card. In doing so, the player becomes able to end the game or move to another casino table only by holding the IC card without a need of carrying the cash, the casino chip, etc.

Fourth Embodiment

Hereinafter, the fourth embodiment will be explained. In the fourth embodiment, when the bill is injected into the bill identification device 140 arranged at a predetermined position on the casino table 100, the money amount of the injected bill, together with a purpose of injecting the bill, is stored and managed. The purpose of injecting the bill is input by the dealer from the keyboard 230 of the game management device 200. Example of the purposes include a purpose of injecting the bill into the bill identification device 140 in order to change the bill to the casino chip or a purpose of injecting the bill as a tip to the dealer.

Figure 17:
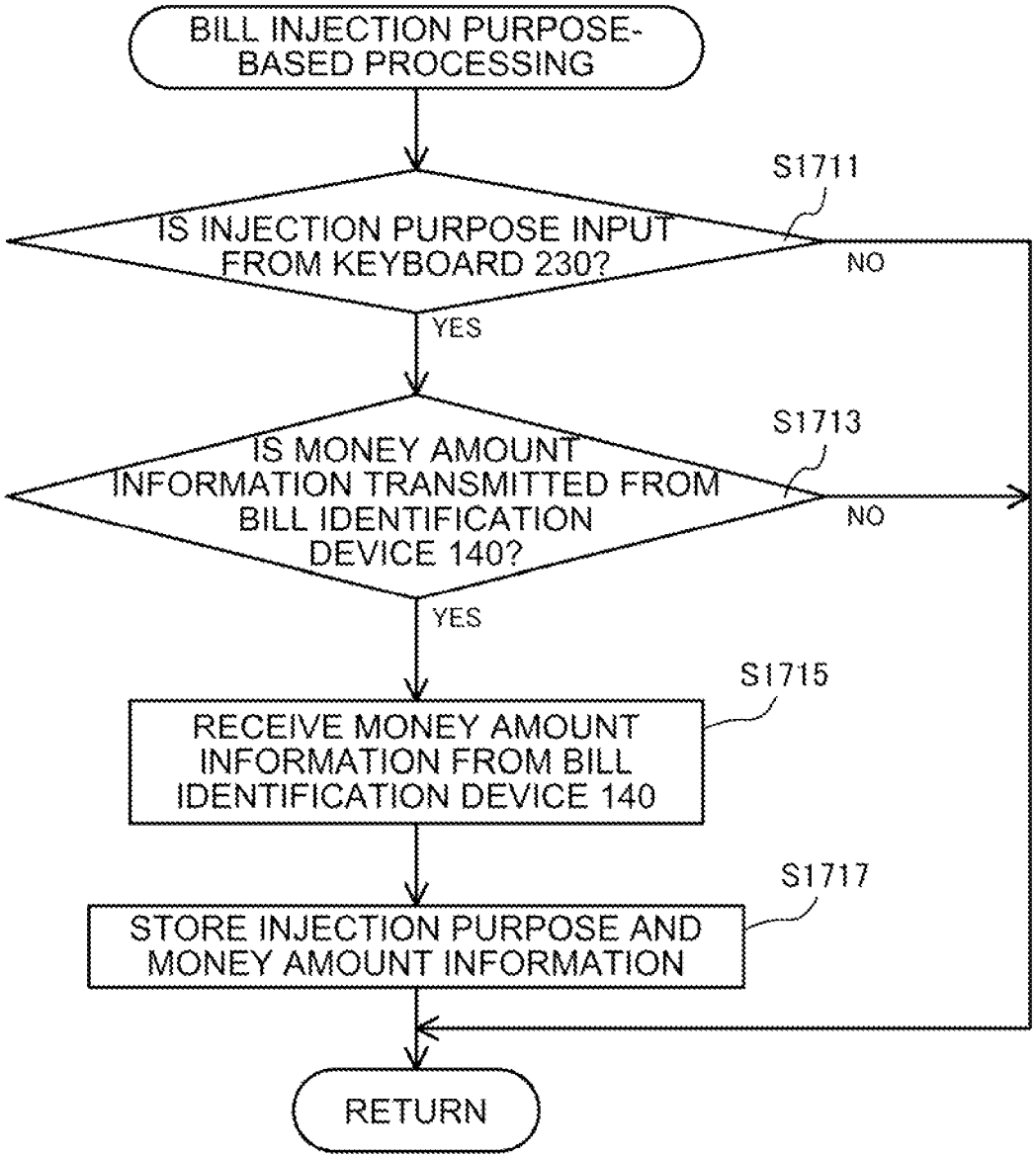
FIG. 17 is a flowchart depicting processing for storing a money amount of an injected bill, together with a purpose of injecting a bill, when the bill is injected into a bill identification device 140.

FIG. 17 is a flowchart depicting processing for storing the money amount of the injected bill, together with the purpose of injecting the bill, when the bill is injected into the bill identification device 140. The processing depicted in this flowchart is executed in the game management device 200.

Firstly, it is determined whether the purpose of injecting the bill is input as a result of the keyboard 230 of the game management device 200 being manipulated by the dealer (step S1711). It is noted that the purpose of injecting the bill is often based on the player' intension, and thus, the player verbally conveys the purpose of injecting the bill to the dealer and then the dealer manipulates the keyboard 230 of the game management device 200.

For example, the game management device 200 displays on the display 220 a selection screen for the purpose of injecting the bill when the money amount information is transmitted from the bill identification device 140. A first item is "for changing to the casino chip", and a second item is "for tip to the dealer". When the dealer, etc., depress "1" on a numerical keypad, an injection purpose of "for changing to the casino chip" is selected, and when the dealer depresses "2" on the numerical keypad, an injection purpose of "for a tip to the dealer" is selected. It is noted that a touch panel function may be arranged on the display 220 so that the dealer manipulates a touch panel unit of the display 220.

Upon determining in the determination processing in step S1711 that the purpose of injecting the bill is not input (NO), the subroutine is immediately ended. On the other hand, upon determining that the purpose of injecting the bill is input (YES), it is determined whether the money amount information is transmitted from the bill identification device 140 (step S1713). The money amount information transmitted from the bill identification device 140 is information indicating the money amount of the bill injected into the bill identification device 140. The bill may be injected into the bill identification device 140 either by the dealer or the player. The bill identification device 140 transmits the money amount information indicating the money amount of the injected bill to the game management device 200 when the bill is injected.

Upon determining in the determination processing in the aforementioned step S1713 that the money amount information is not transmitted from the bill identification device 140 (NO), the subroutine is immediately ended. On the other hand, upon determining that the money amount information is transmitted from the bill identification device 140 (YES), the money amount information transmitted from the bill identification device 140 is received (step S1715), the injection purpose information indicating the injection purpose and the money amount information received in the processing in step S1713 are stored on the HDD 208 or the RAM 206 (step S1717), and then, the subroutine is ended.

In doing so, when the bill is injected by the game management device 200 into the bill identification device 140, the money amount can be managed in a manner to be associated to the purpose of injecting the bill, and the money amount and the injection purpose can be managed in real time. Moreover, the injection purpose information and the money amount information may be transmitted to the management server 400 connected to the game management device 200 for a storage purpose. In doing so, it becomes possible to collectively manage the purposes of injecting the bill and its money amounts in all the bill identification devices 140 installed in the casino.

Further, as a result of the money amount information being received from the bill identification device 140 after the purpose of injecting the bill is input, if the player manipulates the bill identification device 140 without permission of the dealer, then the manipulation is invalidated and the player is prevented from freely manipulating the bill identification device 140.

It is noted that the dealer may input the purpose of injecting the bill after the money amount information issued from the bill identification device 140 is received. In doing so, the money amount of the bill injected by the player can be firstly finalized when the player is allowed to manipulate the bill identification device 140, thus serving to improve the task efficiency without a need of wasting the manipulation for the dealer to input the injection purpose.

Fifth Embodiment

Hereinafter, the fifth embodiment will be explained. In the fifth embodiment, the trajectory data of the card placed on the game surface 110 of the casino table 100 is produced, and in particular, the card placed on the game surface 110 of the casino table 100 is detected and its position is acquired. For example, when the processing in steps S617 to S623 of the subroutine depicted in FIG. 6 is replaced by a subroutine depicted in FIG. 18, the trajectory data can be produced by using the imaged data obtained by imaging the game surface 110 of the casino table 100 by the camera 120.

Figure 18:
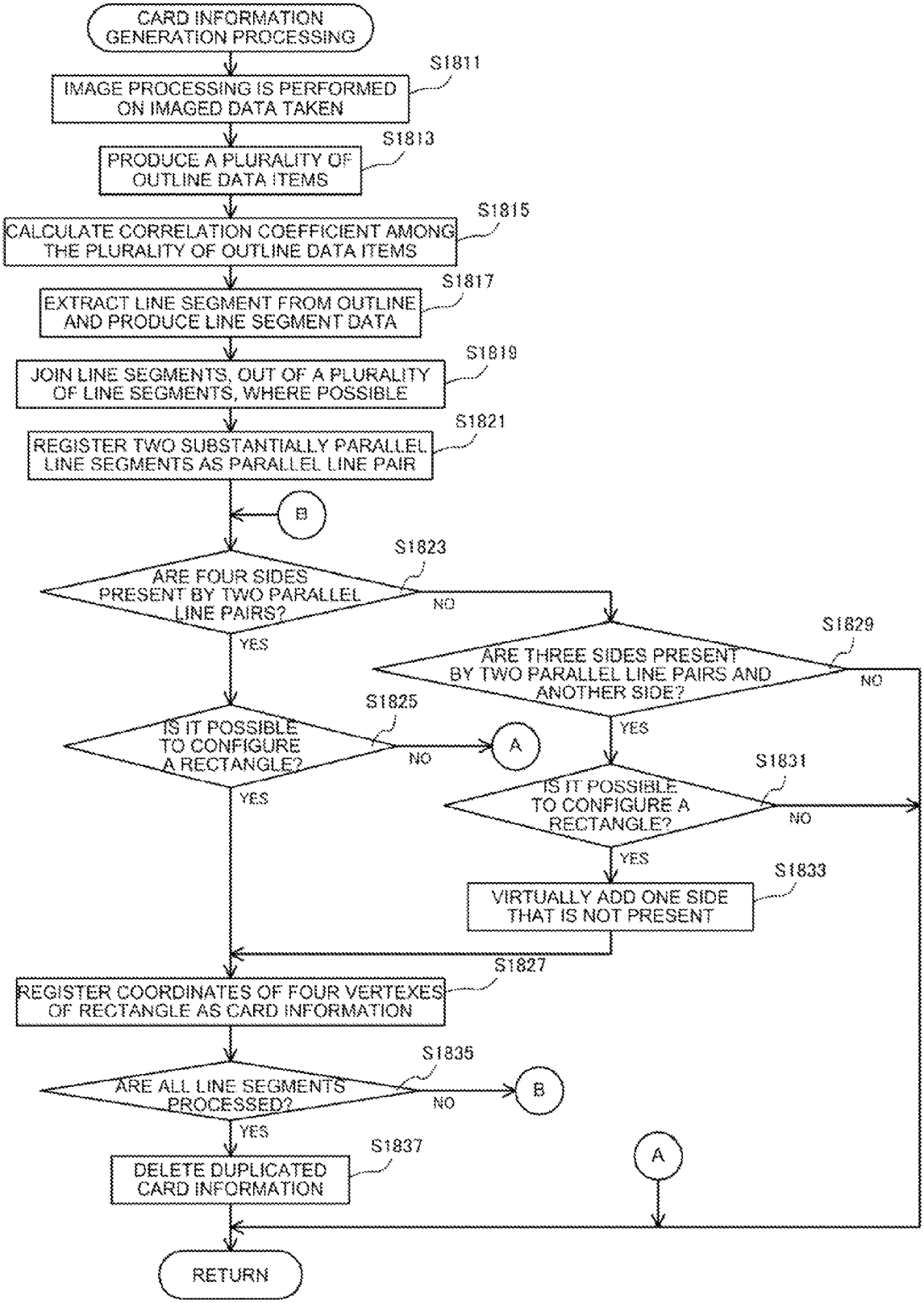
FIG. 18 is a flowchart depicting processing for registering and producing card information of the card placed on the casino table 100.
Figure 19:
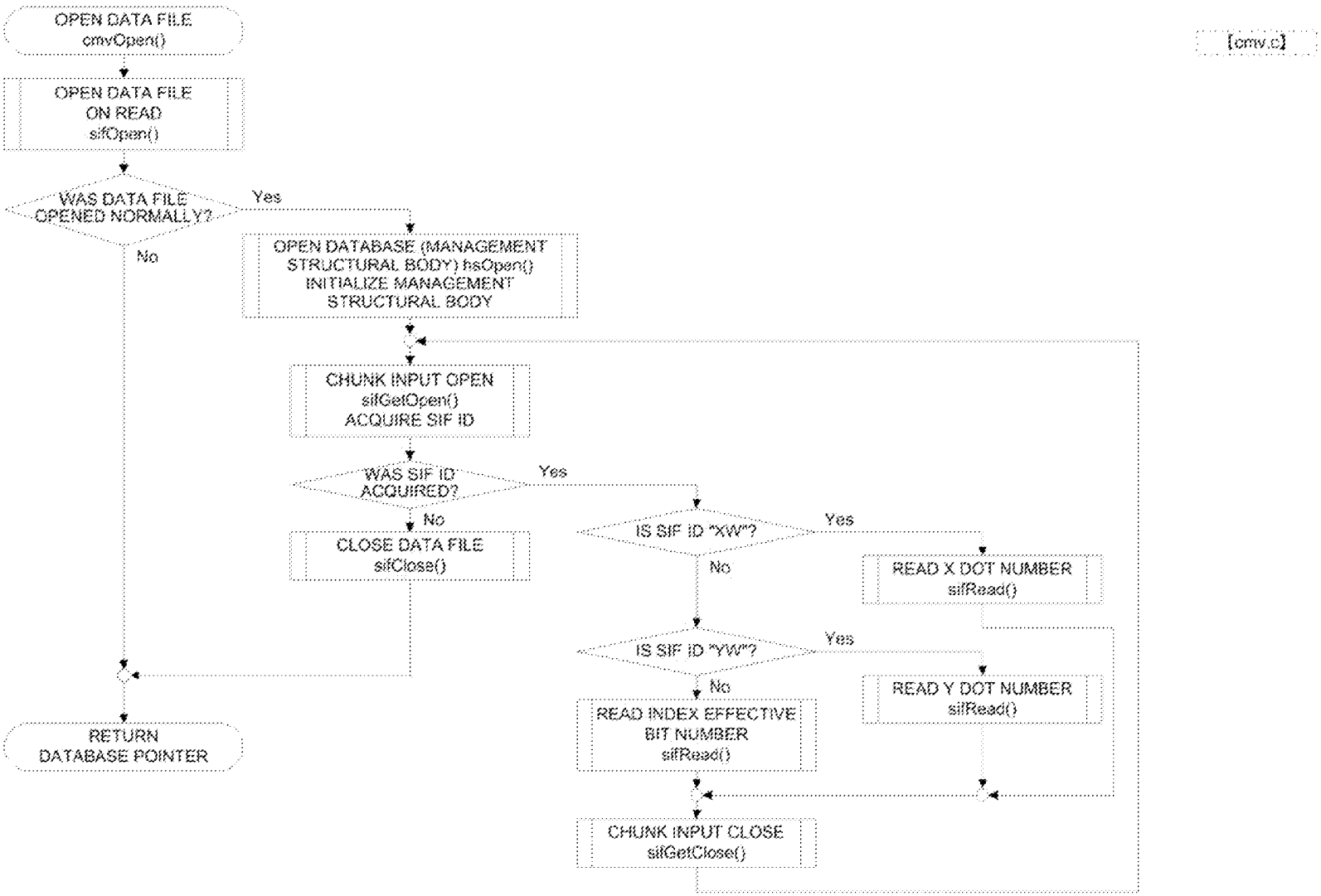
FIG. 19 is a flowchart depicting a subroutine for opening a data file.
Figure 20:
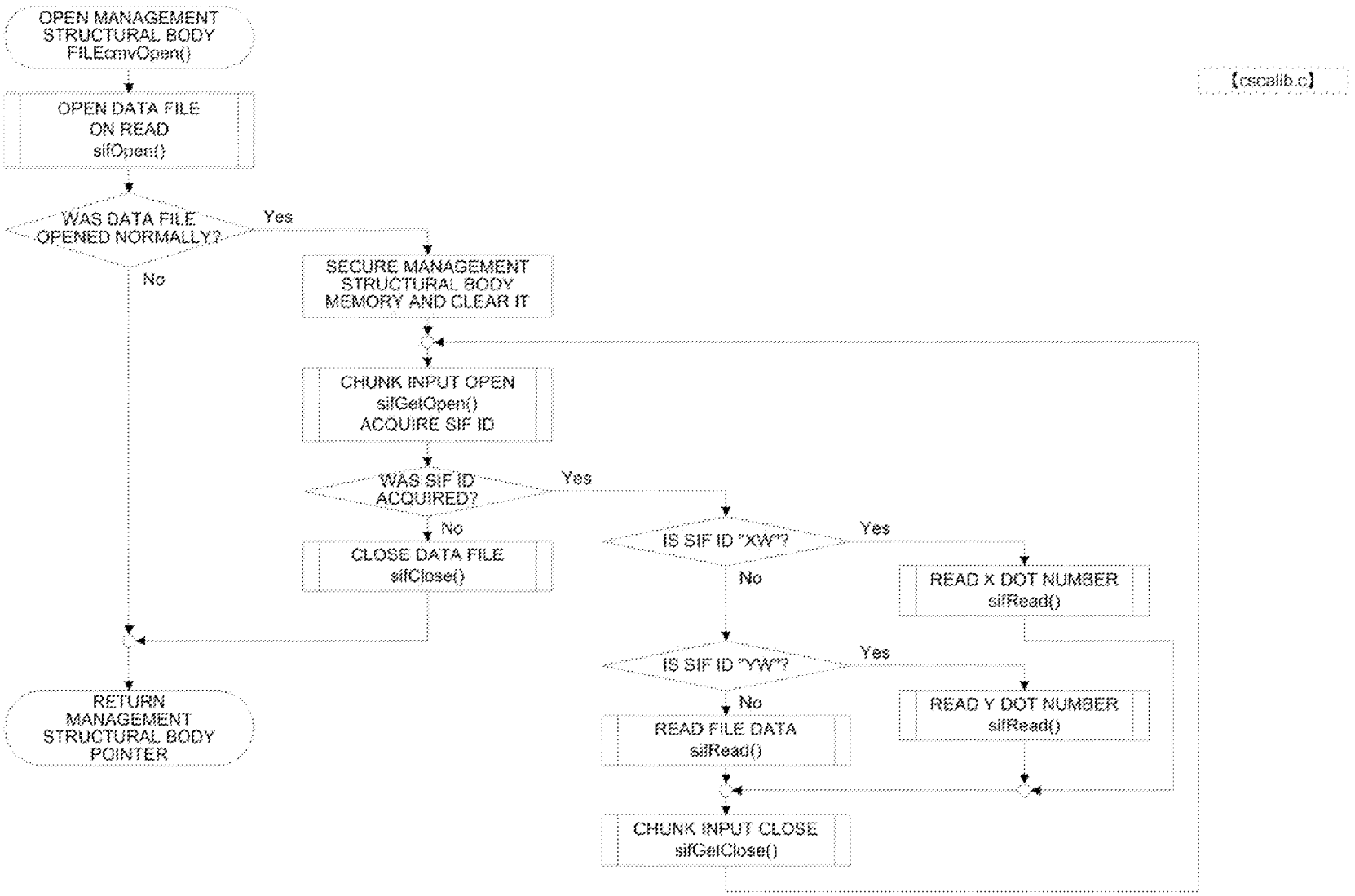
FIG. 20 is a flowchart depicting a subroutine for opening a management structural body file.
Figure 21:
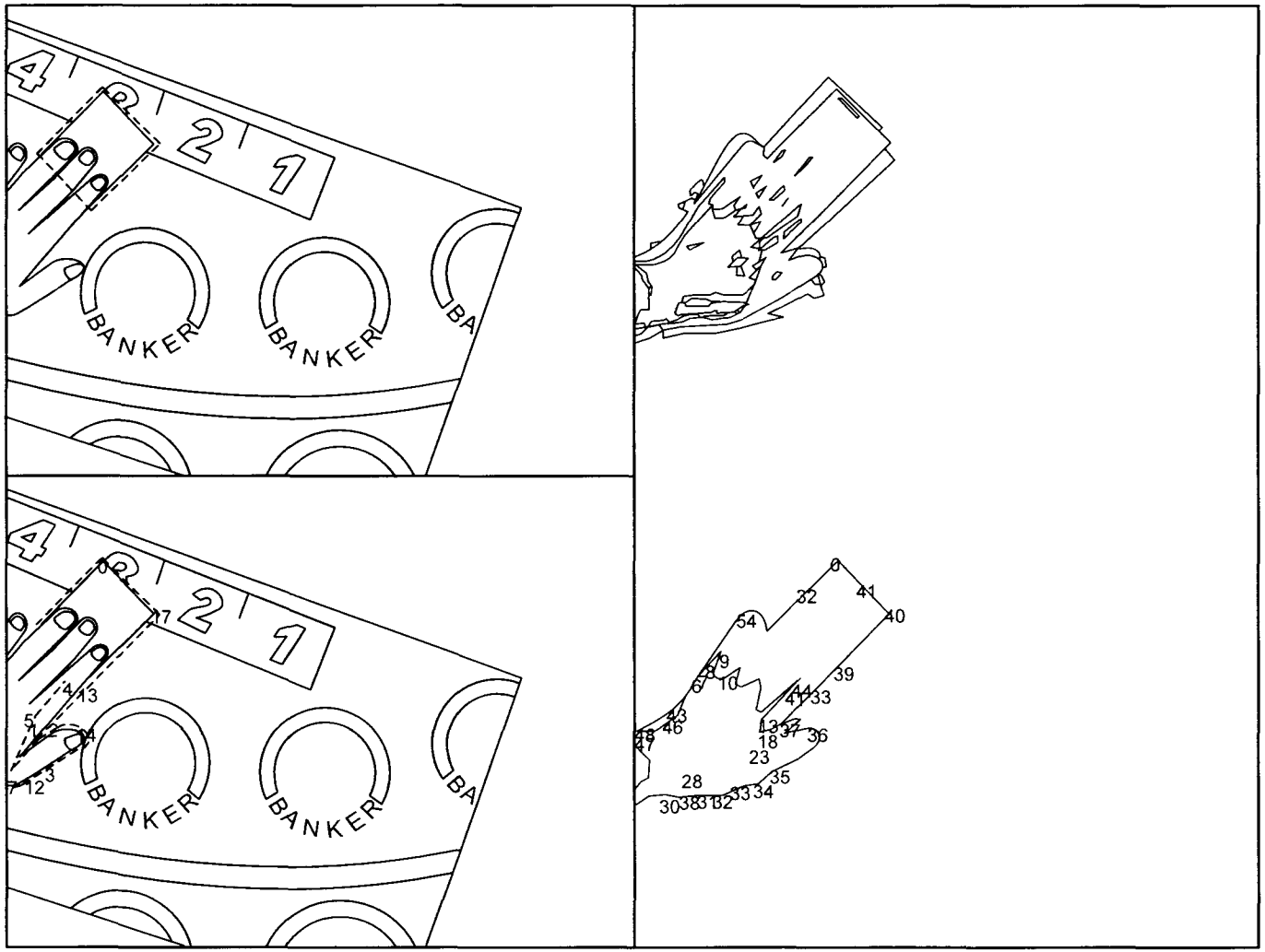
FIG. 21 is a screen depicting one example of an image producing the card information.
Figure 22:
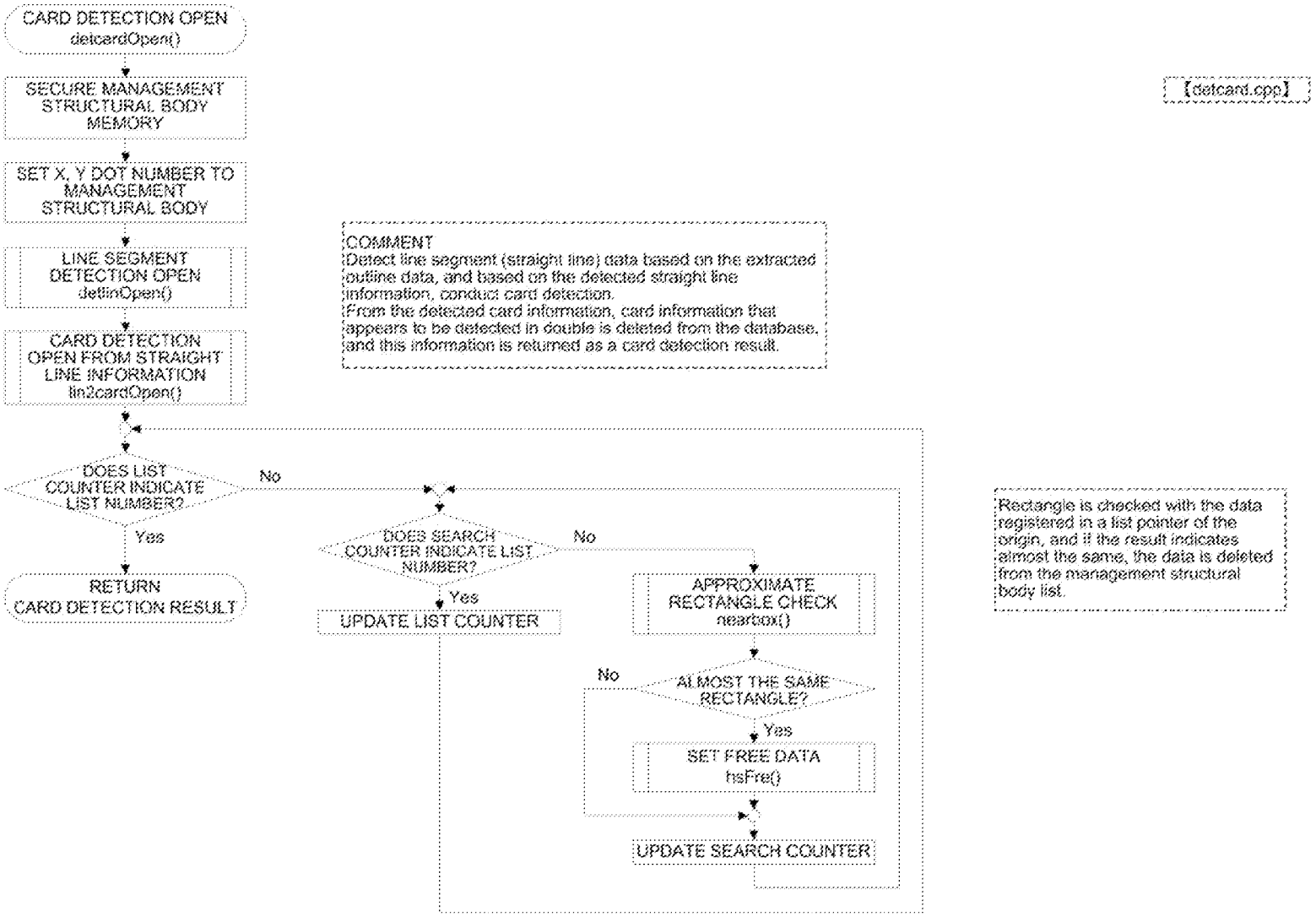
FIG. 22 is a flowchart depicting a subroutine of processing for a card detect open.
Figure 23A:
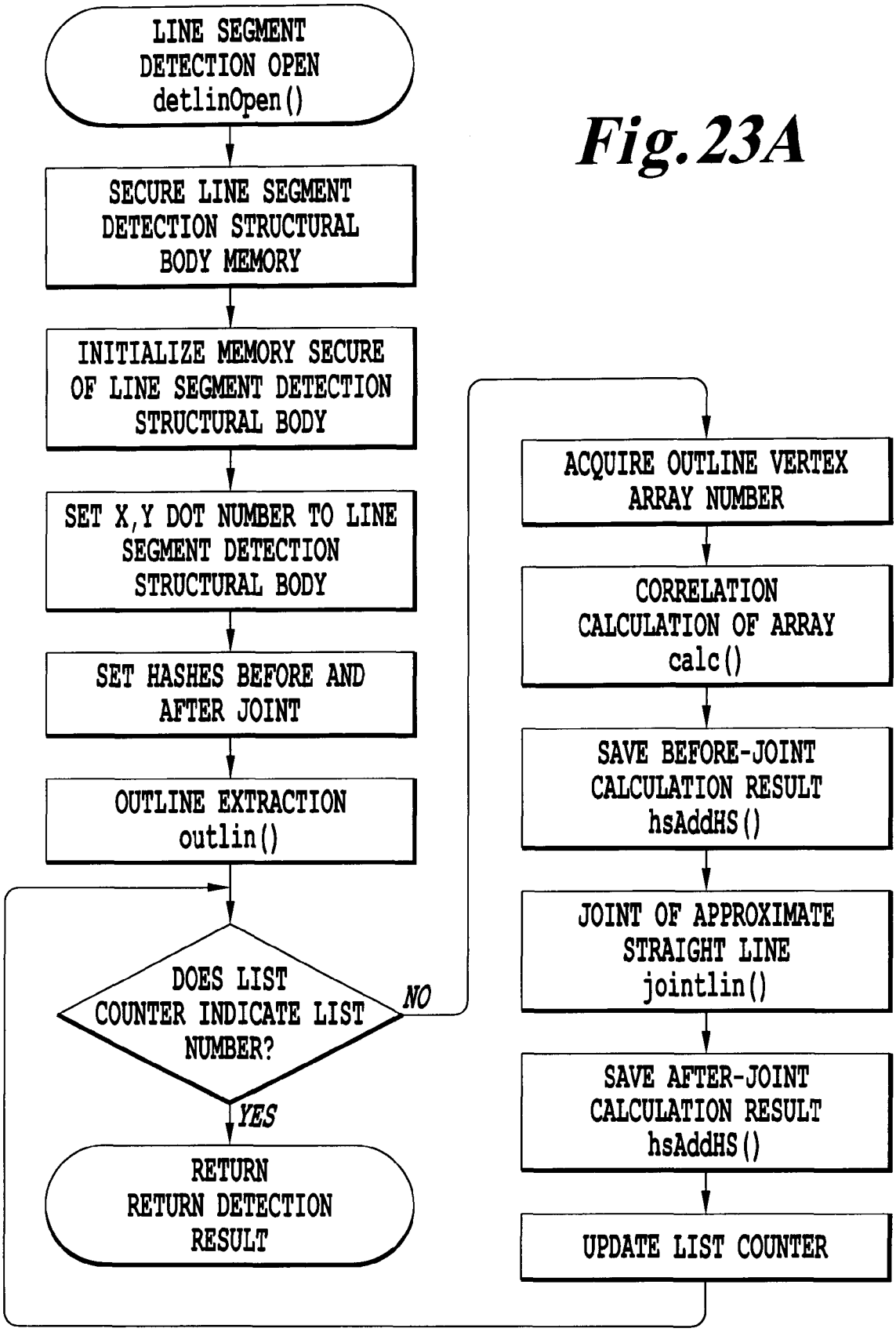
FIG. 23 is a flowchart depicting subroutines of processing for a line segment detect open and processing for evaluating an intervening variable of a line segment.
Figures 23B, 23C:
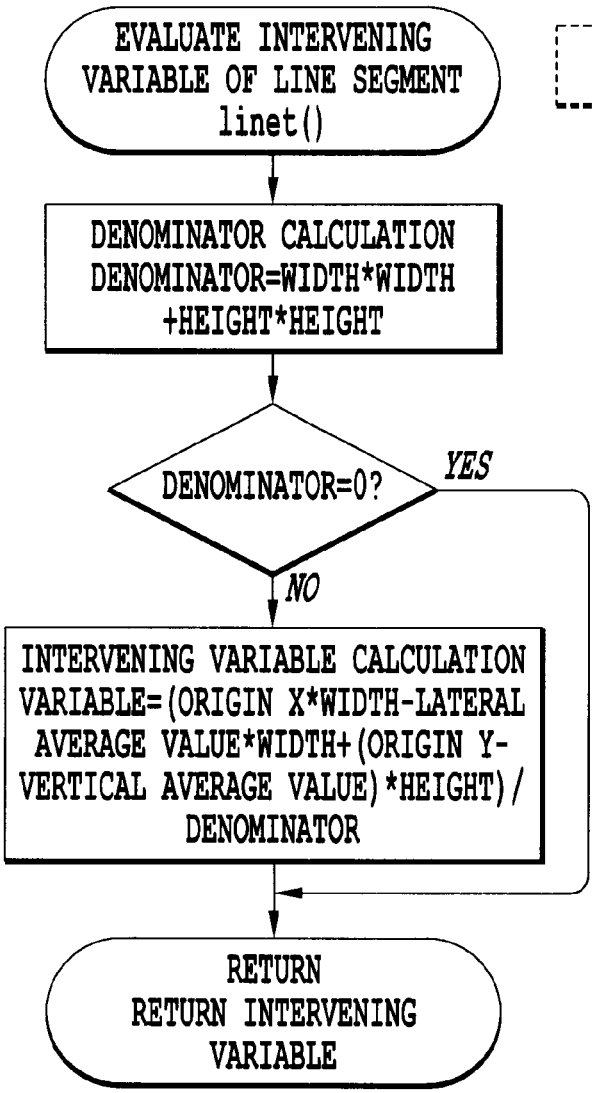
Figure 24A:
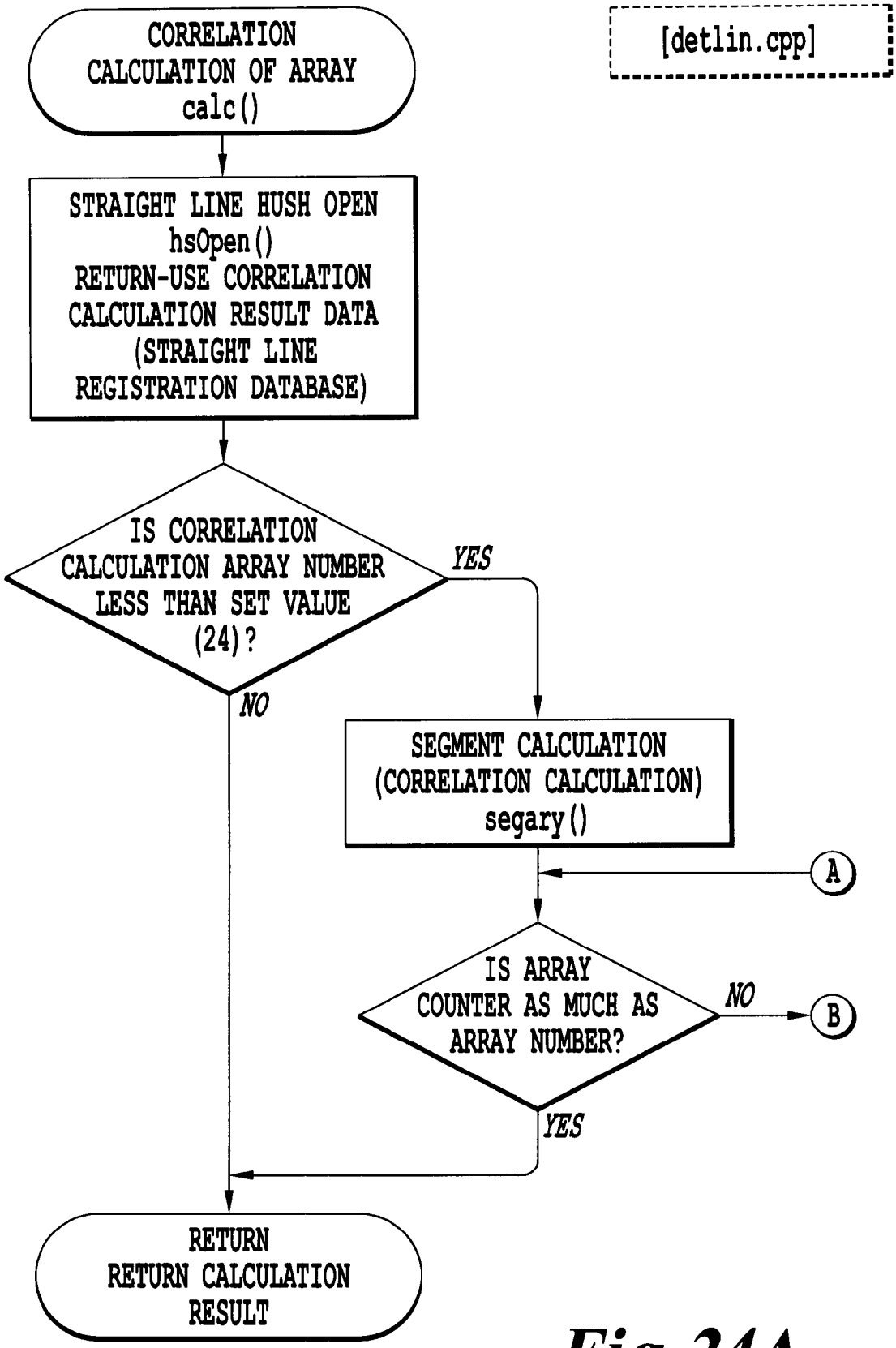
FIG. 24 is a flowchart depicting a subroutine of processing for an alignment correlated calculation.
Figure 24B:
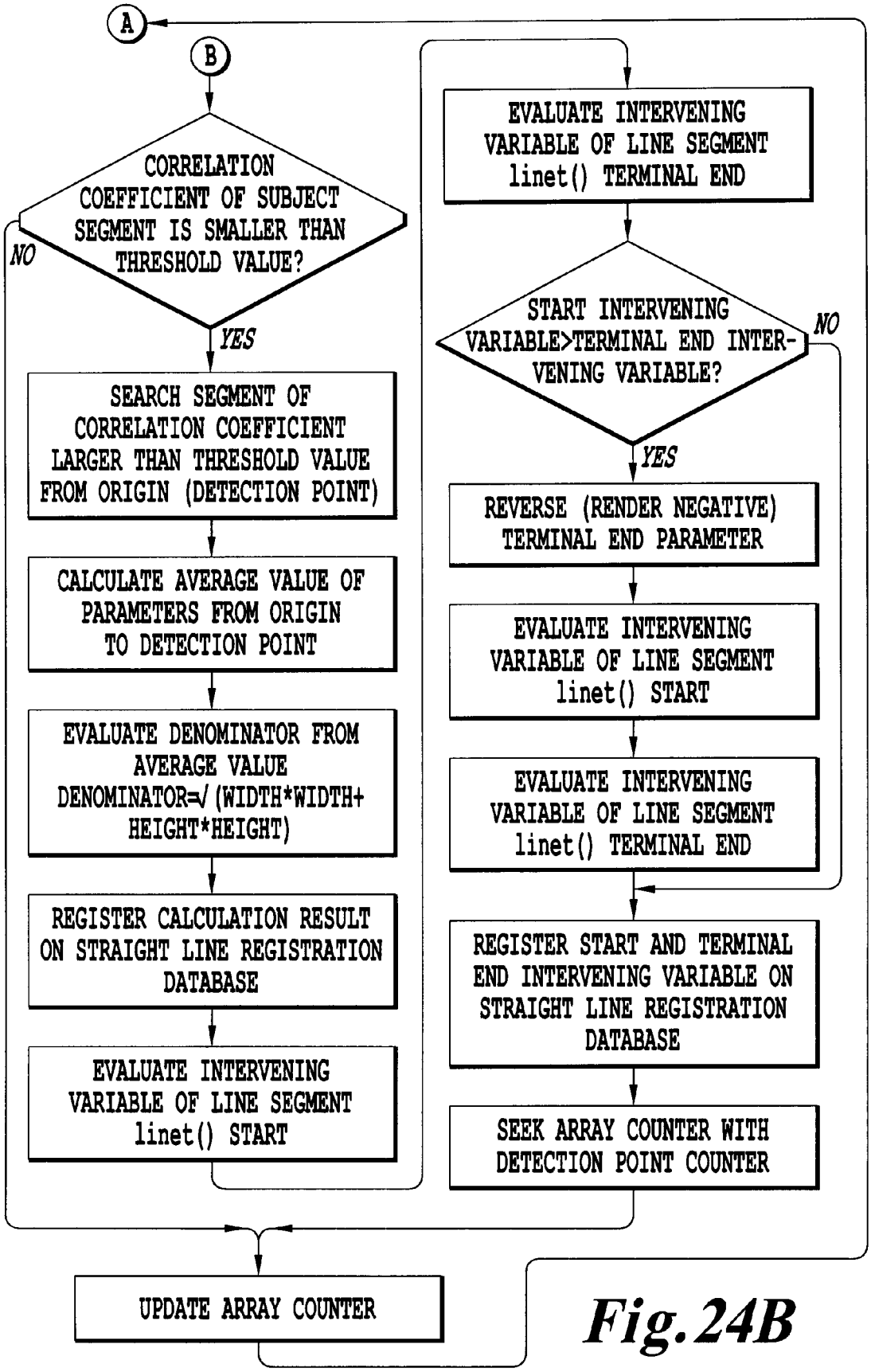
Figure 25A:
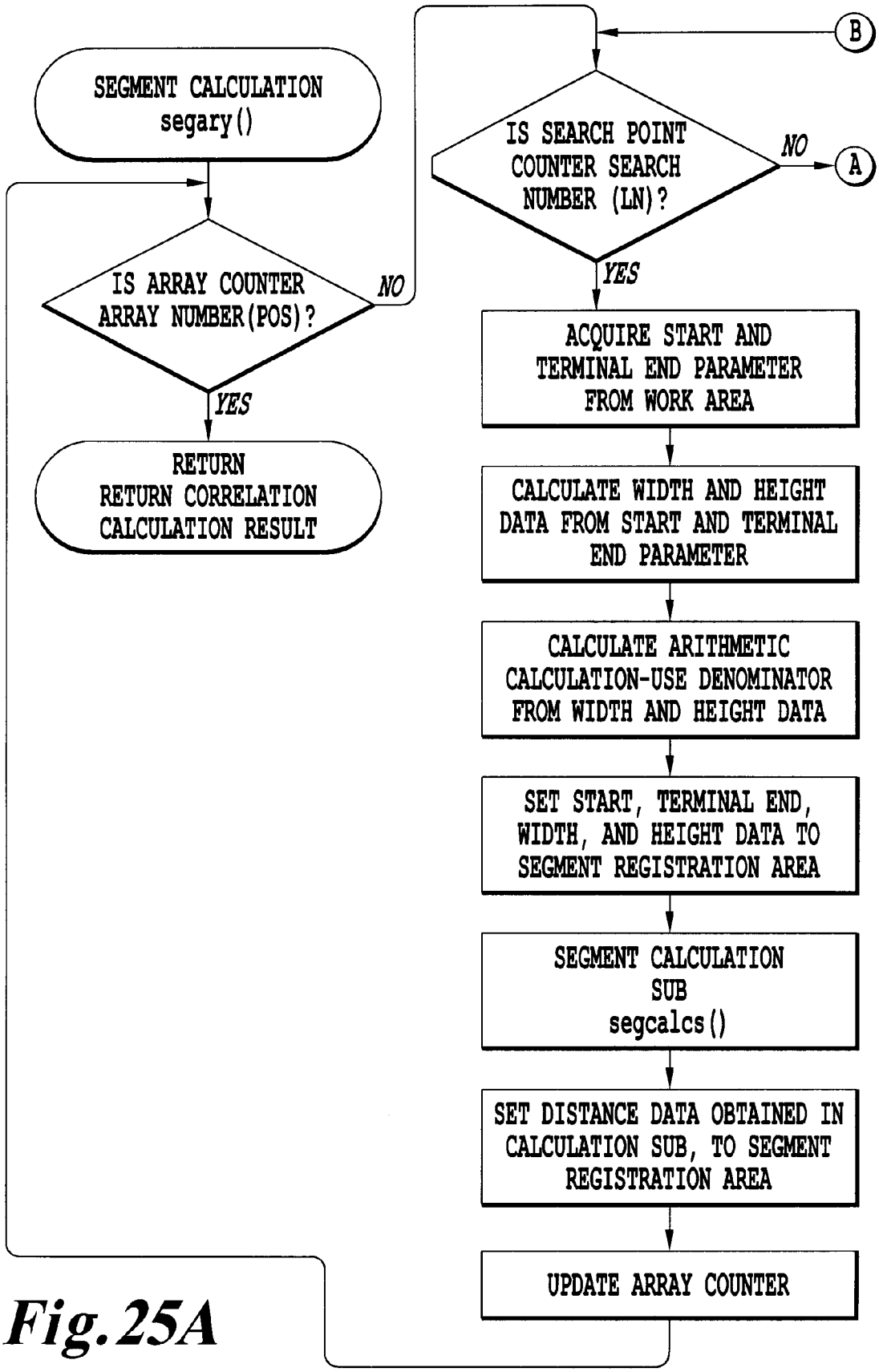
FIG. 25 is a flowchart depicting subroutines of processing for segment calculation and processing for segment calculation sub.
Figure 25B:
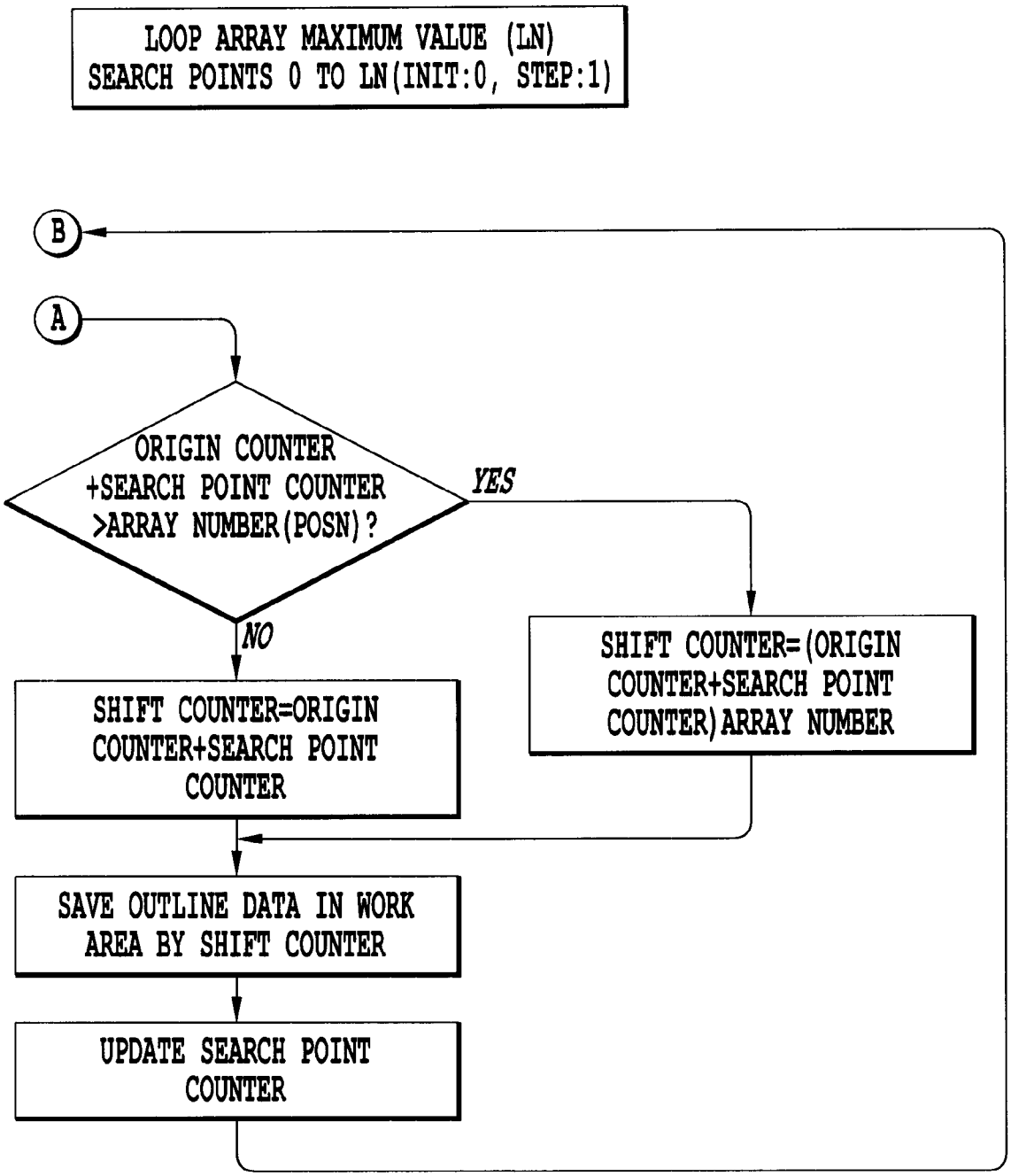
Figure 25C:
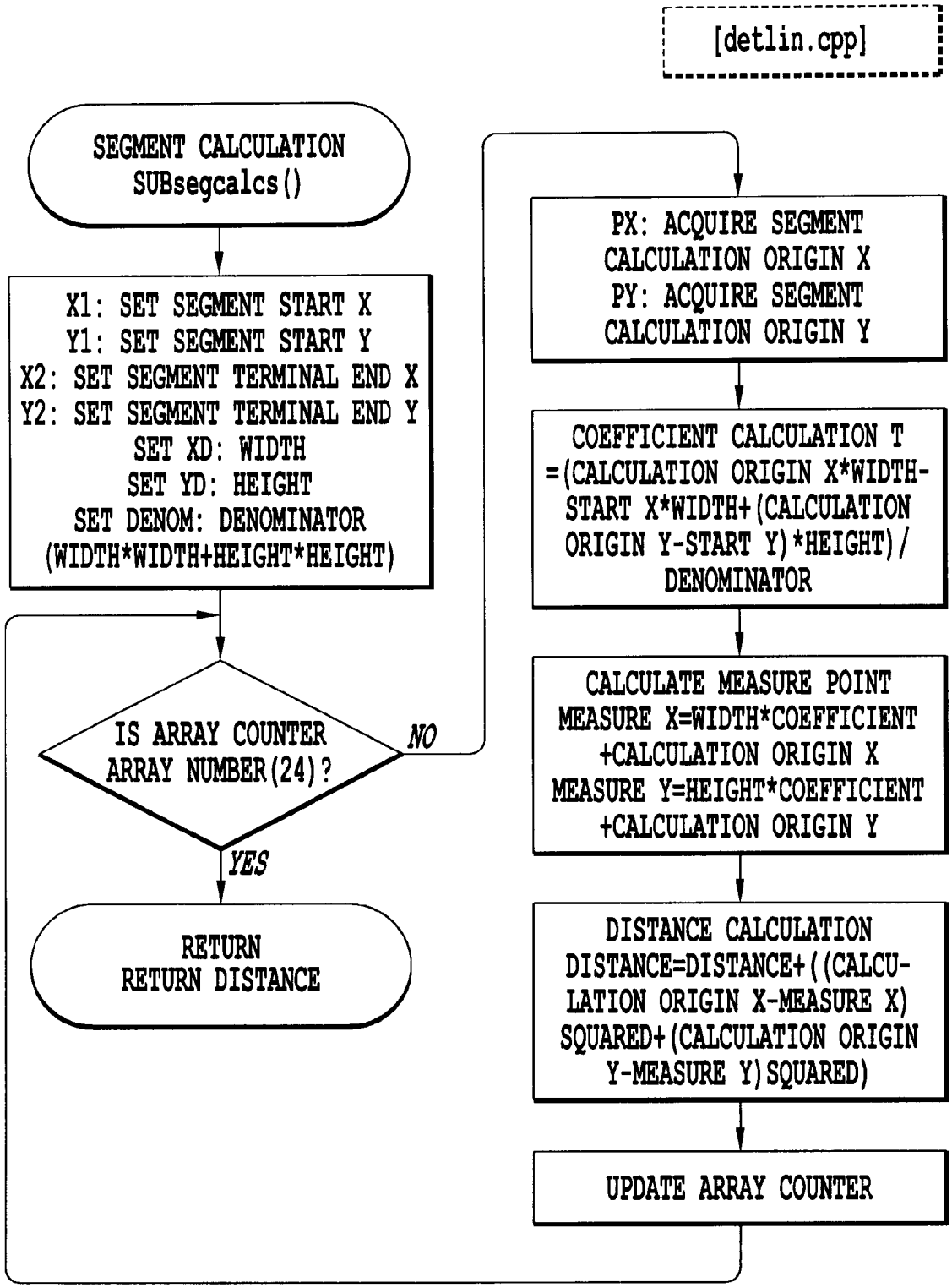
Figure 26A:
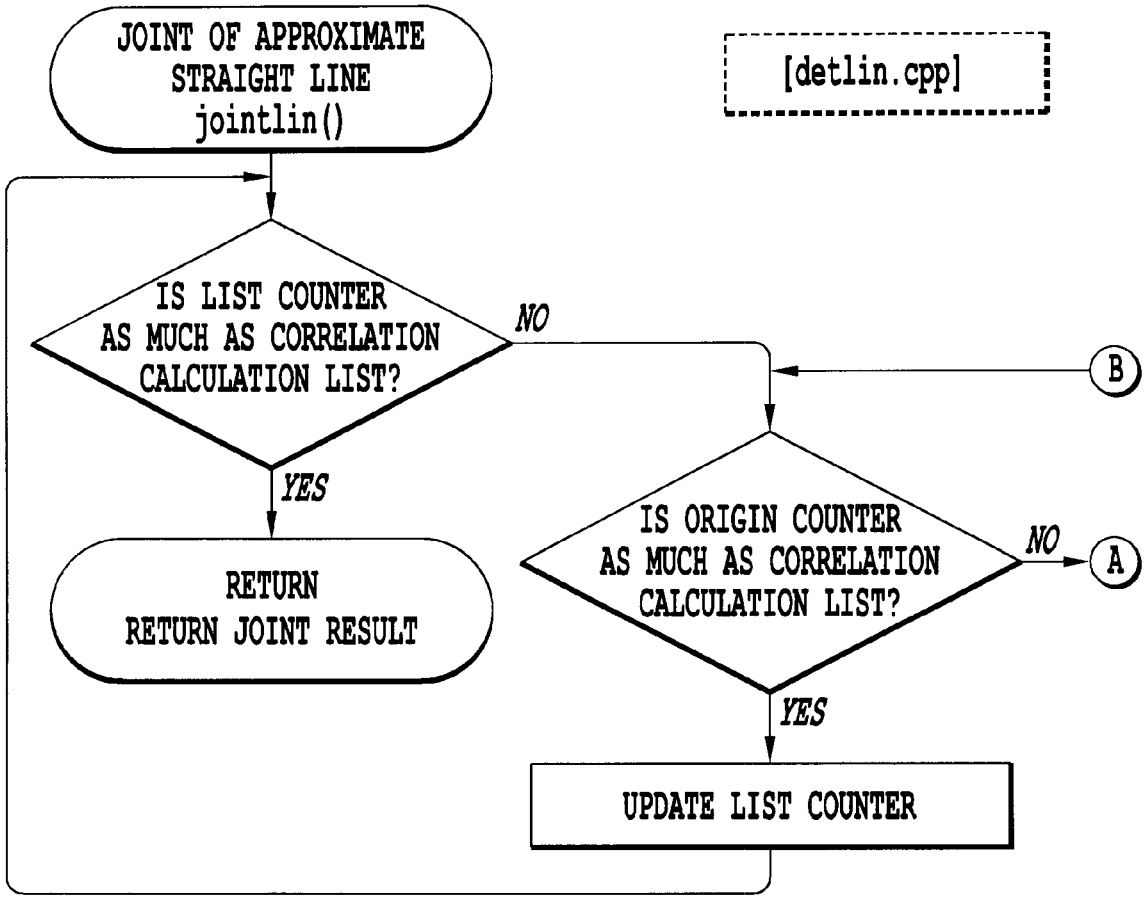
FIG. 26 is a flowchart depicting a subroutine of processing for a joint of approximate straight lines.
Figure 26C:
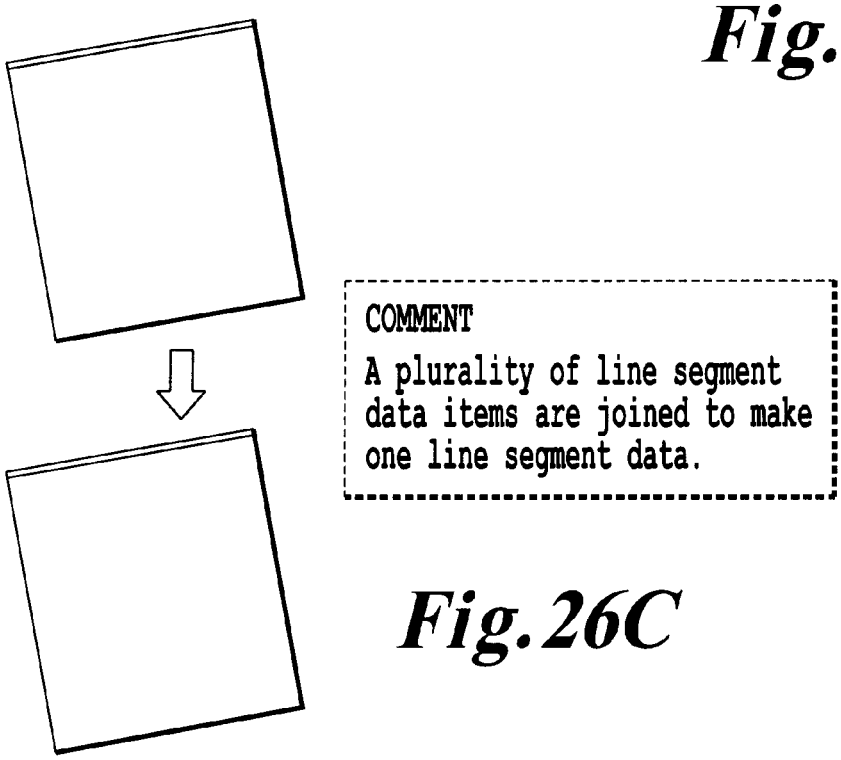
Figure 26B:
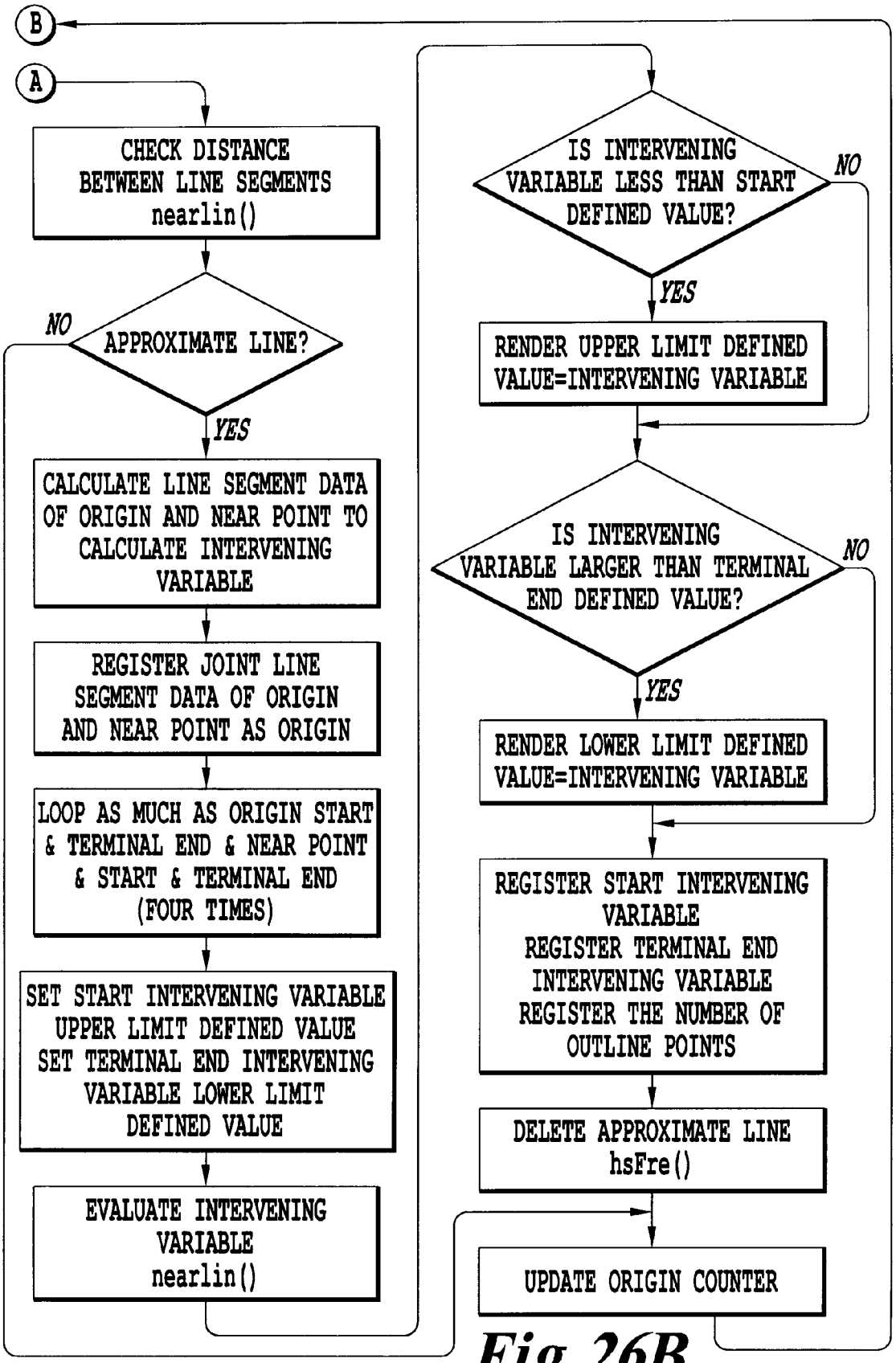
Figure 27A:
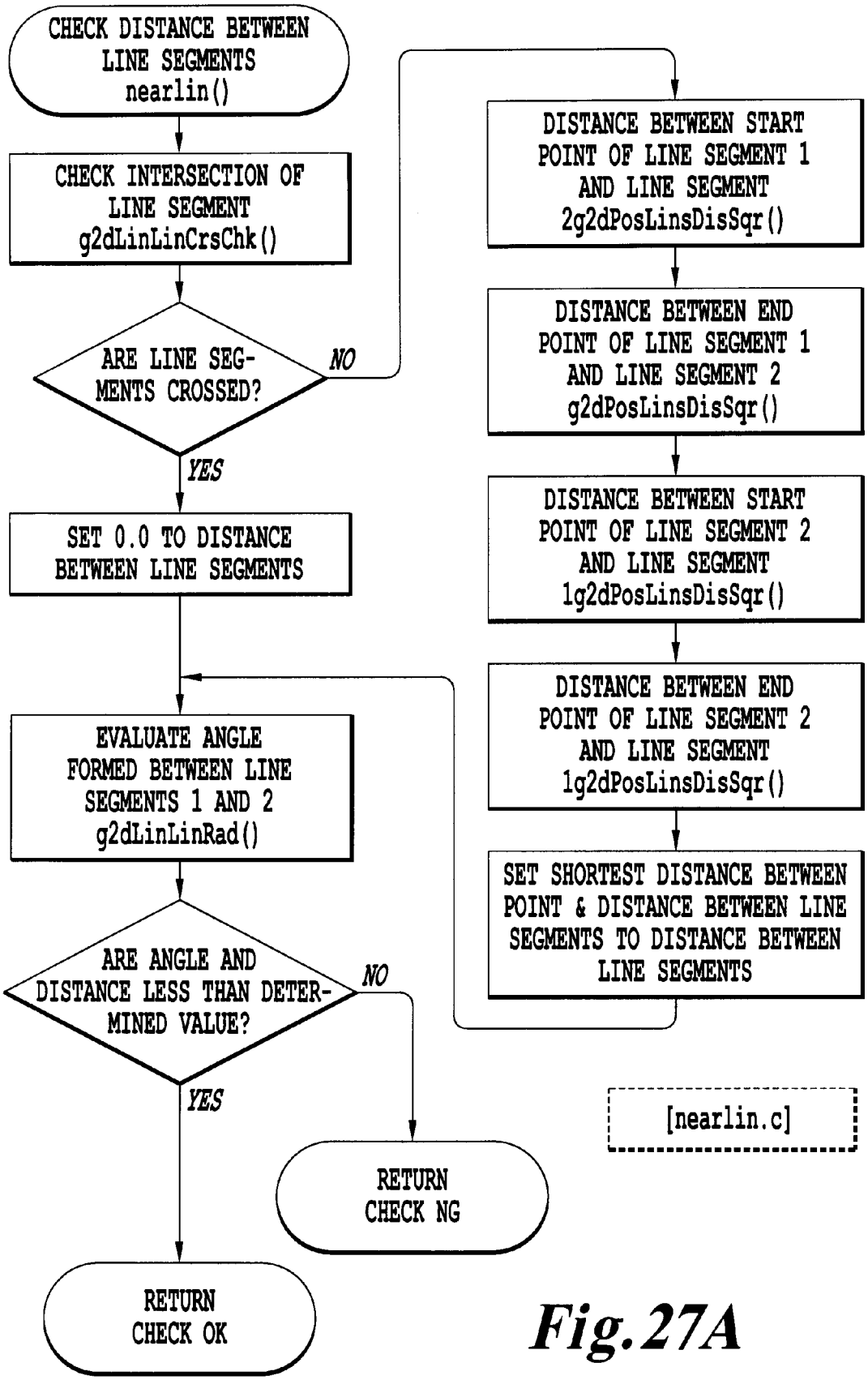
FIG. 27 is a flowchart depicting a subroutine of processing for checking a distance between line segments.
Figure 28A:
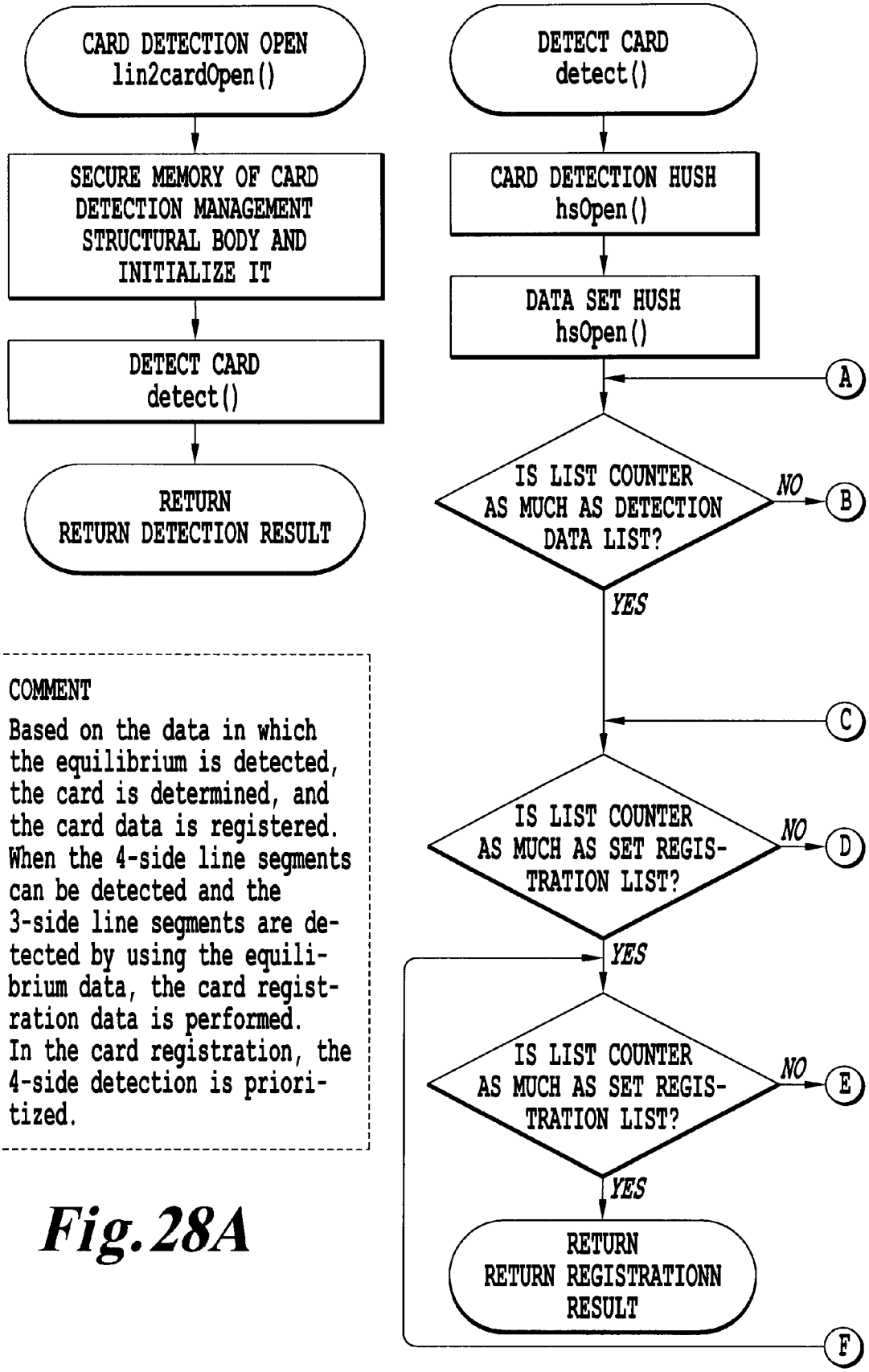
FIG. 28 is a flowchart depicting subroutines of processing for a card detect open and processing for a card detection.
Figure 28B:
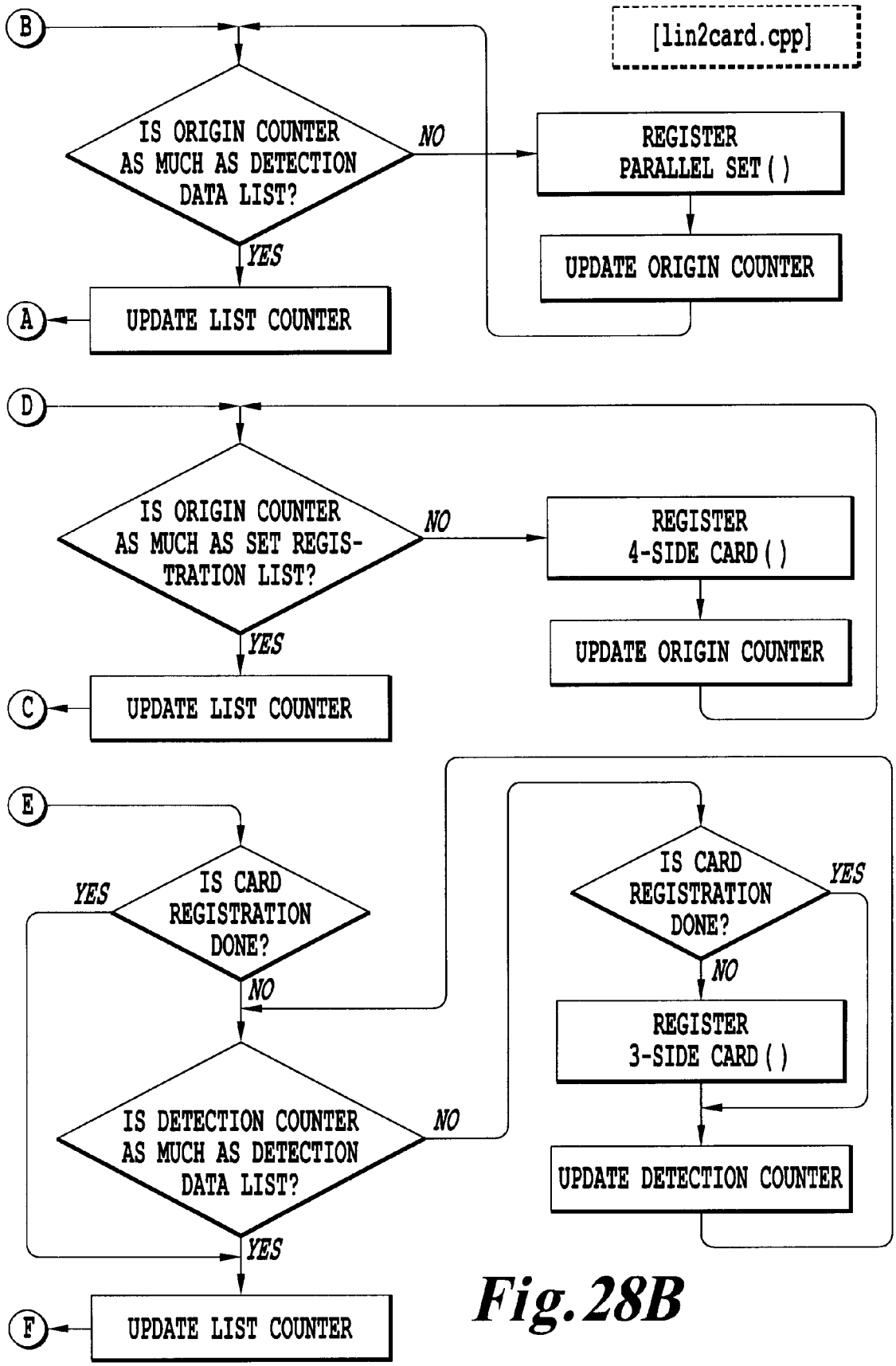
Figure 29A:
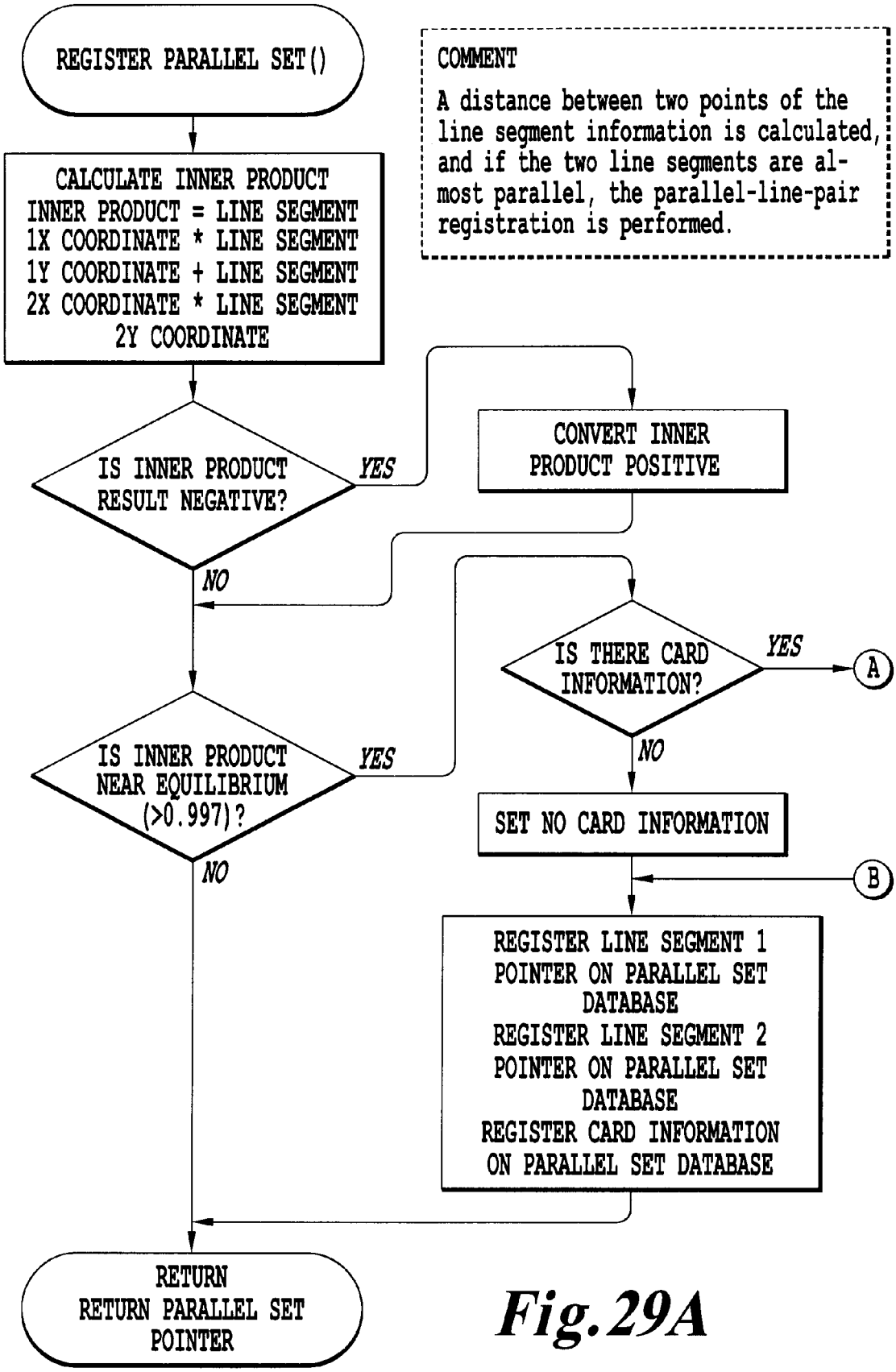
FIG. 29 is a flowchart depicting a subroutine of processing for a parallel set registration.
Figure 29B:
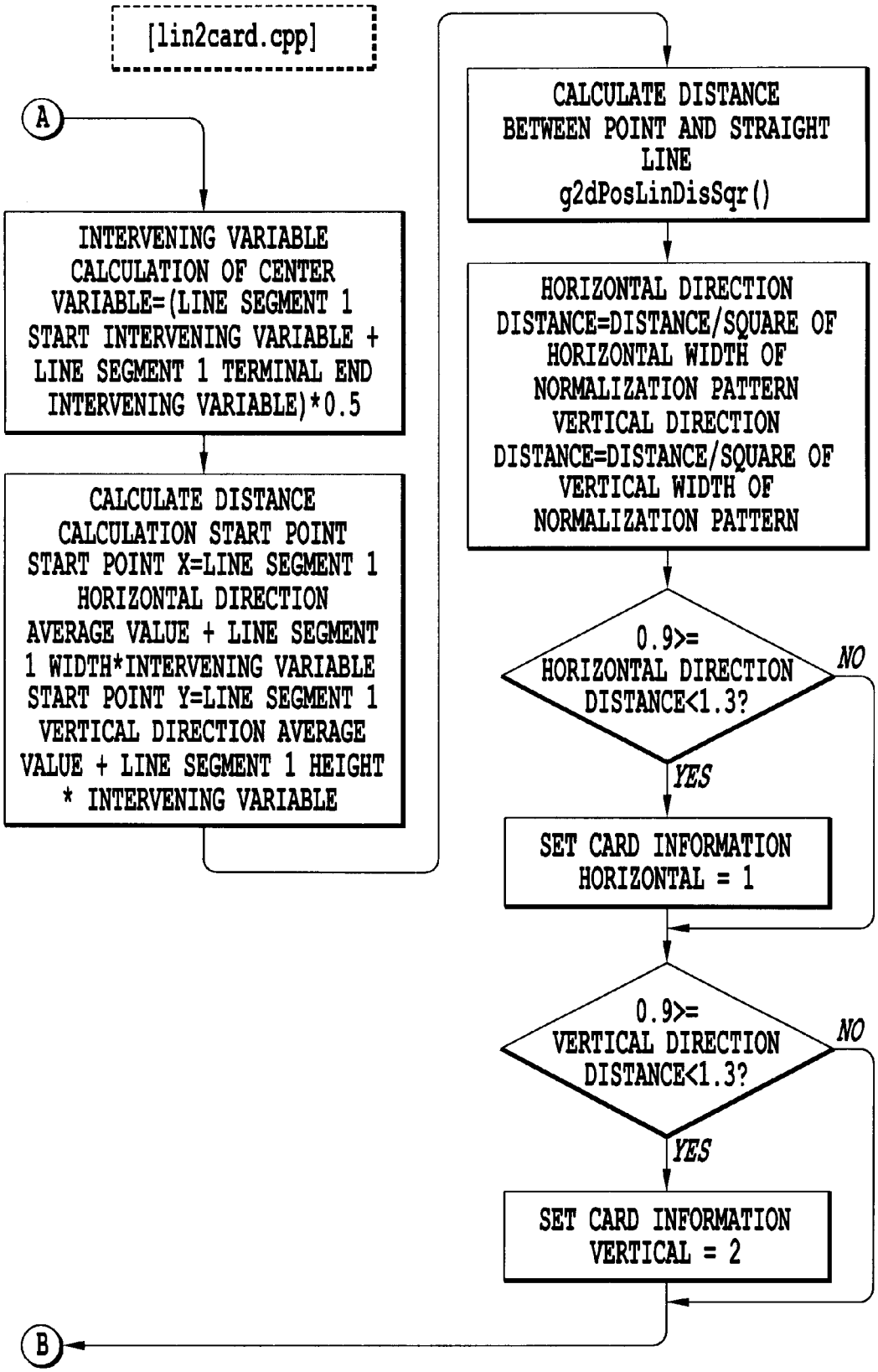
Figure 31A:
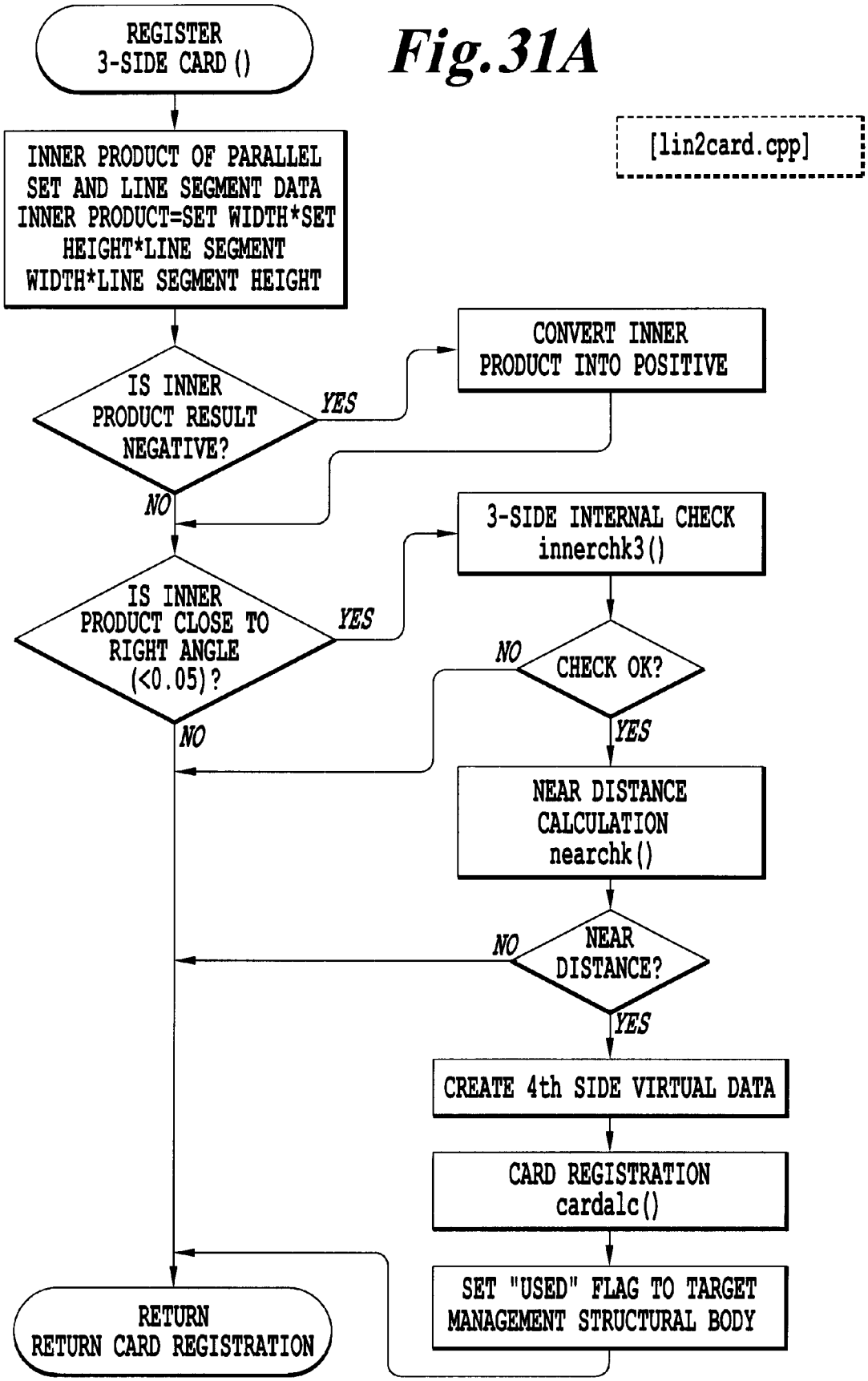
FIG. 31 is a flowchart depicting subroutines of processing for a 3-side card registration, processing for a 3-side internal check, processing for a short distance calculation, and processing for a short distance calculation sub.
Figure 31B:
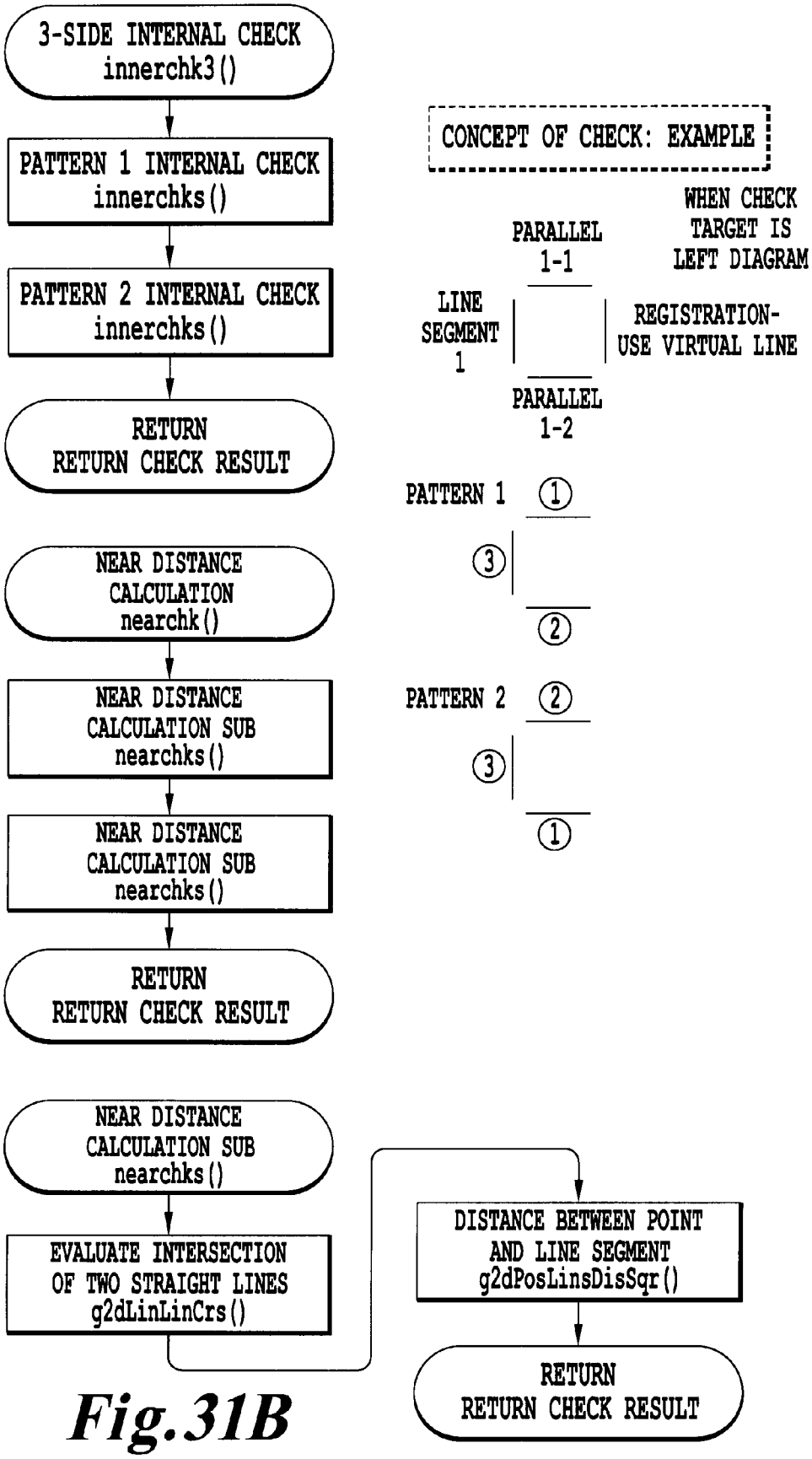
Figure 32B:
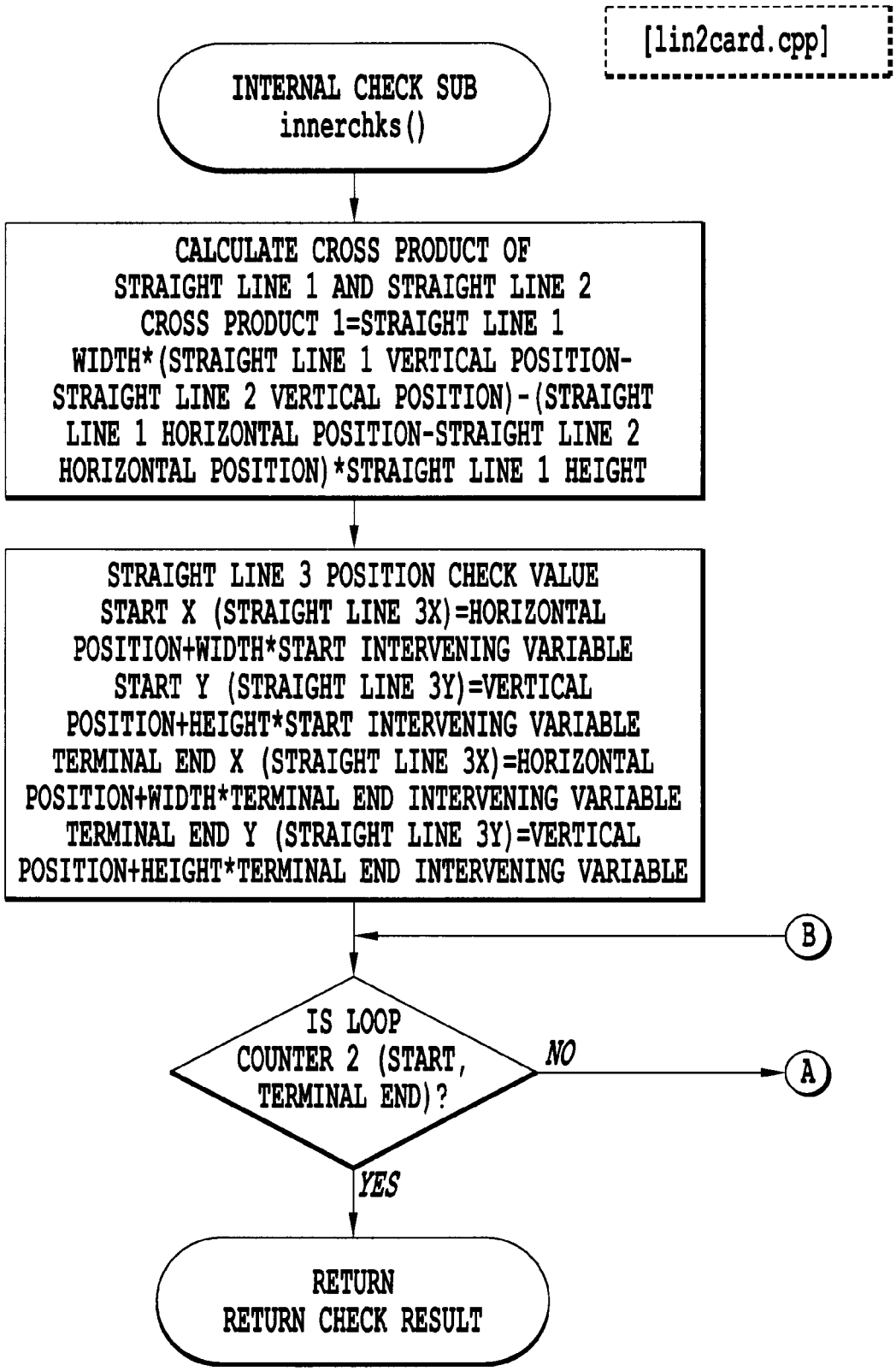
FIG. 32 is a flowchart depicting subroutines of processing for a card registration, processing for a vertex registration sub, and processing for an internal check sub.
Figure 32C:
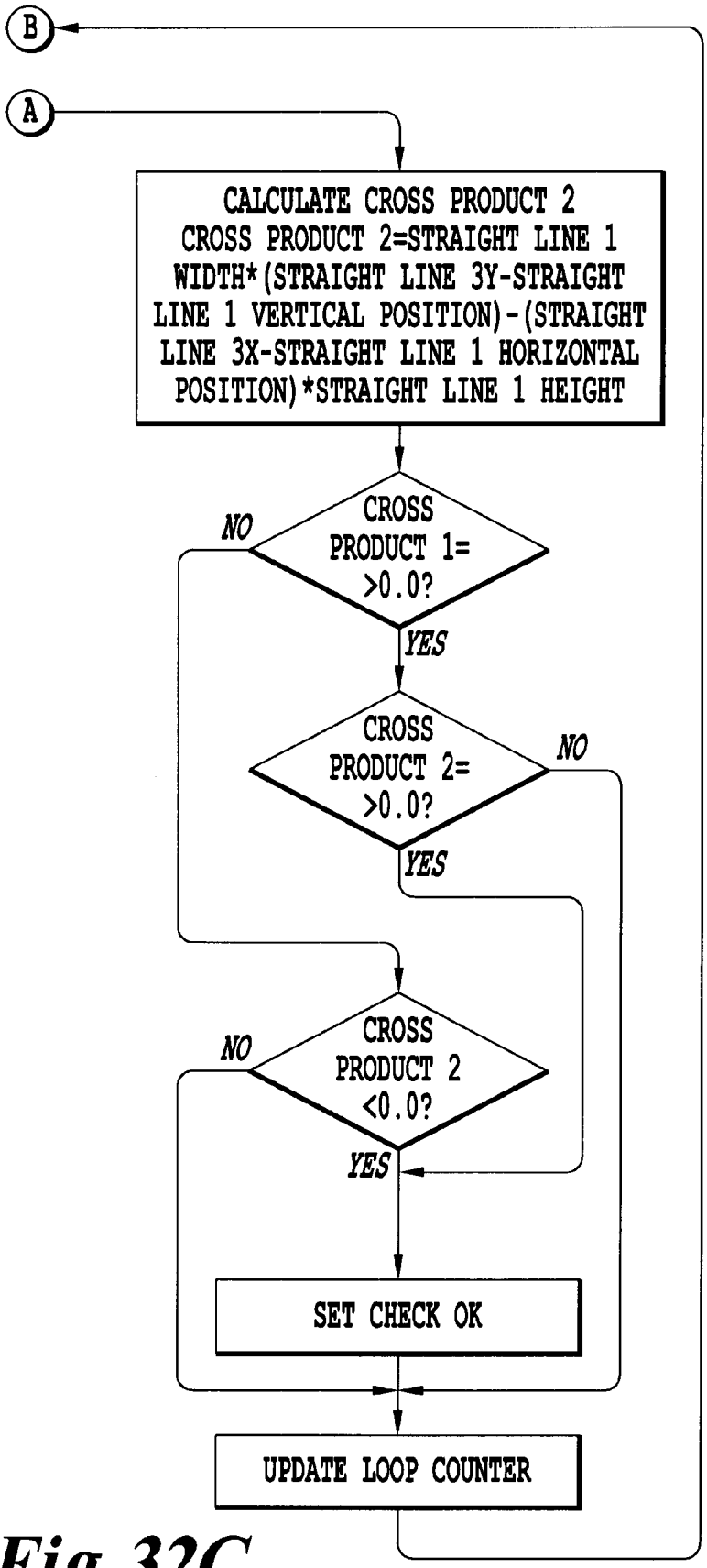
Figure 33:
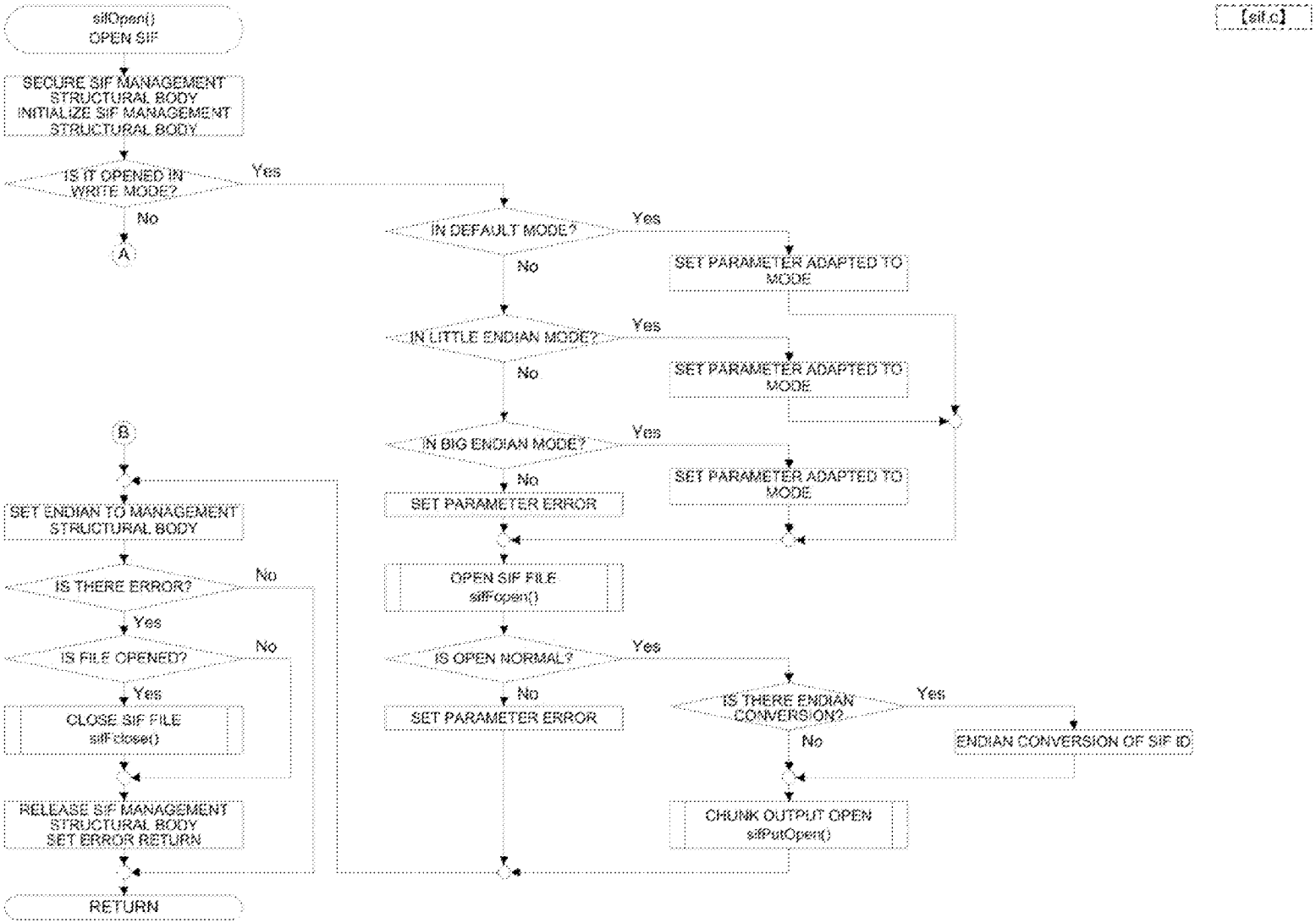
FIG. 33 is a flowchart depicting a subroutine of processing for opening an SIF structure management body.
Figure 34:
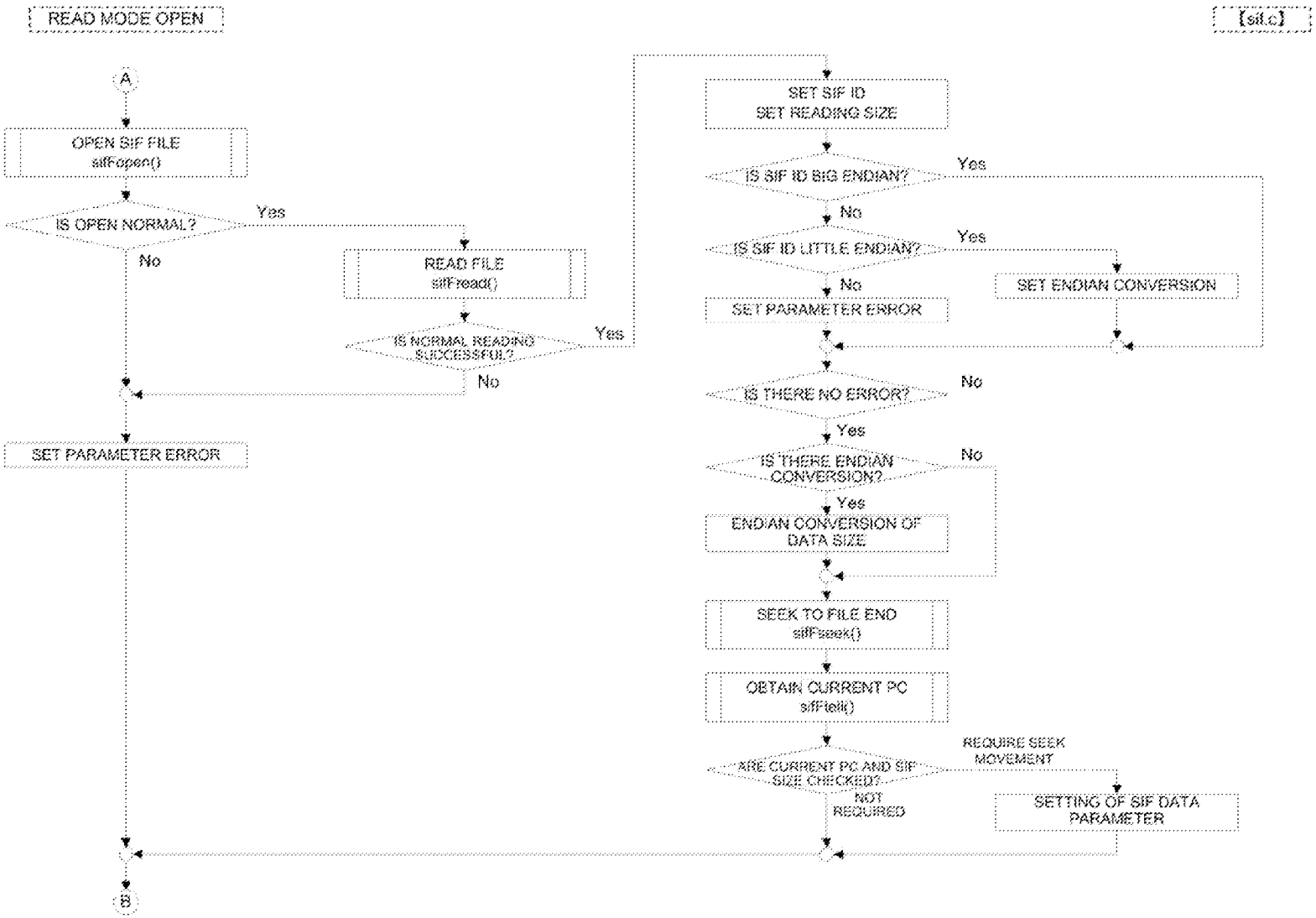
FIG. 34 is a flowchart depicting a subroutine of continued processing for opening an SIF structure management body.
Figure 35:
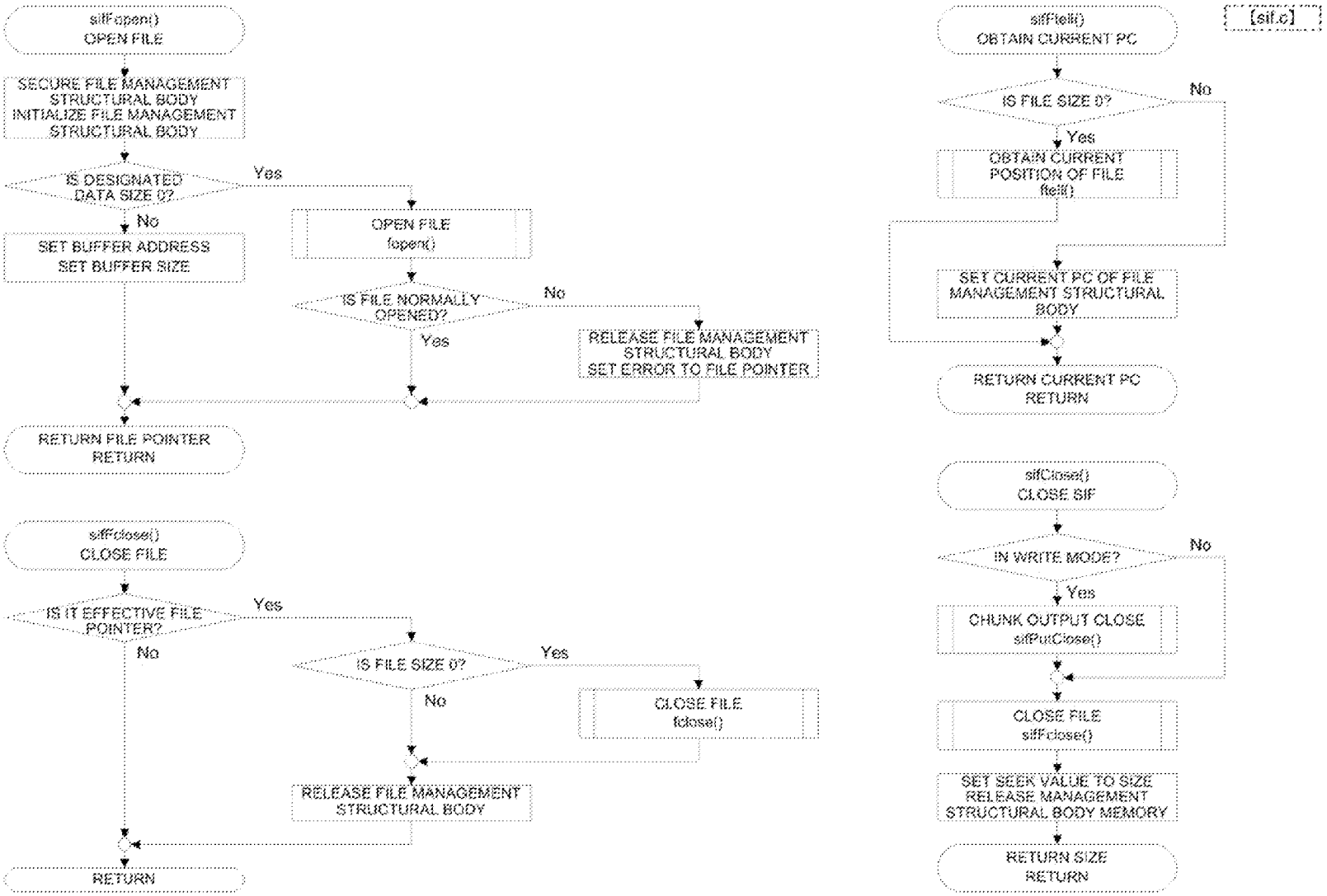
FIG. 35 is a flowchart depicting subroutines of processing for a file open, processing for a file close, processing for obtaining a current PC, and processing for closing the SIF structure management body.
Figure 36:
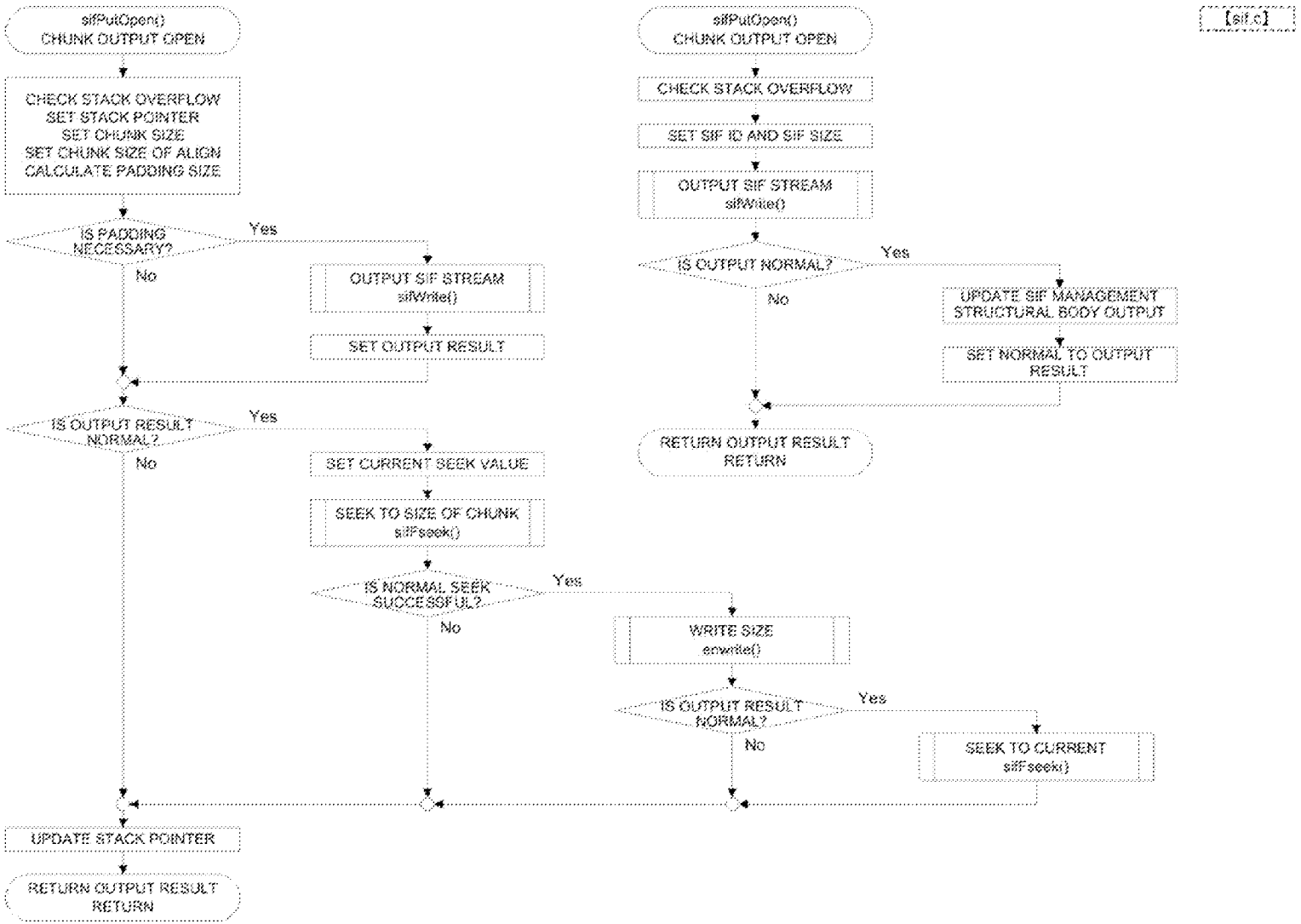
FIG. 36 is a flowchart depicting a subroutine of processing for a chunk output open.
Figure 37:
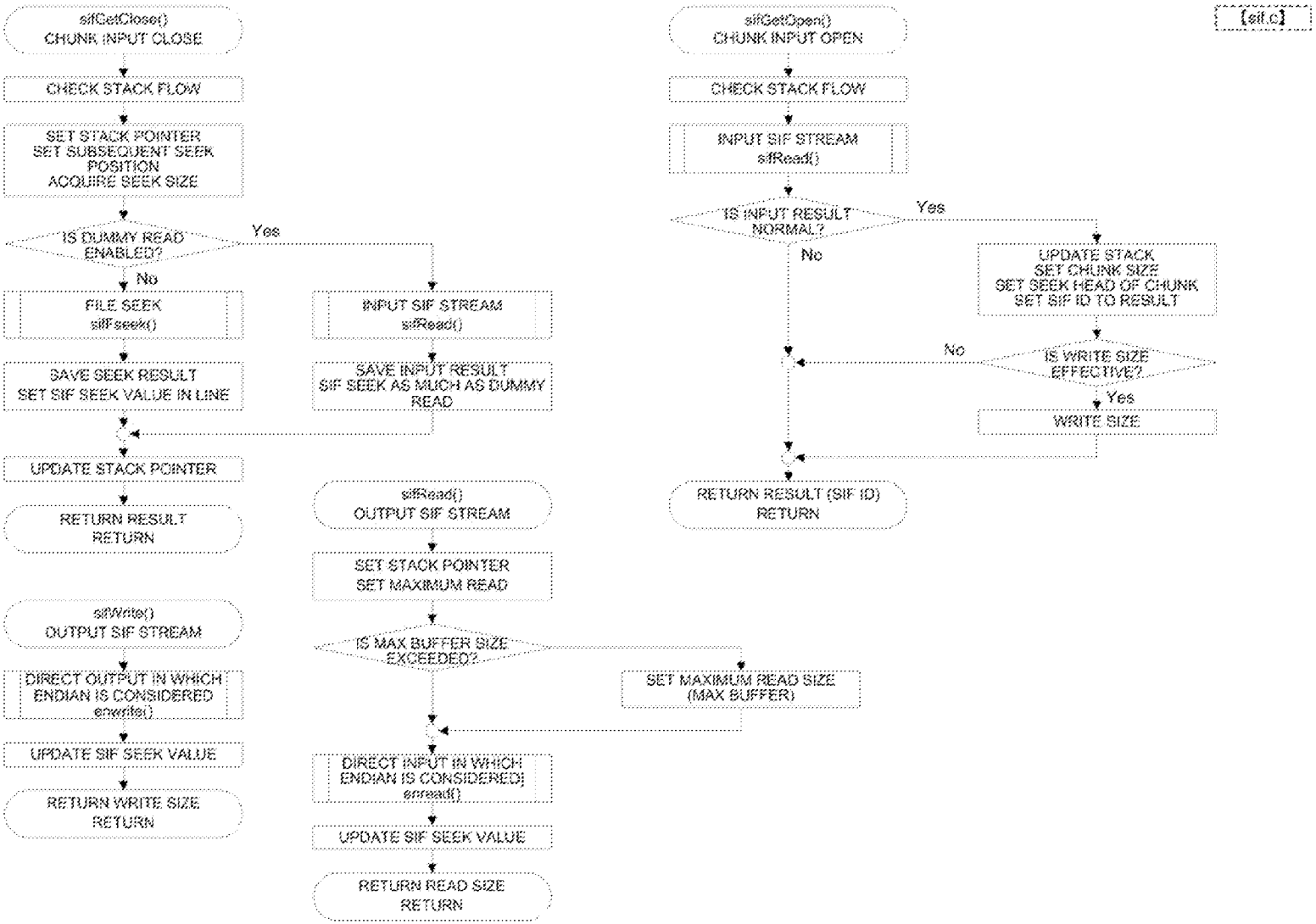
FIG. 37 is a flowchart depicting subroutines of processing for a chunk input close, processing for a chunk input open, and processing for an SIF structure management body stream output.
Figure 38:
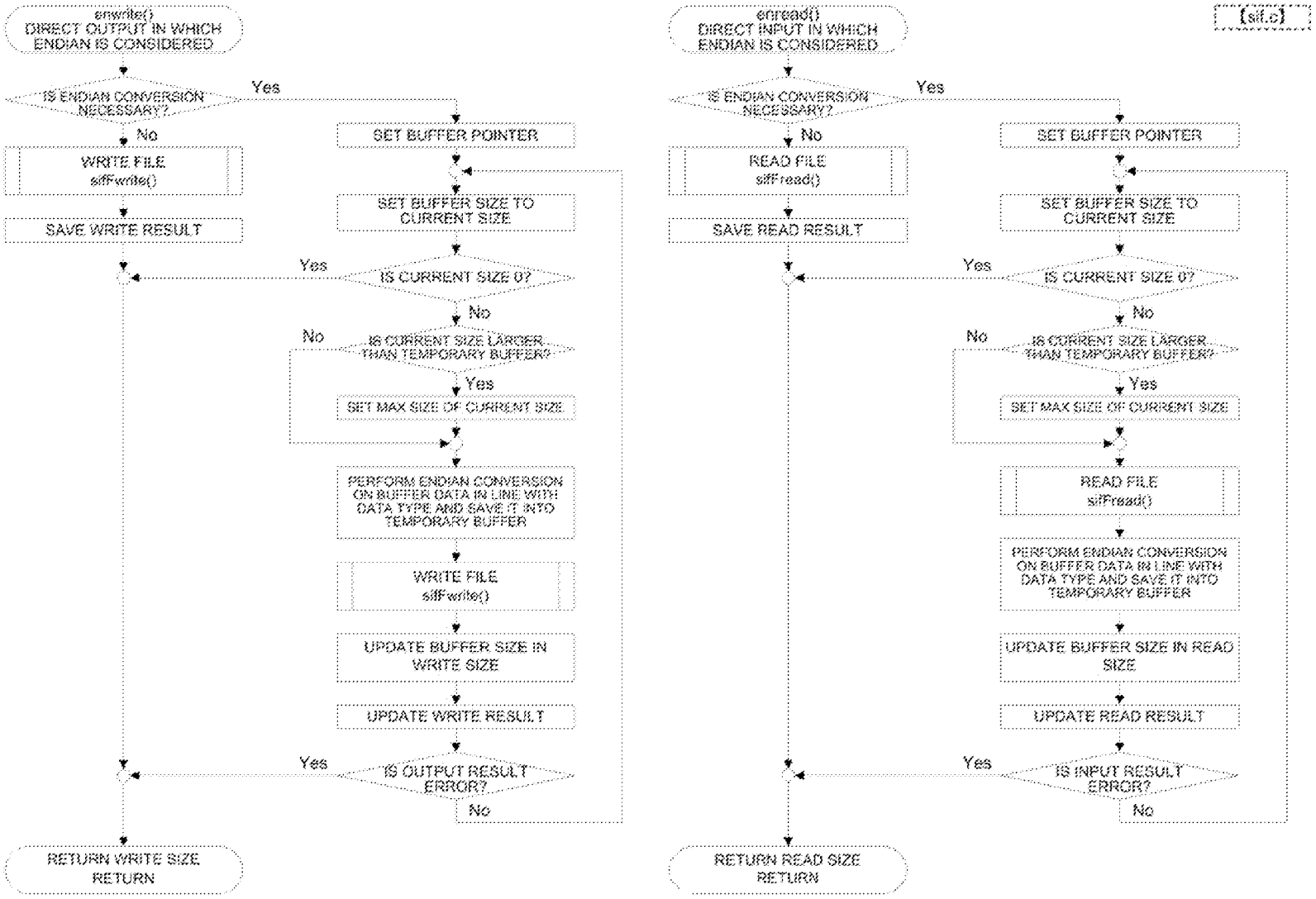
FIG. 38 is a flowchart depicting subroutines of processing for a direct output in which an endian is considered and processing for a direct input in which an endian is considered.
Figure 39:
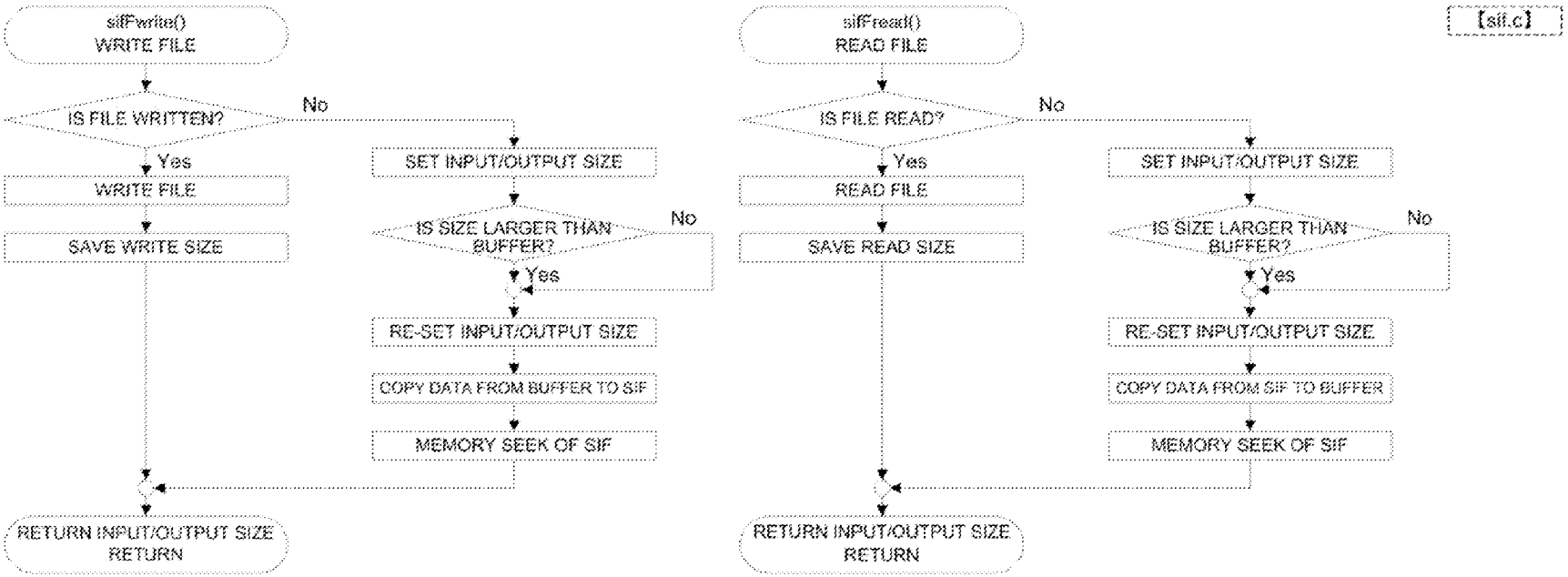
FIG. 39 is a flowchart depicting subroutines of processing for a file writing and processing for a file reading.
Figure 40A:
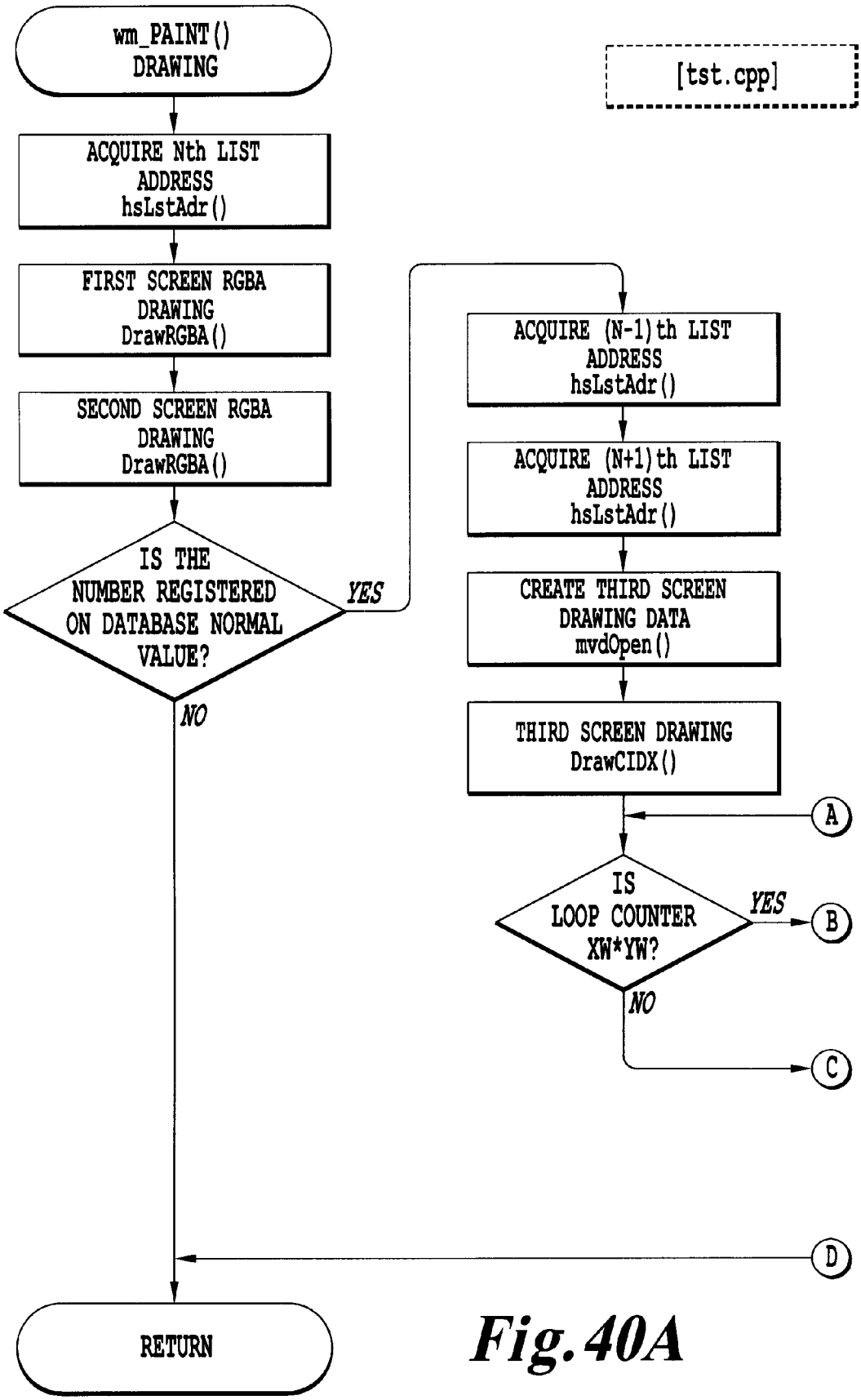
FIG. 40 is a flowchart depicting a subroutine of rendering processing.
Figure 40B:
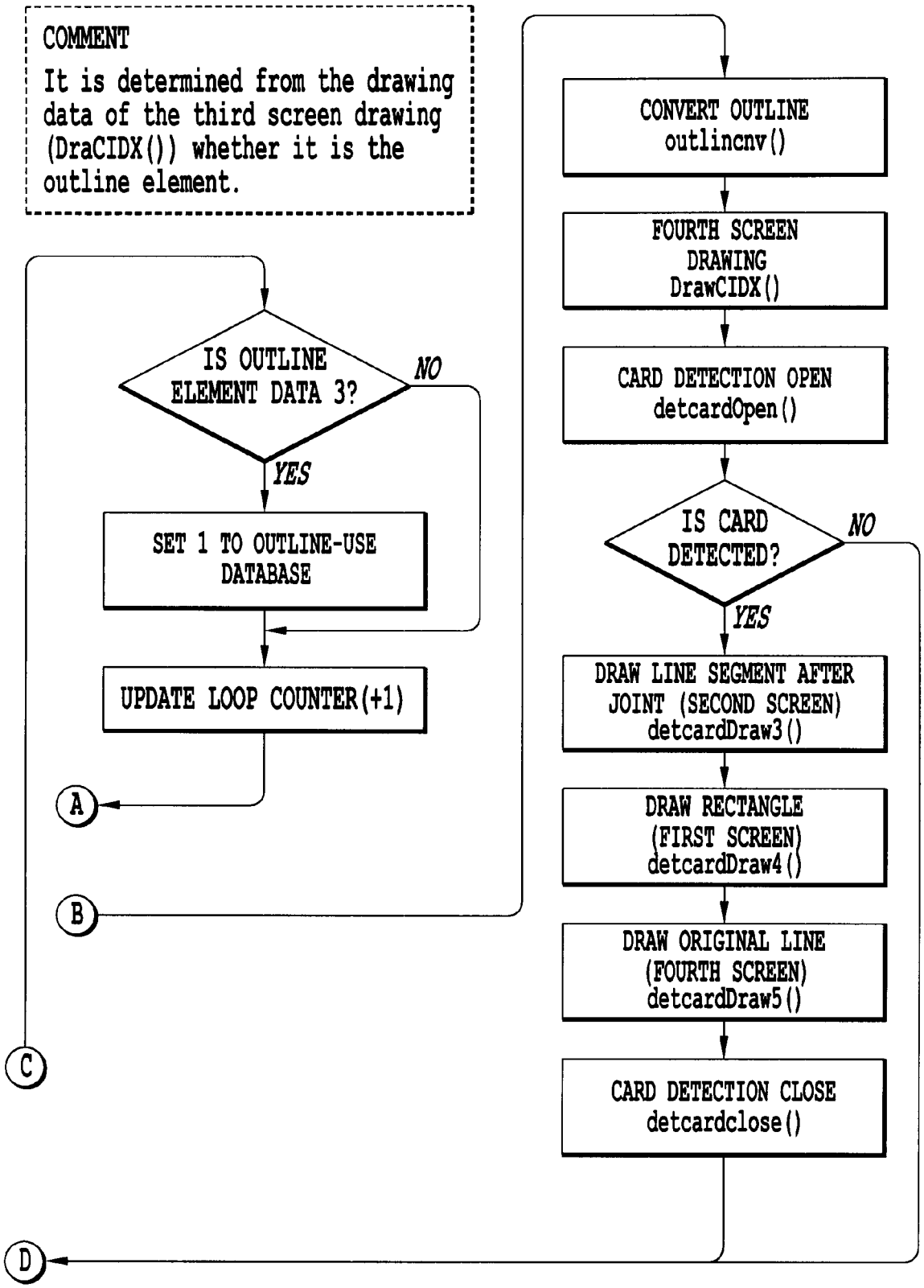
Figure 41A:
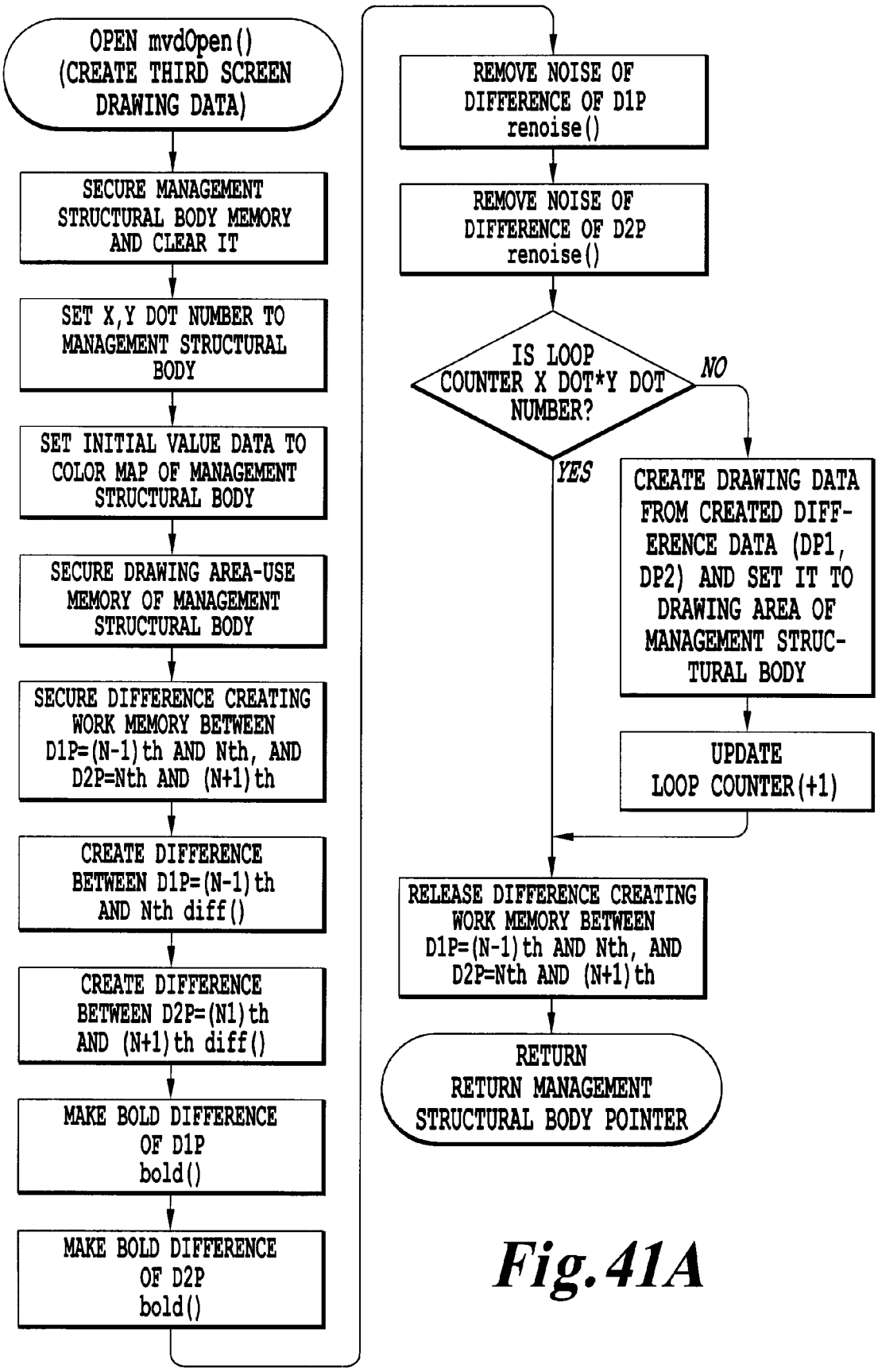
FIG. 41 is a flowchart depicting subroutines of open processing and processing for evaluating a difference.
Figure 42A:
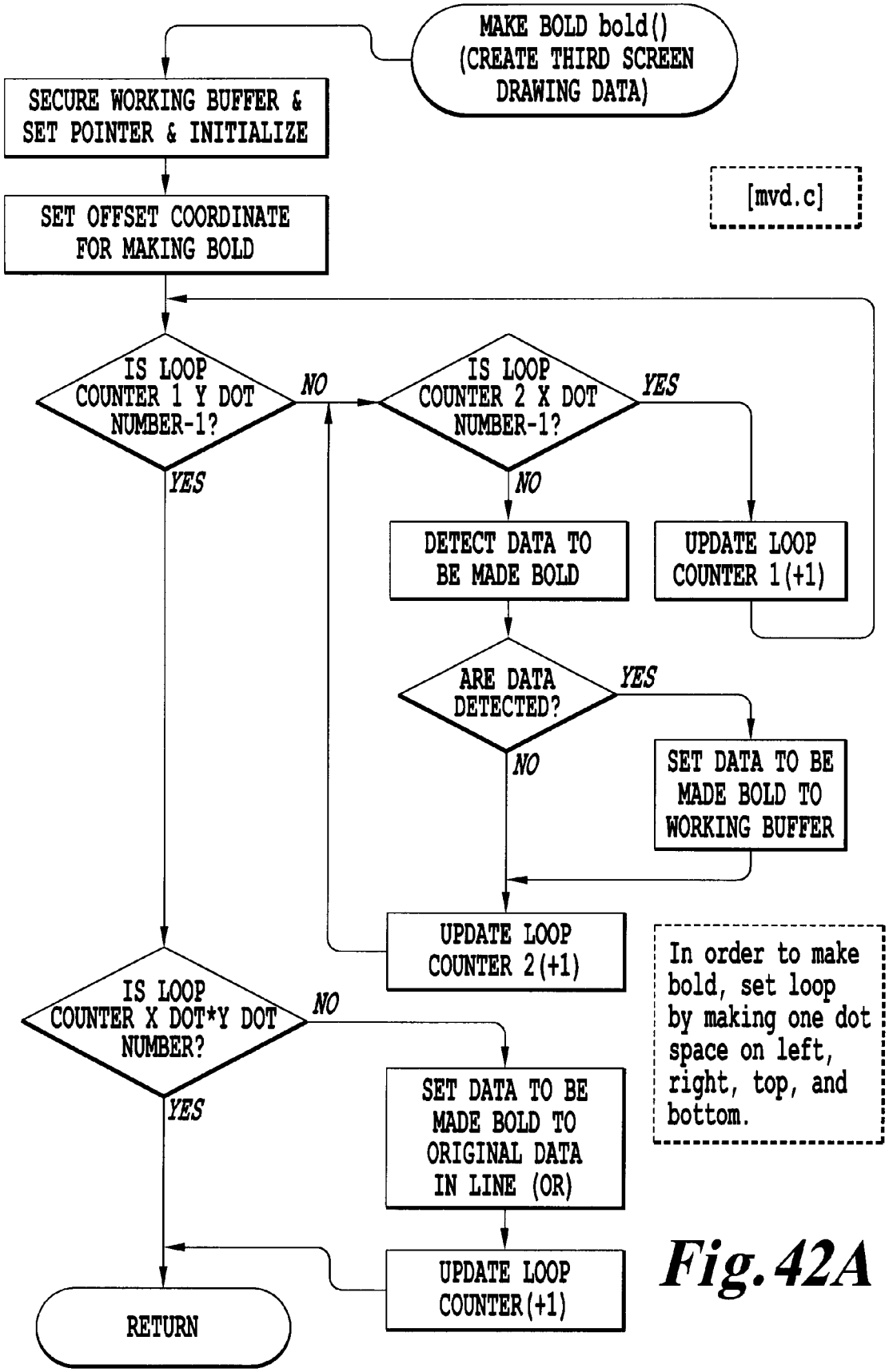
FIG. 42 is a flowchart depicting a subroutine of fattening processing.
Figures 42B, 42C:
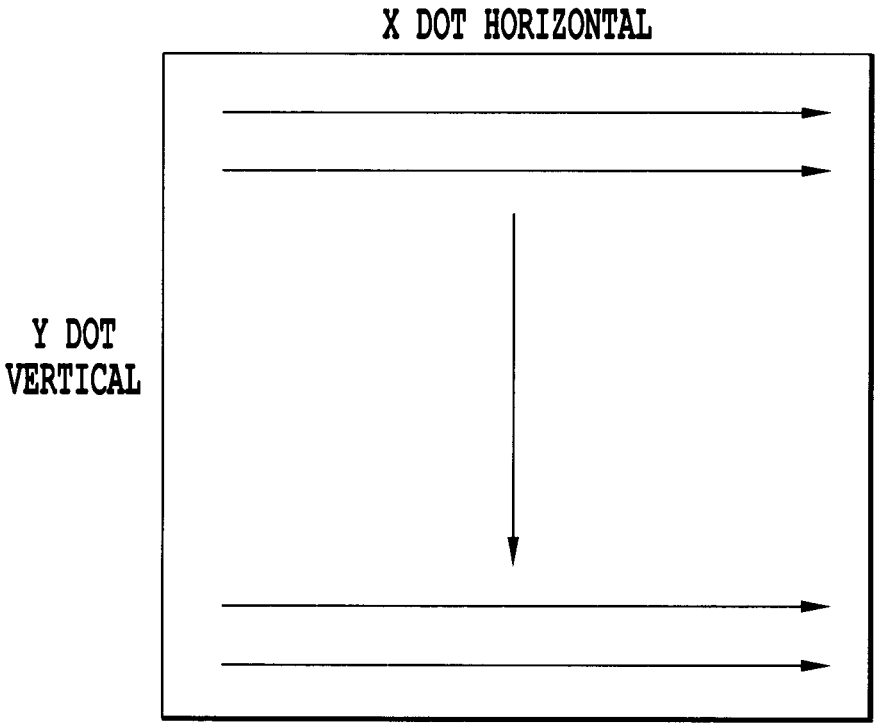
Figure 43A:
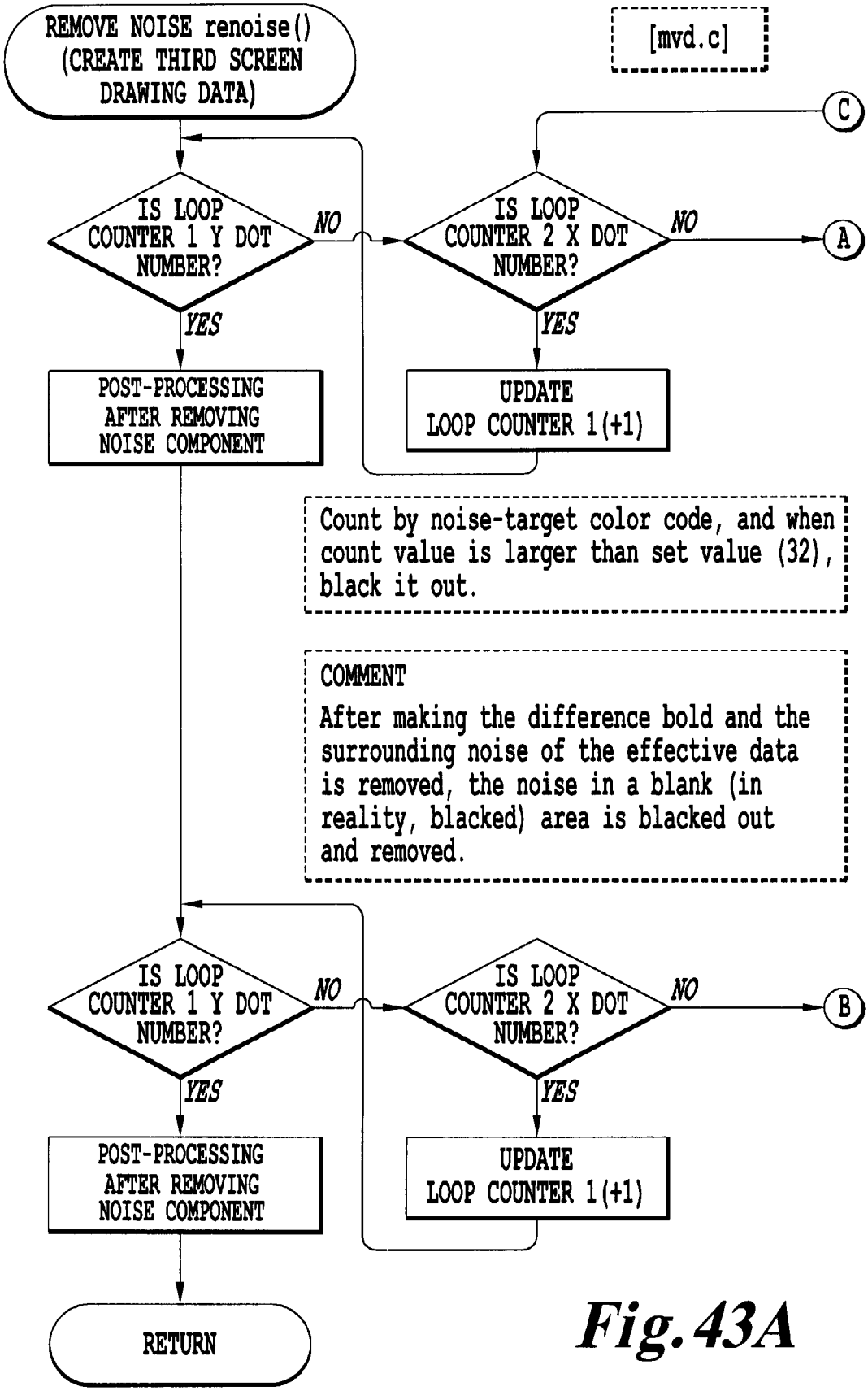
FIG. 43 is a flowchart depicting a subroutine of processing for a noise removal.
Figure 44A:
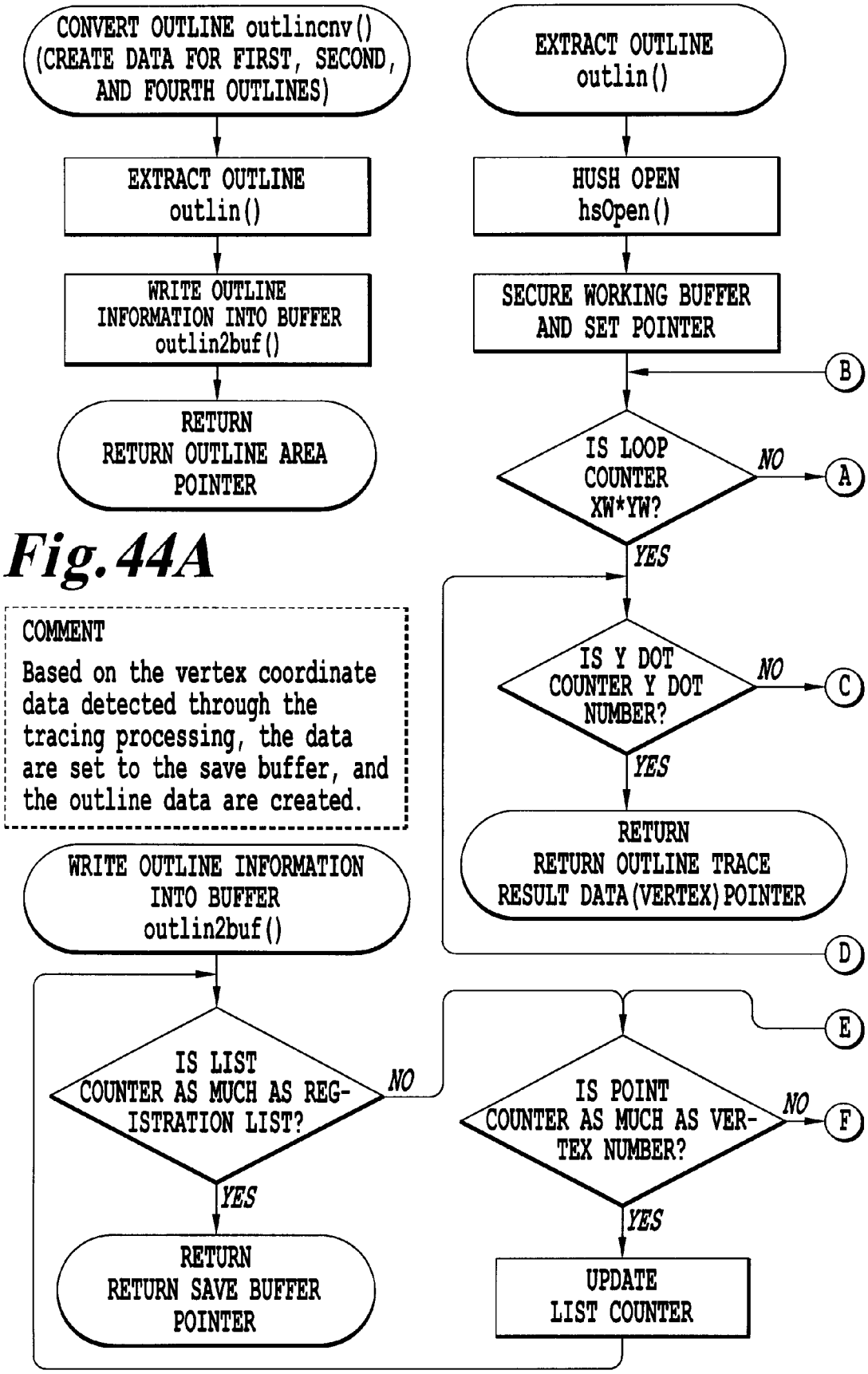
FIG. 44 is a flowchart depicting subroutines of processing for outline conversion, processing for writing outline information in a buffer, and processing for extracting the outline.
Figure 44B:
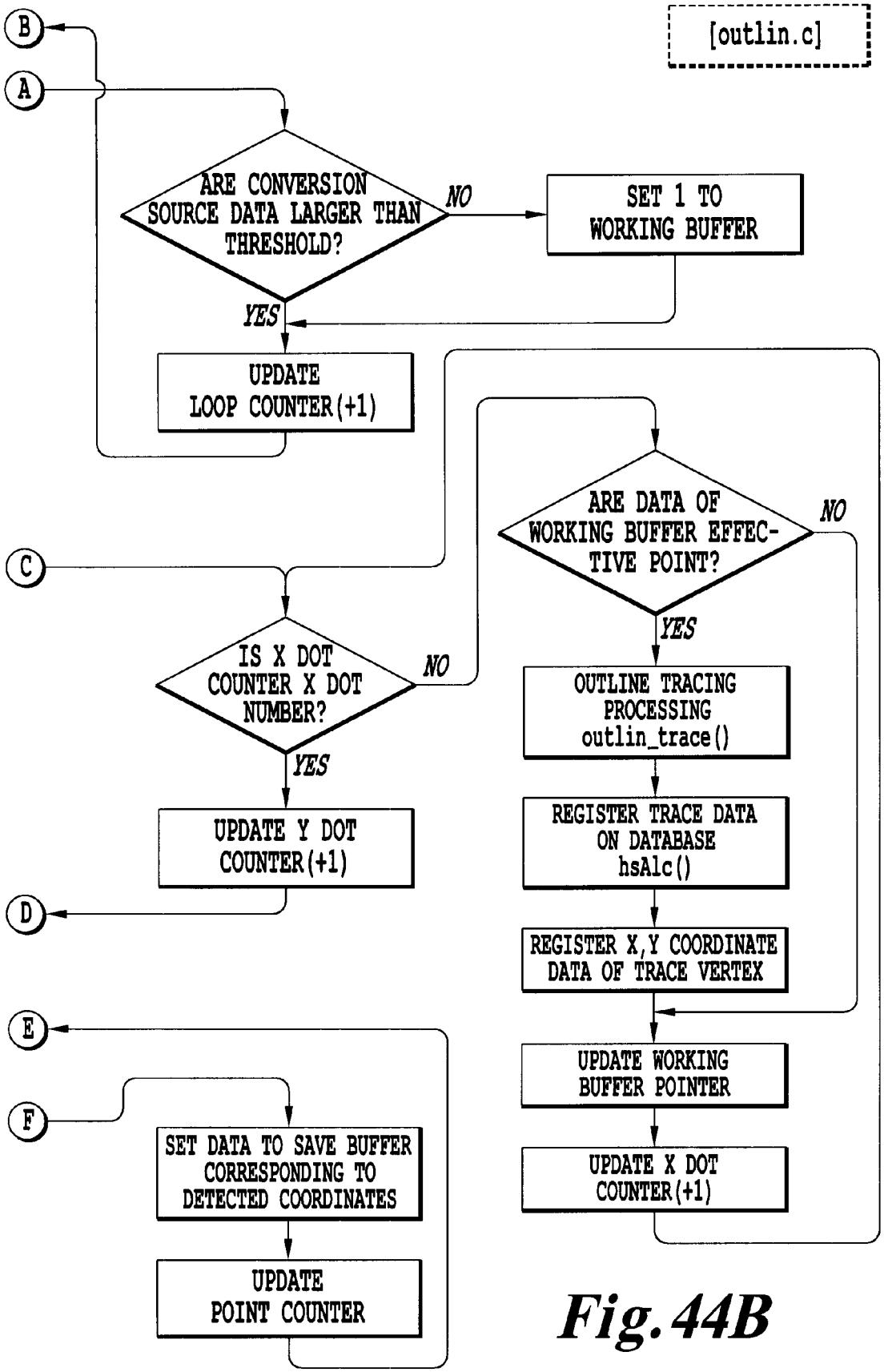
Figure 44C:
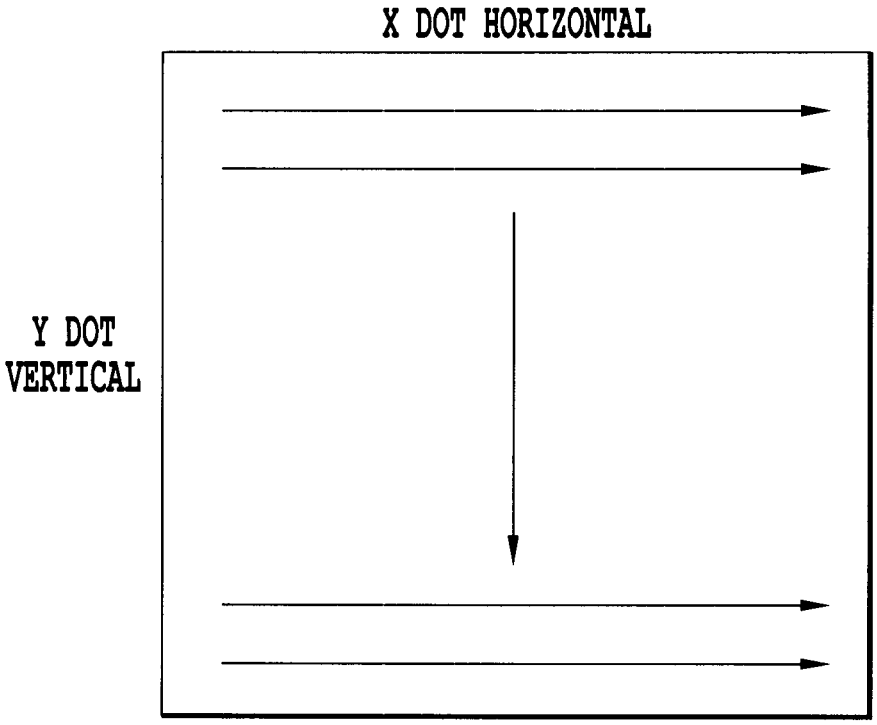
Figure 45A:
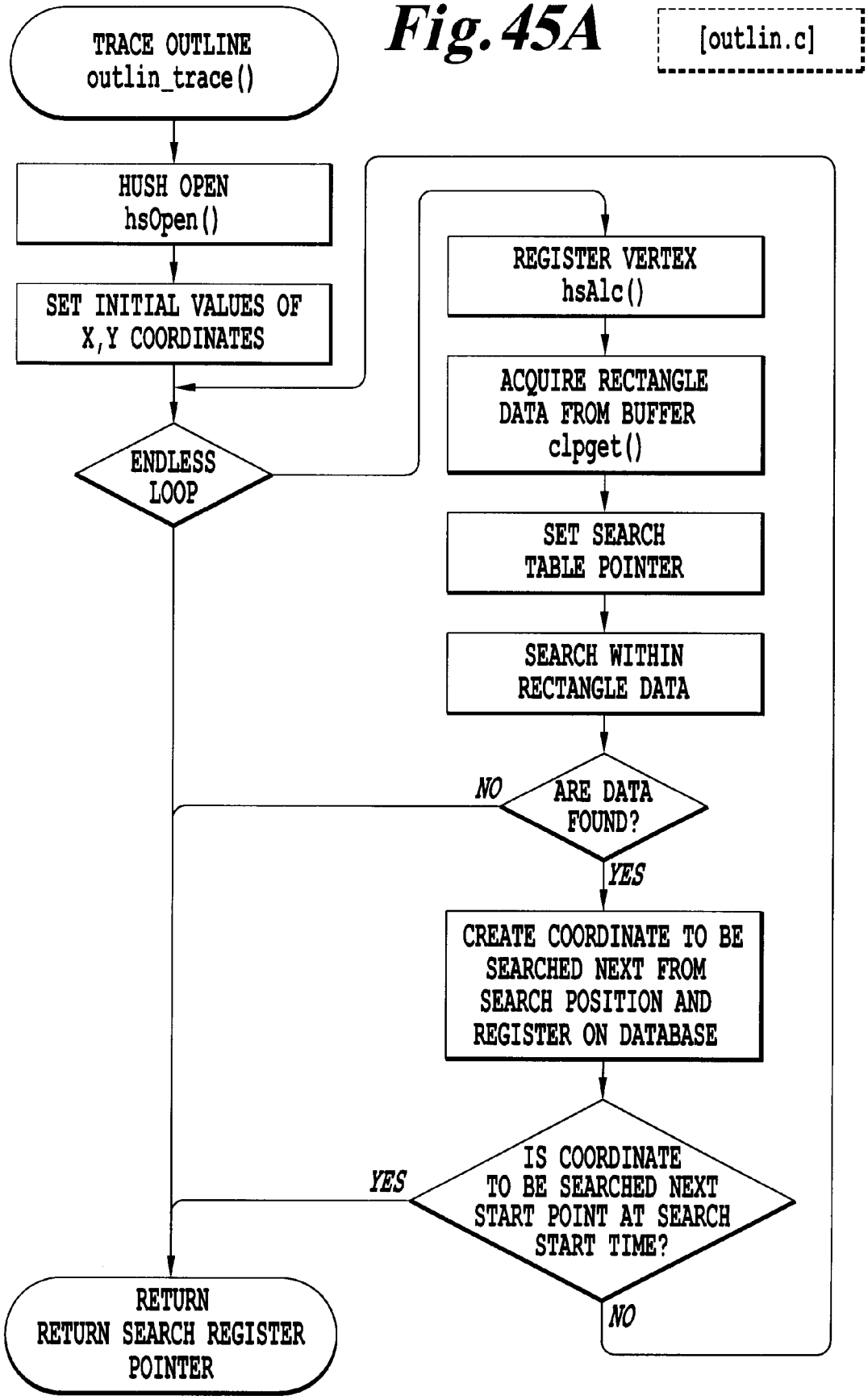
FIG. 45 is a flowchart depicting a subroutine of outline tracing processing.

FIG. 18 is a flowchart depicting processing for registering and producing card information of the card placed on the casino table 100.

Firstly, the imaged data obtained by imaging the game surface 110 of the casino table 100 by the camera 120 is subjected to predetermined image processing (step S1811). In this image processing, it may suffice that processing necessary for detecting the presence of the card from the imaged data obtained by imaging the game surface 110 is performed. Examples of the image processing include increasing sharpness, increasing brightness, and increasing contrast. Any image processing may be acceptable as long as it is possible to adequately extract the image of the card from the imaged data. For example, processing of a subroutine depicted in FIG. 41 or FIG. 42 may be executed.

Subsequently, outlines of the imaged object are extracted from the imaged data on which the image processing is performed, and thereby, a plurality of outline data items are produced (step S1813). For example, by using a coordinate system of units such as a pixel, the outline data can be produced from the imaged data or image data. In doing so, the outline data is formed by a set of coordinates of a start point of the outline or those of an end point thereof, or values of a parameter that characterizes the outline such as the width of the outline and the height thereof. For example, processing of a subroutine depicted in FIG. 43 or FIG. 44 may be executed.

Subsequently, a correlation coefficient among the produced outline data items is calculated (step S1815), a straight-line portion out of the outline is extracted by using the correlation coefficient, and the line segment data of the extracted line segment is produced (step S1817). For example, the plurality of outlines are separated into a plurality of segments, the correlation coefficient obtained by using the coordinates, the width, and the height of the segments is calculated, and a distance between the segments is acquired from the correlation coefficient. A portion of which the distance between the segments is equal to or less than a predetermined length, i.e., a portion in which a set of segments in a relatively near positional relationship is present, is found, the outline to that portion is extracted as the line segment, the line segment data of the line segment is produced and stored on the RAM 206 or the HDD 208. In this way, the line segment is registered. This line segment data also is formed by a set of coordinates of a start point of the extracted line segment or those of an end point thereof, or values of a parameter that characterizes the line segment such as the width of the outline and the height thereof. For example, processing of a subroutine depicted in FIG. 23 or FIG. 24 may be executed.

Subsequently, it is determined whether there are a plurality of line segments that can be joined from all the combinations of the plurality of registered line segments, and upon determining that there are the plurality of line segments that can be joined, the line segments are converted into a long line segment, i.e., single straight-line data (step S1819). For example, the determination whether the line segments can be joined may be based on the determination whether at least one portion of these line segments is present at a position shorter than a predetermined distance and an angle formed by these line segments is substantially zero. When at least one portion of the plurality of line segments is present at the position shorter than the predetermined distance and the angle formed by these line segments is substantially zero, these line segments are one long straight line under normal circumstances and in order that two line segments are converted into one line segment, data of the line segment is produced. For example, processing of a subroutine depicted in FIG. 25 or FIG. 26 may be executed.

Further, when the plurality of line segments are joined to produce the data of one line segment in the processing in step S1819, the original data indicating the original line segments preferably are deleted. In doing so, a data amount of the line segment can be reduced, and at the same time, a time required for processing such as processing for searching a line segment can be shortened.

Subsequently, when as a result of the joining processing in the aforementioned step S1819, a distance between the plurality of produced line segments is calculated and there are two line segments substantially in parallel and substantially the same in length, these two line segments are registered as a parallel line pair (step S1821). The parallel line pair is for detecting two sides opposite to each other, out of four sides configuring a rectangular card. For example, processing of a subroutine depicted in FIG. 28 may be executed.

By the processing in step S1821, a plurality of registered parallel line pairs are searched, and whether two sets of parallel line pairs, out of the plurality of parallel line pairs, are present in a near position is determined (step S1823). The reason why this processing is performed is to make sure that if the two sets of parallel line pairs are present in a near position, there is a possibility that by using the two sets of parallel line pairs, the four sides of a rectangle can be configured. For example, processing of a subroutine depicted in FIG. 29 may be executed.

Subsequently, upon determining in the determination processing in step S1823 that the two sets of parallel line pairs are present in a near position (YES), it is determined whether the two sets of parallel line pairs can configure the four sides of a rectangle (step S1825). Specifically, from the four line segments configuring the two sets of parallel line pairs, a combination of line segment adjacent to each other is produced, a cross product is calculated from the line segment data of the combination. In this way, the determination whether to configure the rectangle is made. When it is possible to configure the rectangle by the four line segments configuring the two sets of parallel line pairs, four vertexes of the rectangle are configured by ends of the line segment adjacent to each other. Angles of the four vertexes of the rectangle are right angles, and thus, all of the four cross products of the line segments adjacent to each other are calculated, and if the value is substantially zero, it is possible to configure the rectangle by the four line segments configuring the two sets of parallel line pairs. The determination in the aforementioned step S1825 is processing in which all of the four cross products of the line segments adjacent to each other are calculated, and whether the value is substantially zero is determined.

Upon determining in the determination processing in the aforementioned step S1825 that the rectangle can be configured by the two sets of parallel line pairs (YES), coordinates of the four vertexes of the rectangle are evaluated from the line segment data of the four line segments configuring the two sets of parallel line pairs, regarding that the card is present in the imaged data imaged by the camera 120, and the coordinates of the vertexes are registered as the card information (step S1827). On the other hand, upon determining in the determination processing in the aforementioned step S1825 that the rectangle cannot be configured by two sets of parallel line pairs (NO), the subroutine is immediately ended. For example, processing of a subroutine depicted in FIG. 31 may be executed.

Upon determining in the determination processing in the aforementioned step S1823 that the two sets of parallel line pairs are not present in a near position (NO), the plurality of registered parallel line pairs and another line segment not configuring the parallel line pair are searched to determine whether one parallel line pair and the other one line segment are present in a near position (step S1829). If one parallel line pair and the other one line segment are present in a near position, then there is a possibility that the three sides of the rectangle can be configured by the one parallel line pair and the other one line segment.

Subsequently, upon determining in the determination processing in step S1829 that the one parallel line pair and the other one line segment are present in a near position (YES), it is determined whether the three sides of the rectangle can be configured by the one parallel line pair and the other one line segment (step S1831). Specifically, from the three line segments configured by the one parallel line pair and the other one line segment, a combination of the line segments adjacent to each other is produced, and a cross product is calculated from the line segment data of the combination. In this way, the determination whether to configure the rectangle is made. The determination by the cross product is similar to the determination processing in the aforementioned step S1825. However, in the determination processing in step S1831, only the three line segments are determined, and thus, the number of combinations of the line segments adjacent to each other is three. When all of the three cross products are calculated and the value is substantially zero, this is regarded that the rectangle can be configured by the one parallel line pair and the other one line segment. For example, processing of a subroutine depicted in FIG. 30 may be executed.

The card is moved and used for the game while the dealer or the player holds it by hand, and thus, it is rare that all the four sides of the card can be always imaged by the camera 120. When the dealer or the player holds the card by hand, there is a case where one side of the card cannot be sufficiently imaged because of the hand of the dealer or the player. In consideration of this, whether the three sides of the rectangle can be configured is determined by the determination processing in step S1831, and when the three sides of the rectangles can be configured, it is processed regarding that there is a possibility that the four sides of the rectangle can be configured.

Subsequently, the line segment data of the remaining one line segment that could not be detected from the line segment data of one parallel line pair and the other one line segment is produced (step S1833), the process is moved to the processing in the aforementioned step S1827, and the coordinates of the four vertexes of the rectangle are registered as the card information.

Subsequently, it is determined whether all the line segment data items are processed (step S1835). Upon determining that all the line segment data items are not processed (NO), the process returns to the processing in the aforementioned step S1823.

Upon determining that that all the line segment data items are processed (YES), it is determining whether, out of the registered card information, the rectangles the same in size overlap in the substantially same position, and upon determining that the rectangles overlap, only the card information of one rectangle is left and the card information of the other rectangles are deleted (step S1837). In doing so, the data amount of the card information can be reduced, and at the same time, various types of processing times such as processing for searching the card information and processing for displaying the card can be shortened.

As described above, when the processing in steps S617 to S623 of the subroutine depicted in FIG. 6 is replaced by a subroutine depicted in FIG. 18, the trajectory data can be produced by using the imaged data obtained by imaging the game surface 110 of the casino table 100 by the camera 120. That is, after executing the subroutine in FIG. 18, the registered card information is used, and by the processing similar to that in step S627 in FIG. 6, the trajectory data can be produced. Further, as a result of the processing in the subroutine depicted in FIG. 7 being executed, the produced trajectory data of the card can be displayed on the display 220 and the trajectory data of the card and the game result can be compared, for example.

What is claimed is:

1. A casino table, comprising:

a game surface on which a game is played;

an imaging device imaging the game surface and issuing an imaging signal; and a monitoring control unit monitoring the game based on the imaging signal issued from the imaging device, wherein the monitoring control unit comprises:

a controller executing the following processing (1-1-1) to (1-1-3) of:

(1-1-1) imaging the game surface by the imaging device;

(1-1-2) detecting the presence of a card placed on the game surface from image data produced by the imaging signal issued from the imaging device; and (1-1-3) producing trajectory data of the card placed on the game surface, and a storing means into which data used for these processing is stored, wherein the trajectory data include a plurality of predetermined times and a plurality of position data of the card that are detected for the predetermined times, respectively and are associated with the predetermined times, respectively, wherein the trajectory data is associated with identification information of the card, and wherein the processing of (1-1-2) comprises processing of:

producing outline data by extracting an outline of an object imaged by the imaging device by the imaging signal;

extracting a plurality of line segments from the outline data;

registering two line segments that are substantially in parallel and has substantially the same in length from among the line segments, as a parallel line pair; and determining two parallel line pairs corresponding to four sides of a rectangle for a card, wherein the processing of (1-1-2) further comprises processing of:

when the two parallel line pairs corresponding to the four sides are not present, determining whether one parallel line pair and one line segment for configuring three sides of the rectangle are present; and forming the rectangle by the one parallel line pair and the one line segment when the one parallel line pair and the one line segment for configuring three sides of the rectangle are present.

2. The casino table according to claim 1, comprising a reference-card-data storing means into which reference card data obtained by converting a design of the top surface of the card into image data is stored, wherein the processing of (1-1-2) further includes processing of:

(1-2-1) determining whether a card is present on the game surface by comparing the image data and the reference card data; and (1-2-2) calculating, when the card is present on the game surface, a position of the card and storing position data of the card into the storing means, and the processing of (1-1-3) includes (1-2-3) producing the trajectory data indicating a trajectory of the card from the position data by executing the processing of (1-2-1) and the processing of (1-2-2) at least once.

3. The casino table according to claim 1, wherein the processing of (1-1-2) further includes processing of:

(1-3-3) storing, as card information, a position of a vertex of the rectangle into the storing means.

4. The casino table according to claim 3, wherein the processing of (1-1-2) further includes (1-5-1) processing of deleting remaining card information except for one card information, out of card information indicating the same rectangle, when there are a plurality of card information indicating the same rectangle, out of the card information stored by the processing of (1-3-3).

5. The casino table according to claim 1, comprising a display on which a display image by a display signal issued from the monitoring control unit is displayed, wherein the monitoring control unit executes (1-4-1) processing for displaying the trajectory data on the display.

6. The casino table according to claim 1, wherein the processing of (1-1-2) further comprises processing of:

generating each combination of two line segments from the one parallel line pair and the one line segment; and determining that the one parallel line pair and the one line segment for configuring three sides of the rectangle are present when a product of the two line segments is substantially zero in each combination.

7. The casino table according to claim 1, wherein the processing of (1-1-2) is performed while the game is played.

8. A casino table, comprising:

a game surface on which a game is played;

an imaging device imaging the game surface and issuing an imaging signal; and a monitoring control unit monitoring the game based on the imaging signal issued from the imaging device, wherein the monitoring control unit comprises:

a controller executing the following processing (5-1-1) to (5-1-6) of:

(5-1-1) producing outline data by extracting an outline of an object imaged by the imaging device by the imaging signal issued from the imaging device;

(5-1-2) extracting a plurality of line segments from the outline data;

(5-1-3) registering two line segments that are substantially in parallel and has substantially the same in length from among the line segments, as a parallel line pair;

(5-1-4) determining two parallel line pairs corresponding to four sides of a rectangle for a card;

(5-1-5) storing, as card information, a position of a vertex of the rectangle into the storing means, and (5-1-6) producing trajectory data indicating a trajectory of the card by executing the processing of (5-1-1) to (5-1-5) at least once, and a storing means into which data used for these processing is stored, wherein the trajectory data include a plurality of predetermined times and a plurality of position data of the card that are detected for the predetermined times, respectively and are associated with the predetermined times, respectively, wherein the trajectory data is associated with identification information of the card, and wherein the controller further executes the following processing of:

when the two parallel line pairs corresponding to the four sides are not present, determining whether one parallel line pair and one line segment for configuring three sides of the rectangle are present; and forming the rectangle by the one parallel line pair and the one line segment when the one parallel line pair and the one line segment for configuring three sides of the rectangle are present.

9. The casino table according to claim 8, wherein the controller further comprises (5-2-1) processing of deleting remaining card information except for one card information, out of card information indicating the same rectangle, when there are a plurality of card information indicating the same rectangle, out of the card information stored by the processing of (5-1-3).

10. The casino table according to claim 8, wherein the controller further executes the following processing of:

generating each combination of two line segments from the one parallel line pair and the one line segment; and determining that the one parallel line pair and the one line segment for configuring three sides of the rectangle are present when a product of the two line segments is substantially zero in each combination.

11. The casino table according to claim 8, wherein the processing of (5-1-1) to (5-1-5) is performed while the game is played.

* * * * *